US006528979B2

(12) United States Patent
Kimura

(10) Patent No.: US 6,528,979 B2
(45) Date of Patent: Mar. 4, 2003

(54) REFERENCE CURRENT CIRCUIT AND REFERENCE VOLTAGE CIRCUIT

(75) Inventor: Katsuji Kimura, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 10/071,022

(22) Filed: Feb. 8, 2002

(65) Prior Publication Data

US 2002/0158614 A1 Oct. 31, 2002

(30) Foreign Application Priority Data

Feb. 13, 2001 (JP) ..... 2001-036139

(51) Int. Cl.[7] ..... G05F 3/16; G05F 3/20
(52) U.S. Cl. ..... 323/313; 323/907; 323/314
(58) Field of Search ..... 323/315, 314, 323/907, 313

(56) References Cited

U.S. PATENT DOCUMENTS

| | | | | | |
|---|---|---|---|---|---|
| 4,528,496 | A | | 7/1985 | Naokawa et al. | 323/315 |
| 5,440,224 | A | | 8/1995 | Kimura | 323/313 |
| 5,512,817 | A | * | 4/1996 | Nagaraj | 323/316 |
| 5,570,008 | A | * | 10/1996 | Goetz | 323/315 |
| 5,627,461 | A | | 5/1997 | Kimura | 323/312 |
| 5,783,936 | A | * | 7/1998 | Girard et al. | 323/315 |
| 5,910,749 | A | | 6/1999 | Kimura | 327/541 |
| 5,926,062 | A | | 7/1999 | Kuroda | 327/538 |
| 5,942,888 | A | | 8/1999 | Tan | 323/315 |
| 6,002,244 | A | * | 12/1999 | Wrathall | 323/315 |
| 6,097,179 | A | * | 8/2000 | Ray et al. | 323/273 |
| 6,181,121 | B1 | * | 1/2001 | Kirkland et al. | 323/313 |
| 6,351,111 | B1 | * | 2/2002 | Laraia | 323/315 |

FOREIGN PATENT DOCUMENTS

| | | | |
|---|---|---|---|
| EP | 0 411 657 A1 | 3/1990 | G05F/3/30 |
| JP | 59-191629 | 10/1984 | |
| JP | 07200086 | 4/1995 | G05F/3/30 |
| JP | 7-200086 | 8/1995 | |

OTHER PUBLICATIONS

Neuteboom, Harry and Ben M.J. Kup and Mark Janssens, "A DSP–Based Hearing Instrument IC". IEEE Journal of Solid–State Circuits, vol. 32, No. 11, Nov. 1997, pp. 1790–1806.

* cited by examiner

*Primary Examiner*—Bao Q. Vu
(74) *Attorney, Agent, or Firm*—Hayes Soloway P.C.

(57) ABSTRACT

There is disclosed a reference current circuit capable of preventing an appearance of the effect of the Early voltage, operated from a low power supply voltage, and adapted to output a current having a positive or optional temperature characteristic. In this reference current circuit, by a self-biased method, a current of a current mirror circuit is set to be proportional or substantially inversely proportional to a temperature by first and second transistors constituting a non-linear current mirror circuit. A third transistor is provided. A current of the third transistor proportional to a third voltage between a control terminal and a current input terminal is set to be substantially inversely proportional to the temperature, and the currents of the current mirror circuit and the third transistor are weighted and added. Thus, an output current having a fixed temperature current is obtained.

21 Claims, 21 Drawing Sheets

REFERENCE CURRENT CIRCUIT AND REFERENCE VOLTAGE CIRCUIT

BACKGROUND OF THE INVENTION

1. Field of the Invention

The present invention relates to a reference current circuit and a reference voltage circuit. More particularly, the present invention relates to a bipolar or CMOS reference current circuit formed on a semiconductor integrated circuit, adapted to prevent an appearance of an effect of an early voltage, and operated from a low voltage to output a reference current having a positive temperature characteristic, alternatively to a bipolar or CMOS reference current circuit for outputting a reference current having an optional temperature characteristic. Furthermore, the present invention relates to a bipolar or CMOS reference voltage circuit operated from a low voltage to output a low reference voltage having no temperature characteristics.

2. Description of the Prior Art

First, description will be made of a conventional art regarding a reference current circuit. A reference current circuit has conventionally been available, which is adapted to prevent an appearance of an effect of such an early voltage, and output a reference current having a fixed temperature characteristic. Examples are a bipolar reference current circuit described in Japanese Patent Application Laid-Open No. 191629/1984, and a bipolar reference current circuit and a CMOS reference voltage circuit described in Japanese Patent Application Laid-Open No. 200086/1995.

Now, an operation of the conventional bipolar reference current circuit will be described.

FIG. 1 shows the bipolar reference current circuit described in Japanese Patent Application Laid-Open No. 191629/1984, which is generally called a proportional to absolute temperature (PTAT) current source circuit because it outputs a current proportional to a temperature. However, the PTAT current source circuit shown in FIG. 1 is adapted to prevent an appearance of an effect of an early voltage. It is because collectors of respective transistors Q5 and Q6 are connected to bases of respective transistors Q3 and Q4 and, by setting currents flowing to the transistors Q3 and Q4 equal to each other, base baias voltages of the transistors Q3 and Q4 can be set equal to each other, and thus collector voltages of the transistors Q5 and Q6 are set equal to each other.

In FIG. 1, the transistors Q2 and Q3 are set as unit transistors, and an emitter area ratio of a transistor Q1 is set to be $K_1$ times ($K_1$>1) as large as that of the unit transistor. Here, if base width modulation is ignored, a relation between a collector current $I_C$ of the transistor and a voltage $V_{BE}$ between the base and an emitter is represented by the following equation (1):

$$I_C=KI_S \exp(V_{BE}/V_T) \tag{1}$$

In this case, $I_S$ denotes a saturation current of the unit transistor; and $V_T$ a thermal voltage, which is represented by $V_T$=kT/q. Here, q denotes a unit electron charge; k Boltzmann constant; T absolute temperature; and K an emitter area ratio with respect to the unit transistor.

Assuming that a DC current amplification factor of the transistor is sufficiently near 1, by ignoring a base current, in the bipolar inverse Widlar current mirror circuit, from the equation (1), relations thus established are represented by the following equations:

$$V_{BE1}=V_T \ln\{I_{C1}/(K_1 I_S)\} \tag{2}$$

$$V_{BE2}=V_T \ln(I_{C2}/I_S) \tag{3}$$

$$V_{BE2}=V_{BE1}+R_1 I_{C1} \tag{4}$$

Now, by solving the equation (4) from the equation (1), a relation of an input/output current of the bipolar inverse Widlar current mirror circuit is obtained by the following equation (5):

$$I_{C2}=(I_{C1}/K_1)\exp(R_1 I_{C1}/V_T) \tag{5}$$

FIG. 2 shows an input/output characteristic of the bipolar inverse Widlar current mirror.

In this case, the transistor Q3 drives the transistor Q4. The transistor Q4 constitutes a current mirror circuit having a current mirror ratio of 1:1 with the transistors Q5 and Q6. Since the transistors Q1 and Q2 are respectively driven by the transistors Q5 and Q6, the bipolar self-biased inverse Widlar reference current circuit is provided, and a relation is represented by the following equation (6):

$$I_{C2}=I_{C1} \tag{6}$$

In the bipolar inverse Widlar current mirror circuit, a mirror current $I_{C2}$ is exponentially increased with respect to an increase of a reference current $I_{C1}$. Thus, if an operation point is ($I_p=(V_T/R_1)\ln K_1=I_{C1}=I_{C2}$), then $I_{C1}>I_{C2}$ is established with $I_p>I_{C1}$, and $I_{C1}<I_{C2}$ is established with $I_p<I_{C1}$. Accordingly, when Ip+ΔI (ΔI>0) is supplied to the transistors Q4 to Q6, $I_{C4}=I_{C6}=I_{C1}$=Ip+ΔI is established. However, since $I_{C2}>I_{C5}$=Ip+ΔI is established to cause a shortage of current supplied from the transistor Q5, the base current of the transistor Q3 is pulled, and the transistor Q3 turns off. Thus, a current flowing to the transistor Q3 is reduced, and currents of the transistors Q4 to Q6 are also reduced to return to IP. Conversely, when $I_p$−ΔI (ΔI>0) is supplied to the transistors Q4 to Q6, $I_{C4}=I_{C6}=I_{C1}=I_p$−ΔI is established. However, since $I_{C2}<I_{C5}$=Ip−ΔI is established to cause a current supplied from the transistor Q5 to be excessive, a current is pushed into the base of the transistor Q3, and the transistor Q3 turns on. Accordingly, a current flowing to the transistor Q3 is increased, and currents of the transistors Q4 to Q6 are also increased to return to $I_p$. That is, a negative feedback current loop is constituted, an operation point is uniquely decided with $I_{C1}>0$, realizing a stable operation.

In addition, since the following equation (7) is established, $$\begin{aligned}\Delta V_{BE} &= V_{BE2}-V_{BE1} = V_T\ln(I_{C1}/I_S) - V_T\ln\{I_{C2}/(K_1 I_S)\} \\ &= V_T\ln(I_{C1}/I_{C2}) = V_T\ln(K_1) = R_1 I_{C1}\end{aligned} \tag{7}$$

an equation (8) is obtained:

$$I_{C1}=I_{C2}=(V_T/R_1)\ln(K_1) \tag{8}$$

Here, $K_1$ denotes a constant having no temperature characteristics and, as described above, the thermal voltage $V_T$ is represented by $V_T$=kT/q, exhibiting a temperature characteristic of 3333 ppm/° C. Accordingly, if a temperature characteristic of a resistor R1 is smaller than that of the thermal voltage $V_T$, exhibiting a primary characteristic with respect to a temperature, an output current $I_0$ of the reference current circuit outputted through the current mirror circuit is proportional to the temperature, realizing a PTAT current source circuit. In this case, since currents flowing to the transistors Q1 to A3 are all equal to one another, base bias voltages of the transistors Q2 and Q3 are also equal to each other. Thus, since collector voltages of the transistors Q5 and Q6 are fixed with these base bias voltages of the transistors Q2 and Q3, and equally set, no effects of Early voltages of the transistors Q1 and Q2 appear. Since no changes occur in a desired current mirror ratio even if the collector voltages of the transistors Q5 and Q6 are changed to cause an appearance of effects of Early voltages, a highly accurate current output having only small changes with respect to fluctuation in a power supply voltage is obtained.

Next, a conventional art regarding a reference voltage circuit will be described. A reference voltage circuit having no temperature characteristics because of cancellation, and adapted to output a reference voltage of 1.2 V or lower has conventionally been available. An example is described in IEEE Journal of Solid-State Circuits, Vol. 32, No. 11, pp.1790 to 1806, November 1997.

First, an operation of this exemplary reference voltage circuit will be described. FIG. 3 shows the reference voltage circuit described in IEEE Journal of Solid-State Circuits, Vol. 32, No. 11, pp. 1790 to 1806, November 1997. A current proportional to a temperature is generally outputted. Thus, an output current of a reference current circuit called a proportional to absolute temperature (PTAT) current source circuit is supplied into an output circuit, where it is converted into a voltage and set as a reference voltage.

In FIG. 3, transistors Q1 and Q2 are set as unit transistors, and an emitter area ratio of the transistor Q2 is set to be $K_1$ times ($K_1$>1) as large as that of the unit transistor. If the base width modulation is ignored, then a relation between a collector current $I_C$ of the transistor, and a voltage $V_{BE}$ between the base and an emitter is represented by the following equation (9):

$$I_C=KI_S \exp(V_{BE}/V_T) \tag{9}$$

In this case, $I_S$ denotes a saturation current of the unit transistor; and $V_T$ the thermal voltage, which is represented by $V_T$=kT/q. Here, q denotes a unit electron charge; k Boltzmann constant; T absolute temperature; and K an emitter area ratio with respect to the unit transistor.

Assuming that a DC current amplification factor of the transistor is sufficiently near 1, if a base current is ignored, relations thus established are represented by the following equations (10) to (12):

$$V_{BE1}=V_T \ln(I_{C1}/I_S) \tag{10}$$

$$V_{BE2}=V_T \ln\{I_{C2}/(K_1 I_S)\} \tag{11}$$

$$V_{BE2}=V_{BE1}+R_1 I_{C2} \tag{12}$$

A solution of the equation (12) from the equation (10) is represented by the following equation (13):

$$V_T \ln\{K_1 I_{C1}/I_{C2}\}=R_1 I_{C2} \tag{13}$$

In this case, since a common gate voltage of transistors M4 and M5 are controlled through an operation amplifier to establish the equation (12), the transistors Q1 and Q2 are self-biased, which is represented by the following equation (14).

$$I_{D4}=I_{D5}=I_{C1}=I_{C2} \tag{14}$$

Accordingly, the equation (13) is obtained by the following equation (15):

$$I_{D4}=I_{D5}=I_{C1}=I_{C2}=V_T \ln(K_1)/R_1 \tag{15}$$

In addition, a transistor M6 constitutes a current mirror circuit with the transistors M4 and M5, the following equation (16) is established:

$$I_{D4}=I_{D5}=I_{D6} \tag{16}$$

A drain current $I_{D6}$ of the transistor M6 is converted into a voltage by the output circuit, and set as a reference voltage $V_{REF}$. Assuming that a current flowing to a resistor R2 is $\gamma I_{D6}$ ($0<\gamma<1$), the reference voltage is represented by the following equation (17):

$$V_{REF}=V_{BE3}+R_2\gamma I_{D6}=R_3(1-\gamma)I_{D6} \tag{17}$$

A solution γ of the equation (17) is represented by the following equation (18):

$$\gamma=(-V_{BE3}+R_3 I_{D6})/\{I_{D6}(R_2+R_3)\} \tag{18}$$

Accordingly, the reference voltage $V_{REF}$ is obtained by the following equation (19):

$$\begin{aligned} V_{REF} &= \{I_{D6}(R_2+R_3)\}(V_{BE3}+R_2 I_{D6}) \\ &= \{I_{D6}(R_2+R_3)\}\{V_{BE3}+(R_2/R_1)V_T \ln(K_1)\} \end{aligned} \tag{19}$$

In this case, a coefficient term $R_3/(R_2+R_3)$ of the equation (19) is $0<R_3/(R_2+R_3)<1$. Regarding a second term of $\{V_{BE3}+(R_2/R_1)V_T \ln(K1)\}$, $V_{BE3}$ has a negative temperature characteristic of about −1.9 mV/° C., and the thermal voltage $V_T$ has a positive temperature characteristic of 0.0853 mV/° C. Accordingly, in order to prevent a reference voltage $V_{REF}$ to be outputted from having no temperature characteristics, temperature characteristics are cancelled each other between a voltage having a positive temperature characteristic and a voltage having a negative temperature characteristic. That is, in this case, a value of $(R_2/R_1)\ln(K1)$ is 22.3, and a voltage value of $(R_2/R_1)V_T \ln(K1)$ is 0.57 V. Now, if $V_{BE3}$ is 0.7 V, then $\{V_{BE3}+(R_2/R_1)V_T \ln(K1)\}$=1.27 V is obtained. Thus, since $R_3/(R_2+R_3)<1$ is established, the reference voltage $V_{REF}$ can be set to a value equal to 1.27 V or lower, e.g., 1.0 V.

However, the following problems are inherent in the conventional reference current circuit.

Conventionally, in the reference current circuit for outputting a reference current having a positive temperature characteristic similar to the above, a non-linear current mirror circuit was used for the PTAT current source circuit, and prevention of an appearance of an effect of an early voltage was achieved only by using the foregoing Widlar current mirror circuit or the Widlar current mirror circuit described in the other embodiment of Japanese Patent Application Laid-Open No. 191629/1984 as the non-linear current mirror circuit.

In addition, it is difficult to provide a reference current circuit having an optional temperature characteristic, adapted to prevent an appearance of an effect of an early voltage, by a currently available technology.

Reference current circuits are usually used for bias currents in circuits of an LSI including an analog LSI, a digital LSI such as a memory, and many other kinds of an LSI. Especially, the reference current circuit for outputting a current proportional to a temperature is generally called a PTAT current source circuit. However, higher integration of an LSI has made a process more detailed, lowering a power supply voltage. At present, therefore, other than the reference current circuit having a positive temperature characteristic, a reference current circuit having an optional temperature characteristic is requested. For example, a reference voltage circuit can be easily realized by converting an output current of a reference current circuit having no temperature characteristics into a voltage through a resistor, and an output voltage of an optional value can be obtained. The reference voltage circuit having no temperature characteristics is generally called a band gap reference voltage circuit, and its output voltage is near a band gap voltage 1.205 V of silicon (Si) at absolute zero. Thus, a normal operation is no longer possible by a nominal output voltage 1.2 V of a nickel-hydrogen battery or a nickel-cadmium battery as a currently most general secondary battery.

Next, problems inherent in the conventional reference voltage circuit will be described. Conventionally, in the reference voltage circuit for outputting a reference voltage having no temperature characteristics, since an operation amplifier was used for a feedback circuit of the PTAT current source circuit, operation was difficult by a low power supply voltage. That is, reference voltage circuits are usually used for bias currents in circuits of an LSI including an analog LSI, a digital LSI such as memory devices, and many other kinds of an LSI. Especially, the reference voltage circuit for outputting a voltage having no temperature characteristics is generally called a band gap reference voltage circuit. Its output voltage is near a band gap voltage 1.205 V of silicon (Si) at absolute zero.

However, higher integration of an LSI has made a process more detailed, lowering a power supply voltage. At present, therefore, a normal operation is no longer possible by a low nominal output voltage of about 1.2 V of a nickel-hydrogen battery or a nickel-cadmium battery as a current most general battery.

SUMMARY OF THE INVENTION

An object of the present invention is to provide a reference current circuit operated from a low power supply voltage of about 1 V, and adapted to output a current having a positive or optional temperature characteristic. Specifically, the object of the present invention is to provide a PTAT current source circuit using the Nagata current mirror circuit, and adapted to prevent an appearance of an effect of an early voltage, and a reference current circuit having an optional temperature characteristic by using the PTAT current source circuit thus obtained.

Another object of the present invention is to provide a reference voltage circuit operated from a low power supply voltage of about 0.9 V, and adapted to output a voltage having no temperature characteristics by simple and small circuitry.

In accordance with a first aspect of the present invention, there is provided a reference current circuit, comprising: a power supply line; a ground line; a current mirror circuit installed between the power supply line and the ground line; and a third transistor connected between between the power supply line and the ground line. In this case, the current mirror circuit includes a first resistor having one end connected to a first node, and the other end connected to a second node, a first transistor connected between the second node and the ground line, and having a control terminal connected to the first node, and a second transistor connected between a third node and the ground line, and having a control terminal connected to the second node, and the third transistor has a control terminal connected to the third node, drives the current mirror circuit for setting a current source for driving the first and second transistors as a mirror current, and constitutes a negative feedback current loop.

In accordance with a second aspect of the present invention, there is provided a reference current circuit, comprising: a power supply line; a ground line; a current mirror circuit installed between the power supply line and the ground line; and a third transistor connected between the power supply line and the ground line. In this case, the current mirror circuit includes a first resistor having one end connected to a second node, and the other end connected to the ground line, a first transistor connected between the first and second nodes, and having a control terminal connected to the first node, and a third node, and a second transistor connected between a fourth node and the ground line, and having a control terminal connected to the third node, and the third transistor has a control terminal connected to the third node, drives the current mirror circuit for setting a current source for driving the first and second transistors as a mirror current, and constitutes a negative feedback current loop.

In accordance with a third aspect of the present invention, there is provided a reference current circuit, comprising: a power supply line; a ground line; a current mirror circuit installed between the power supply line and the ground line; and a third transistor connected between the power supply line and the ground line. In this case, the current mirror circuit includes a first resistor having one end connected to a fourth node, and the other end connected to the ground line, a first transistor connected between a first node and the ground line, and having a control terminal connected to each of the first node and a second node, and a second transistor connected between a third node and the fourth node, and having a control terminal connected to the second node, and the third transistor has a control terminal connected to the third node, drives the current mirror circuit for setting a current source for driving the first and second transistors as a mirror current, and constitutes a negative feedback current loop.

In accordance with a fourth aspect of the present invention, there is provided a reference current circuit, comprising: a power supply line; a ground line; a current mirror circuit installed between the power supply line and the ground line; and a third transistor connected between the power supply line and the ground line; and second and third resistors. In this case, the current mirror circuit includes a first resistor having one end connected to a second node, and the other end connected to the ground line, a first transistor connected between the first and second nodes, and having a control terminal connected to the first node and a third node, and a second transistor connected between a fourth node and the ground line, and having a control terminal connected to the third node, the second resistor has one end connected to the first node, and the other end connected to the ground line, the third resistor has one end connected to the fourth node, and the other end connected to the ground line, and the third transistor has a control terminal connected to the fourth node, drives the current mirror circuit for setting a current source for driving the first and second transistors as a mirror current, and constitutes a negative feedback current loop.

In accordance with a fifth aspect of the present invention, there is provided a reference current circuit, comprising: a power supply line; a ground line; a current mirror circuit installed between the power supply line and the ground line; and a third transistor connected between the power supply line and the ground line; and second and third resistors. In this case, the current mirror circuit includes a first resistor having one end connected to a first node, and the other end connected to a second node, a first transistor connected between the second node and the ground line, and having a control terminal connected to the first node and a third node, and a second transistor connected between the third node and the ground line, and having a control terminal connected to the second node, the second resistor has one end connected to the first node, and the other end connected to the ground line, the third resistor has one end connected to the third node, and the other end connected to the ground line, and the third transistor has a control terminal connected to the third node, drives the current mirror circuit for setting a current source for driving the first and second transistors as a mirror current, and constitutes a negative feedback current loop.

In accordance with a sixth aspect of the present invention, there is provided a reference current circuit, comprising: a power supply line; a ground line; a current mirror circuit installed between the power supply line and the ground line; a third transistor connected between the power supply line and the ground line; and second and third resistors. In this case, the current mirror circuit includes a first resistor having one end connected to a fourth node, and the other end connected to a second node, a first transistor connected between a first node and the ground line, and having a control terminal connected to the first and second nodes, and a second transistor connected between a third node and the fourth node, and having a control terminal connected to the second node, the second resistor has one end connected to the first node, and the other end connected to the ground line, the third resistor has one end connected to the third node, and the other end connected to the ground line, and the third transistor has a control terminal connected to the third node, drives the current mirror circuit for setting a current source for driving the first and second transistors as a mirror current, and constitutes a negative feedback current loop.

Furthermore, the reference current circuit of the present invention may employ various suitable application forms described below.

A current outputted from the reference current circuit is supplied into a fifth resistor. The fifth resistor includes a plurality of resistors connected in series.

In addition, according to the reference current circuit of the present invention, a current of the third transistor is set to be substantially inversely proportional to a temperature, a current mirror circuit current flowing to the transistor of the current mirror circuit and the current of the third transistor are weighted and added, and an output current having a fixed temperature characteristic is obtained.

In accordance with a seventh aspect of the present invention, there is provided a reference voltage circuit, comprising: a power supply line; a ground line; a current mirror circuit installed between the power supply line and the ground line; and a third transistor connected between the power supply line and the ground line. In this case, the current mirror circuit includes a first resistor having one end connected to a second node, and the other end connected to the ground line, a first transistor connected between a first node and the second node, and having a control terminal connected to the first node and a third node, and a second transistor connected between a fourth node and the ground line, and having a control terminal connected to the third node, the reference voltage circuit being self-biased to constitute a reference current circuit, and including a second resistor having one end connected to a fourth node, and the other end connected to a fifth node, the third transistor connected between the fifth node and the ground line, and having a control terminal connected to the fifth node, and a third resistor having one end connected to the fourth node, and the other end connected to the ground line, and an output voltage being obtained by supplying an output current of the reference current circuit to paths of the third transistor and the third resistor through the second resistor.

In accordance with an eighth aspect of the present invention, there is provided a reference voltage circuit, comprising: a power supply line; a ground line; a current mirror circuit installed between the power supply line and the ground line; and a third transistor connected between the power supply line and the ground line. In this case, the current mirror circuit includes a first resistor having one end connected to a first node, and the other end connected to a second node, a first transistor connected between the second node and the ground line, and having a control terminal connected to the first node, and a second transistor connected between a third node and the ground line, and having a control terminal connected to the second node, the reference voltage circuit being self-biased to constitute a reference current circuit, and including a second resistor having one end connected to a fourth node, and the other end connected to a fifth node, the third transistor connected between the fifth node and the ground line, and having a control terminal connected to the fifth node, and a third resistor having one end connected to the fourth node, and the other end connected to the ground line, and an output voltage being obtained by supplying an output current of the reference current circuit to paths of the third transistor and the third resistor through the second resistor.

In accordance with a ninth aspect of the present invention, there is provided a reference voltage circuit, comprising: a power supply line; a ground line; a current mirror circuit installed between the power supply line and the ground line; and a third transistor connected between the power supply line and the ground line. In this case, the current mirror circuit includes a first resistor having one end connected to a fourth node, and the other end connected to the ground line, a first transistor connected between a first node and the second node, and having a control terminal connected to the first node and a second node, and a second transistor connected between a third node and the fourth node, and having a control terminal connected to the second node, the reference voltage circuit being self-biased to constitute a reference current circuit, and including a second resistor having one end connected to the fourth node, and the other end connected to a fifth node, the third transistor connected between the fifth node and the ground line, and having a control terminal connected to the fifth node, and a third resistor having one end connected to the fourth node, and the other end connected to the ground line, and an output voltage being obtained by supplying an output current of the reference current circuit to paths of the third transistor and the third resistor through the second resistor.

In accordance with a tenth aspect of the present invention, there is provided a reference voltage circuit, comprising: a power supply line; a ground line; a current mirror circuit installed between the power supply line and the ground line; and a third transistor connected between the power supply line and the ground line. In this case, the current mirror circuit includes a first resistor having one end connected to a second node, and the other end connected to the ground line, a first transistor connected between a first node and the second node, and having a control terminal connected to the first node and a third node, and a second transistor connected between a fourth node and the ground line, and having a control terminal connected to the third node, the third transistor connected between a fifth node and the ground line drives a reference transistor of the current mirror circuit for setting a current source for driving the first and second transistors as a mirror current, and constitutes a negative feedback current loop, and the reference voltage circuit including a second resistor having one end connected to the fourth node, and the other end connected to the fifth node, the third transistor connected between the fifth node and the ground line, and having a control terminal connected to the fifth node, and a third resistor having one end connected to the fourth node, and the other end connected to the ground line, and an output voltage being obtained by supplying an output current proportional to a current of the current source for driving the first and second transistors to paths of the third transistor and the third resistor through the second resistor.

In accordance with an eleventh aspect of the present invention, there is provided a reference voltage circuit, comprising: a power supply line; a ground line; a current mirror circuit installed between the power supply line and the ground line; and a third transistor connected between the power supply line and the ground line. In this case, the current mirror circuit includes a first resistor having one end connected to a first node, and the other end connected to a second node, a first transistor connected between the second node and the ground line, and having a control terminal connected to the first node, and a second transistor connected between a third node and the ground line, and having a control terminal connected to the second node, and the third transistor connected between a fifth node and the ground line wire drives a reference transistor of the current mirror circuit for setting a current source for driving the first and second transistors as a mirror current, and constitutes a negative feedback current loop, the reference voltage circuit including a second resistor having one end connected to a fourth node, and the other end connected to the fifth node, the third transistor connected between the fifth node and the ground line, and having a control terminal connected to the fifth node, and a third resistor having one end connected to the fourth node, and the other end connected to the ground line, and an output voltage being obtained by supplying an output current proportional to a current of the current source for driving the first and second transistors to paths of the third transistor and the third resistor through the second resistor.

In accordance with a twelfth aspect of the present invention, there is provided a reference voltage circuit, comprising: a power supply line; a ground line; a current mirror circuit installed between the power supply line and the ground line; and a third transistor connected between the power supply line and the ground line. In this case, the current mirror circuit includes a first resistor having one end connected to a fourth node, and the other end connected to the ground line, a first transistor connected between a first node and the ground line, and having a control terminal connected to the first node and a second node, and a second transistor connected between a third node and the fourth node, and having a control terminal connected to the second node, and the third transistor connected between a fifth node and the ground line drives a reference transistor of the current mirror circuit for setting a current source for driving the first and second transistors as a mirror current, and constitutes a negative feedback current loop, the reference voltage circuit including a second resistor having one end connected to the fourth node, and the other end connected to the fifth node, the third transistor connected between the fifth node and the ground line, and having a control terminal connected to the fifth node, and a third resistor having one end connected to the fourth node, and the other end connected to the ground line, and an output voltage being obtained by supplying an output current proportional to a current of the current source for driving the first and second transistors to paths of the third transistor and the third resistor through the second resistor.

The reference voltage circuit of the present invention may employ various suitable application forms described below.

That is, an output circuit composed of a fourth transistor having a control terminal connected through the second resistor to a current input terminal, and a current output terminal connected to the ground line, and the third resistor having one terminal connected to the ground line, and the current mirror circuit for driving the output circuit are series-connected by n stages, and n output voltages are outputted.

According to the reference voltage circuit of the present invention, an output circuit composed of a fourth transistor having a control terminal connected through the second resistor to a current input terminal, and a current output terminal connected to the ground line, and the third resistor having one terminal connected to the ground line is series-connected by n stages, and n output voltages are outputted by sharing a circuit current.

According to the reference current circuit of the present invention, the first to third transistors are bipolar transistors.

According to the reference current circuit of the present invention, the first to third transistors are field-effect transistors.

According to the reference voltage circuit of the present invention, the first to third transistors are bipolar transistors.

Furthermore, according to the reference voltage circuit of the present invention, the first to third transistors are field-effect transistors.

According to the reference current circuit of the present invention, in the non-linear current mirror circuit composed of the two transistors having different voltages between bases and emitters (or between gates and sources), self-biasing sets a collector (or drain) current of each to be a current $I_{PTAT}$ proportional, or substantially proportional to a temperature. On the other hand, the voltage between the base and the emitter (or between the gate and the source) has a negative temperature characteristic. Thus, a current proportional to the voltage between the base and the emitter (or between the gate and the source) is set to be a current $I_{IPTAT}$ substantially inversely proportional to the temperature.

Therefore, by weighting and adding the current $I_{PTAT}$ flowing to the transistor of the non-linear current mirror circuit, and the current $I_{IPTAT}$ proportional to the current between the base and the emitter (or between the gate and the source), an output current $I_{REF}(=I_{PTAT}+I_{IPTAT})$ having a fixed temperature characteristic is obtained. Moreover, by converting the output current IREF into a voltage, a reference voltage circuit for outputting an optional voltage value having a fixed temperature characteristic can be provided.

However, in the conventional reference voltage circuit, by weighting and adding a voltage $V_{PTAT}$ proportional to an absolute temperature, and a voltage $V_{IPTAT}$ inversely proportional to the absolute temperature, a reference voltage circuit having a fixed temperature characteristic is provided. Thus, in the conventional reference voltage circuit, an operation power supply voltage exceeding $V_{PTAT}+V_{IPTAT}(=1.2\ V)$, e.g., 1.4 V or higher, was necessary. According to the present invention, however, a stable operation is provided even by a lower power supply voltage.

DETAILED DESCRIPTION OF THE PREFERRED EMBODIMENTS

Next, description will be made of the preferred embodiments of the present invention, specifically those of reference current and voltage circuits in a divided manner. First, the embodiments of the reference current circuits of the present invention will be described with reference to the accompanying drawings.

Figure 1:
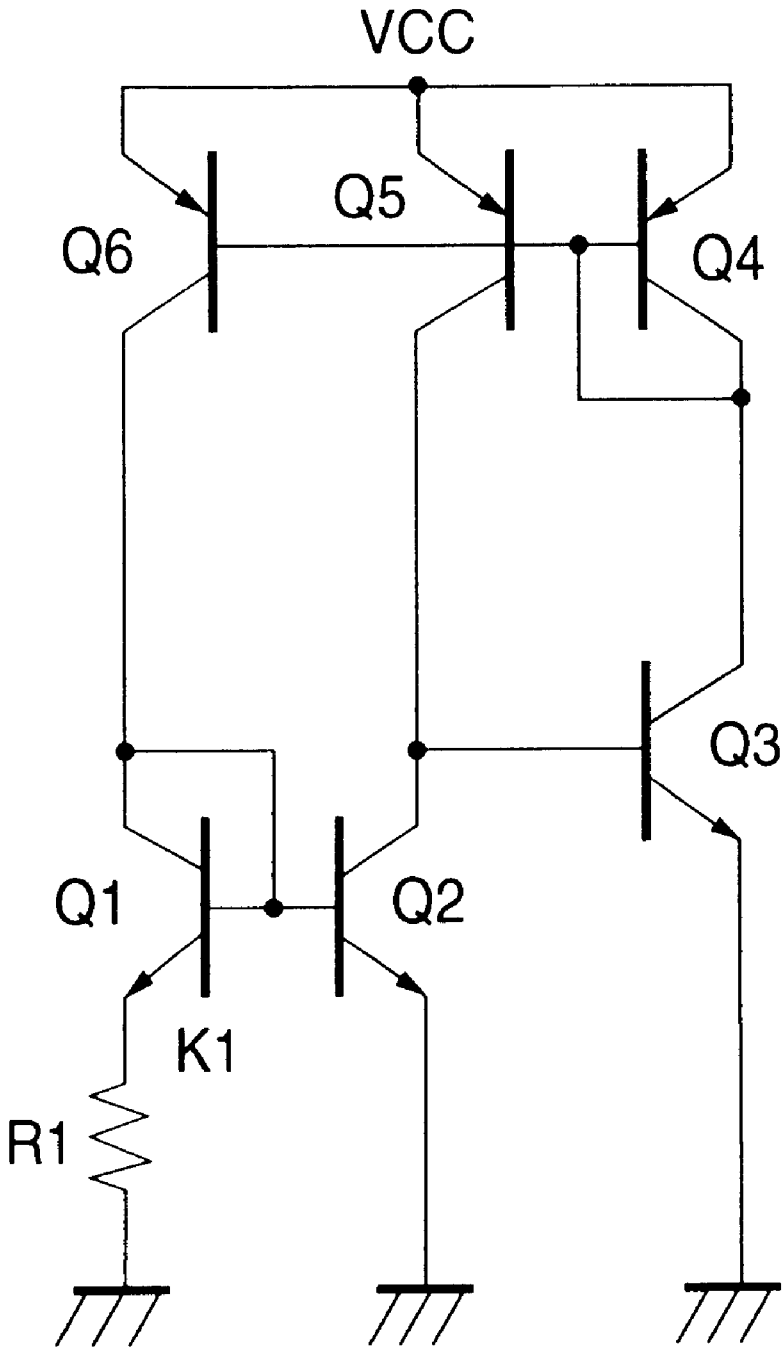
Fig.1 Prior art
FIG. 1 is a view showing an example of a conventional highly accurate bipolar PTAT reference current circuit, using a highly accurate bipolar self-biased inverse Widlar reference current circuit.
Figure 2:
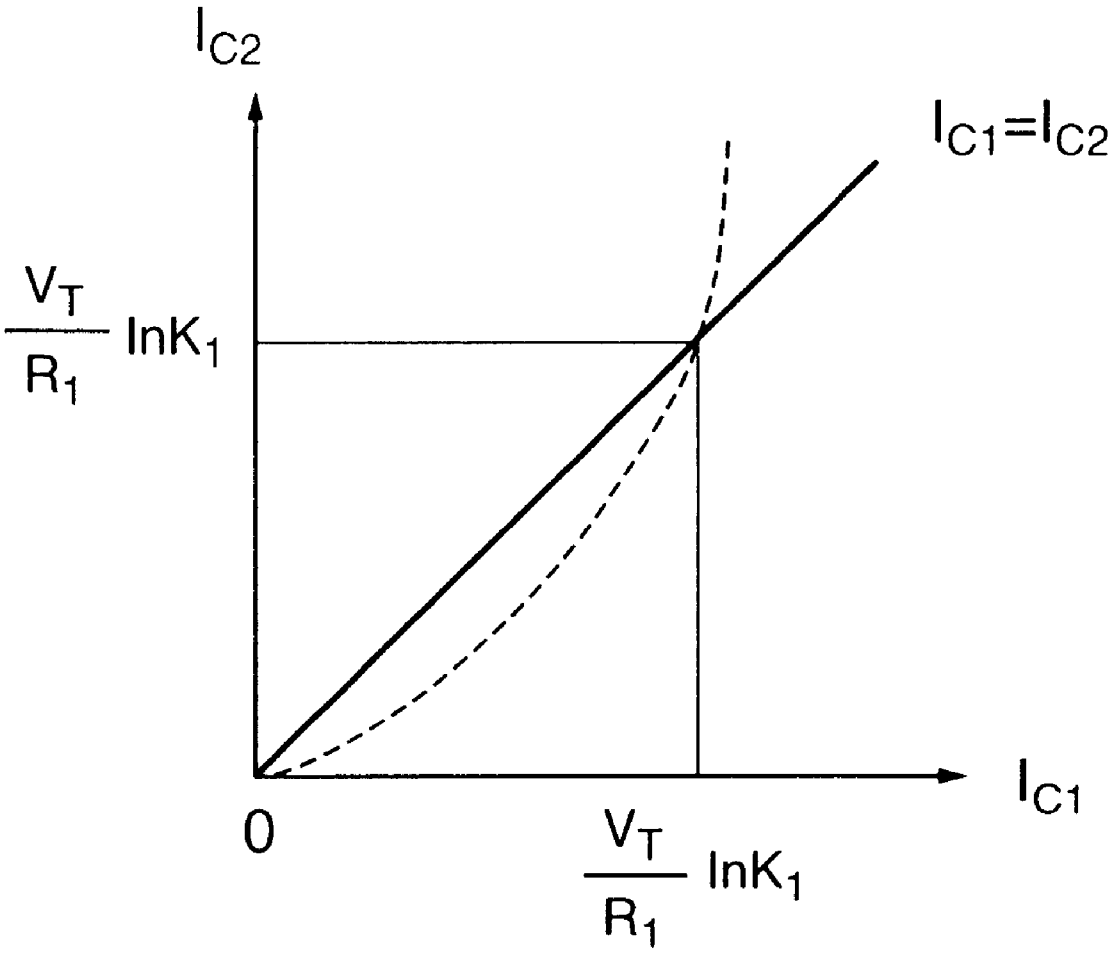
Fig.2 Prior art
FIG. 2 is a view showing an input/output characteristic of the conventional bipolar inverse Widlar current mirror circuit.
Figure 3:
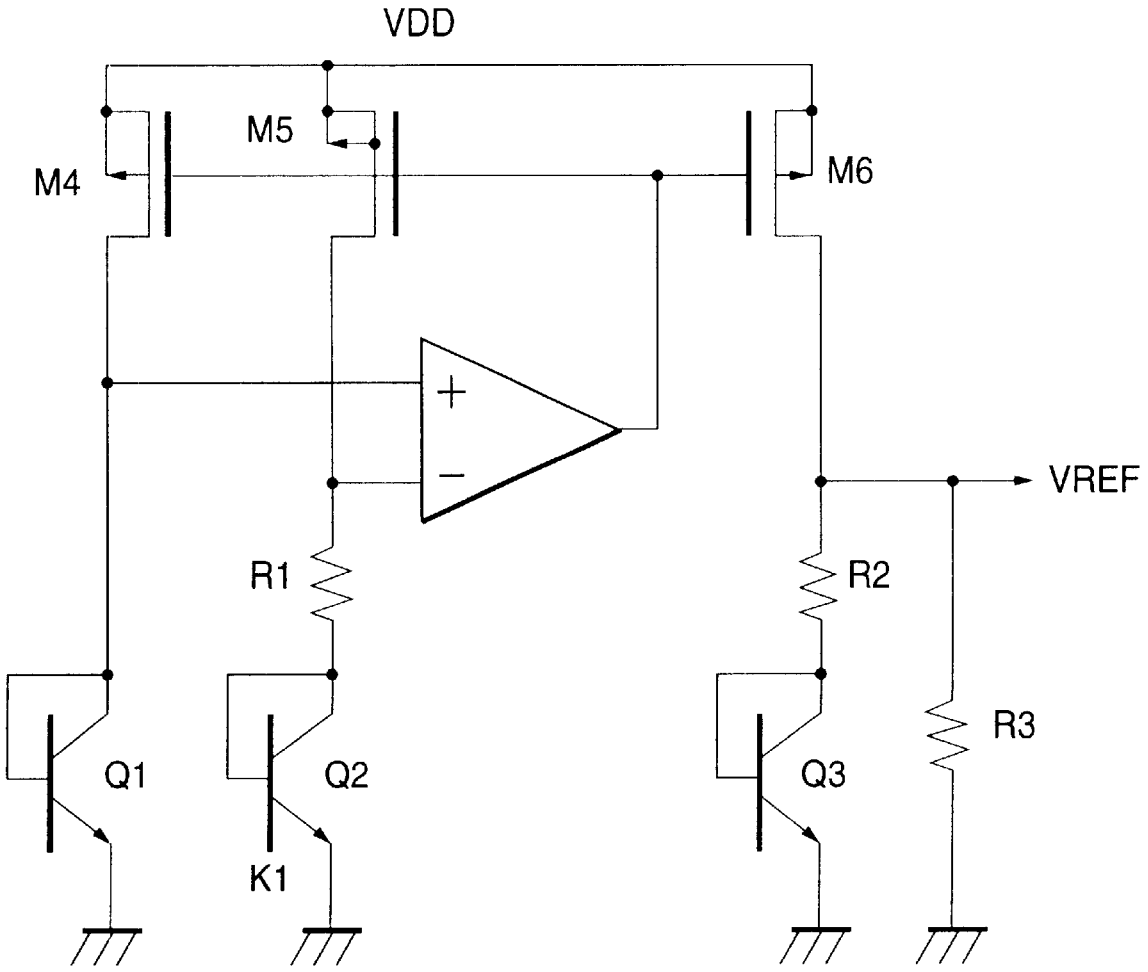
Fig.3 Prior art
FIG. 3 is a view showing a conventional reference voltage circuit using an operation amplifier.
Figure 4:
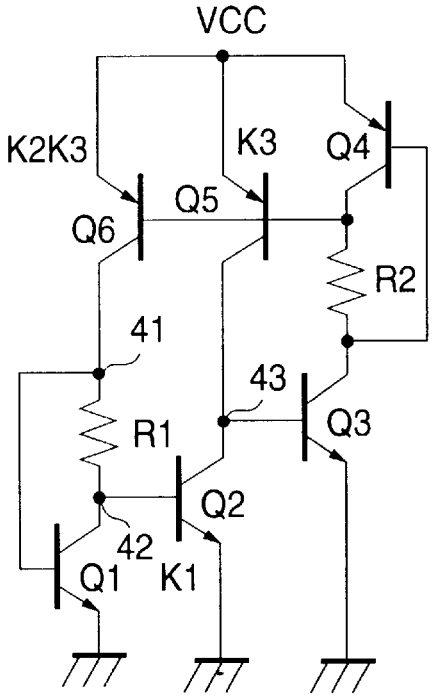
FIG. 4 is a view showing an example of a reference current circuit according to a first embodiment of the present invention, using a highly accurate bipolar self-biased Nagata reference current circuit.

FIG. 4 is a view showing an example of a reference current circuit according to a first embodiment of the present invention, specifically an embodiment of a bipolar reference current circuit.

Referring to FIG. 4, the reference current circuit of the first embodiment of the present invention is shown to be constructed in a manner that transistors Q1 and Q2, and a resistor R1 constitute the bipolar Nagata current mirror circuit, and transistors Q4, Q5, (Q6), and a resistor R4 constitute the bipolar Nagata current mirror circuit. In this case, by the transistors Q5 and Q6, the transistors Q1 and Q2, and the resistor R1 constitute the bipolar self-biased Nagata reference current circuit.

In the bipolar Nagata current mirror circuit constituted of the transistors Q4, Q5, (Q6) and the resistor R4, a circuit constant is set such that when a current of the transistor Q3 to be driven is increased, currents flowing to the transistors Q5 and Q6 can be reduced. Thus, in the bipolar self-biased Nagata reference current circuit, a negative feedback current loop is formed in the circuit, enabling the circuit to be stably operated.

In the case of the bipolar self-biased Nagata reference current circuit described in Japanese Patent Application Laid-Open No. 200086/1995, since a positive feedback current loop is formed in the circuit, the circuit is not operated.

Figure 5:
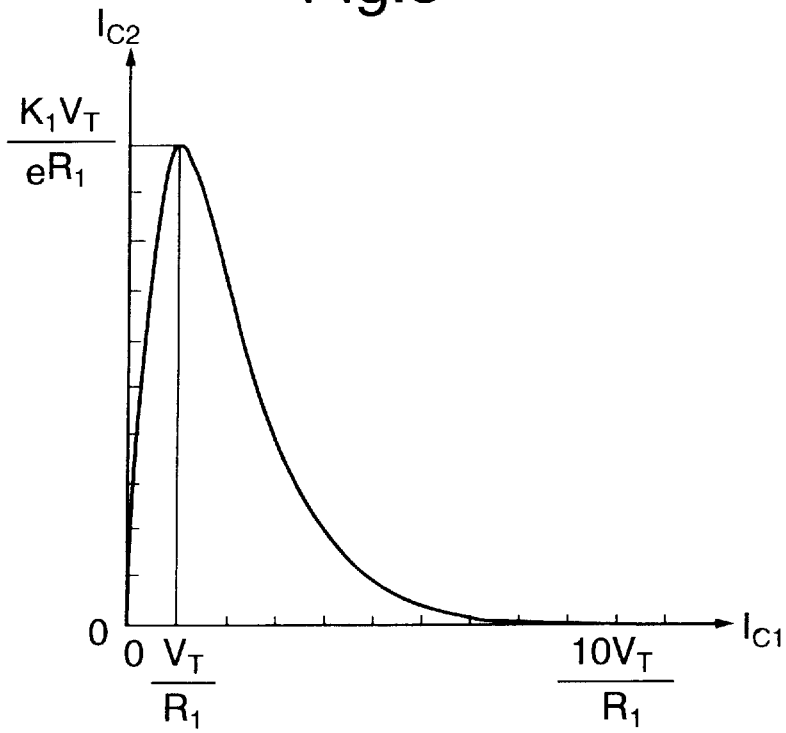
FIG. 5 is a view showing an input/output characteristic of the bipolar Nagata current mirror circuit.

FIG. 5 shows an input/output characteristic of the bipolar Nagata current mirror circuit (FIG. 4) constituted of the transistors Q1 and Q2 and the resistor R1. In the drawing, an abscissa indicates an input current $I_{C1}$, and an ordinate indicates an output current $I_{C2}$. A feature of the bipolar Nagata current mirror circuit is that there are a region where the output current (mirror current) $I_{C2}$ is monotonously increased with respect to the input current (reference current) $I_{C1}$, a peak point, and a region where the output current (mirror current) $I_{C2}$ is monotonously reduced with respect to the input current (reference current) $I_{C1}$. At the peak point, when the input current (reference current) is $I_{C1}=V_T/R_1$, the output current (mirror current) is $I_{C2}=K_1V_T/eR_1$. Assuming that a DC current amplification factor of the transistor is sufficiently near 1, by ignoring a base current, in the bipolar Nagata current mirror circuit, from the equation (1), relations are represented by the following equations (20) to (22):

$$V_{BE1}=V_T \ln(I_{C1}/I_S) \tag{20}$$

$$V_{BE2}=V_T \ln\{I_{C2}/(K_1I_S)\} \tag{21}$$

$$V_{BE1}=V_{BE2}+R_1I_{C1} \tag{22}$$

Here, by solving the equations (20) to (22), a relation between the input and output currents in the bipolar Nagata current mirror circuit is represented by the following equation (23):

$$I_{C2}=K_1I_{C1} \exp\{-R_1I_{C1}/(V_T)\} \tag{23}$$

At the peak point, with $R_1I_{C1}=V_T$, $I_{C2}=K_1I_{C1}/e$ is established, where e is 2.7183. Accordingly, with $K_1=e$, $I_{C2}=I_{C1}$ is established. In this case, the transistor Q3 drives the transistor Q4. The transistor Q4 constitutes the bipolar Nagata current mirror circuit with the transistor Q5 and Q6 and the resistor R4, which is operated in the region where the output current (mirror current) is monotonously reduced with respect to the input current (reference current). The transistors Q1 and Q2 are respectively driven by the transistors Q6 and Q5. Thus, the bipolar self-biased Nagata reference current circuit is provided, and if an emitter area ratio of the transistors Q5 and Q6 is $1:K_2$, then a relation is represented by the following equation (24):

$$I_{C1}=K_2I_{C2} \tag{24}$$

However, if the transistor Q4 is a unit transistor, an emitter area ratio of the transistor Q5 is $K_3$ times as large as that of the unit transistor; and an emitter area ratio of the transistor Q6 $K_2K_3$ times as large as that of the unit transistor. In addition, to keep the bipolar Nagata current mirror circuit operable in the region of a monotonous reduction, $K_3>e$ (=2.7183) must be set.

Therefore, since the following equation (25) is established, $$\begin{aligned}\Delta V_{BE} &= V_{BE1}-V_{BE2}=V_T\ln(I_{C1}/I_S)-V_T\ln\{I_{C2}/(K_1I_S)\} \\ &= V_T\ln(K_1I_{C1}/I_{C2})=V_T\ln(K_1K_2)=R_1I_{C1}\end{aligned} \tag{25}$$

the equation (26) is obtained:

$$I_0=I_{C1}=(V_T/R_1)\ln(K_1K_2) \tag{26}$$

Here, $K_1$ and $K_2$ denote constants having no temperature characteristics and, as described above, the thermal voltage $V_T$ is represented by $V_T=kT/q$, exhibiting a temperature characteristic of 3333 ppm/° C. Accordingly, if a temperature characteristic of the resistor R1 is smaller than the temperature characteristic of the thermal voltage $V_T$, being a primary characteristic with respect to a temperature, an output current $I_0(=I_{C1})$ of the reference current circuit outputted through the current mirror circuit is proportional to the temperature, realizing a PTAT current source circuit.

To make currents flowing to the transistors Q1 and Q3 equal to each other, the emitter area ratios K1, K2 and K3, and values of the resistors R1 and R4 are set. Thus, base bias voltages of the transistors Q1 and Q3 are substantially equal to each other, fixing and setting collector voltages of the transistors Q1 and Q3 to be equal to each other. As a result, no effects of Early voltages of the transistors Q1 and Q2 appear, and no changes occur in a desired current mirror ratio even if the collector voltages of the transistors Q5 and Q6 are changed to cause an appearance of effects of Early voltages, making it possible to obtain a highly accurate current output having only a small change with respect to fluctuation in a power supply voltage. Moreover, even when the currents flowing to the transistors Q1 and Q3 are not equal to each other, the collector voltages of the transistors Q1 and Q2 are fixed by at least the base bias voltages of the transistors Q1 and Q3, and a fluctuation extent is limited, and thus almost no effects of Early voltages (base width modulation) of the transistors Q1 and Q2 appear.

Figure 6:
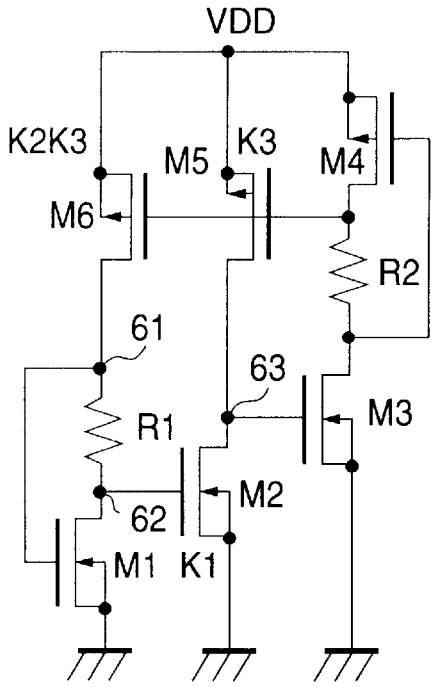
FIG. 6 is a view showing an example of the reference current circuit of the first embodiment of the present invention, using a highly accurate CMOS self-biased Nagata reference current circuit.

FIG. 6 shows the reference current circuit of the first embodiment of the present invention, specifically a CMOS reference current circuit of another embodiment. In the reference current circuit of the first embodiment of the present invention, transistors M1 and M2 and a resistor R1 constitute the Nagata current mirror circuit and, similarly, transistors M4, and M5 (M6), and a resistor R4 constitute the Nagata current mirror circuit. In this case, by the transistors M5 and M6 constituting a current source, the transistors M1 and M2 and the resistor R1 constitute the self-biased Nagata reference current circuit. In addition, the MOS Nagata reference current circuit constituted of the transistors M4 and M5 (M6), and the resistor R4 has a circuit constant set such that when a current of a transistor M3 to be driven is increased, currents flowing to the transistors M5 and M6 can be reduced. Thus, in the CMOS self-biased Nagata reference current circuit, a negative feedback current loop is formed, and the circuit is stably operated. In the case of the CMOS self-biased Nagata reference current circuit described in Japanese Patent Application Laid-Open No. 200086/1995, a positive feedback current loop is formed in the circuit, and thus the circuit is not operated.

In FIG. 6, the transistor M1 is a unit transistor, and a ratio (W/L) of a gate width W between a gate length L of the transistor M2 is $K_1$ times ($K_1$>1) as large as that of the unit transistor. In the MOS Nagata current mirror circuit shown in FIG. 6, if element consistency is high, the channel length modulation and a body effect are ignored, and a relation between a drain current and a voltage between the gate and the source of the MOS transistor is set according to a square law, then the drain current of the MOS transistor is represented by the following equation (27):

$$I_{D1}=\beta(V_{GS1}-V_{TH})^2 \tag{27}$$

Here, β denotes a transconductance parameter, which is represented by $\beta=\mu(C_{OX}/2)(W/L)$. In this case, $\mu$ denotes an effective mobility of a carrier; $C_{OX}$ a gate oxide capacitance per unit area; and W and L respectively a gate width and a gate length.

A drain current of the MOS transistor M2 is represented by the following equation (2):

$$I_{D2}=K_1\beta(V_{GS2}-V_{TH})^2 \tag{28}$$

Furthermore, a relation represented by the following equation (29) is established:

$$V_{GS1}=V_{GS2}+R_1I_{D1} \tag{29}$$

Here, by solving the equations (27) to (29), a relation between input and output currents of the MOS Nagata current mirror circuit represented by the following equation (30) is established:

$$I_{D2} = K_1\beta R_1^2 ID_1\left(\sqrt{I_{D1}} - \frac{1}{\sqrt{R_1\beta}}\right)^2 \tag{30}$$

Figure 7:
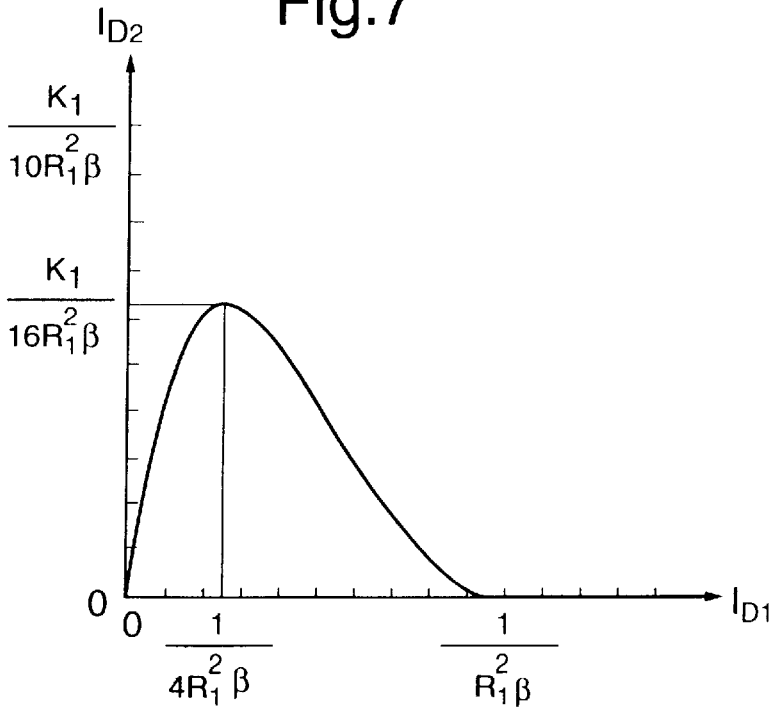
FIG. 7 is a view showing an input/output characteristic of the MOS Nagata current mirror circuit.

FIG. 7 shows an input/output characteristic of the MOS Nagata current mirror circuit constituted of the transistors M1 and M2 and the resistor R1. In the drawing, an abscissa indicates an input current $I_{D1}$, and an ordinate indicates an output current $I_{D2}$. A feature of the MOS Nagata current mirror circuit is that as in the case of the bipolar Nagata current mirror circuit, there are a region where the output current (mirror current) $I_{D2}$ is monotonously increased with respect to the input current (reference current) $I_{D1}$, a peak point, and a region where the output current (mirror current) $I_{D2}$ is monotonously reduced with respect to the input current (reference current) $I_{D1}$. At the peak point, with the input current (reference current) $I_{D1}=1/(4R_1^2\beta)$, the output current (mirror current) is $I_{D2}=K_1/16R_1^2\beta$. Normally, $I_{D2}=K_1I_{D1}/4$ is set with $I_{D1}=1/(4R_1^2\beta)$. Accordingly, $I_{D2}=I_{D1}$ is set with $K_1=4$.

In this case, the transistor M3 drives the transistor M4. The transistor M4 constitutes the MOS Nagata current mirror circuit with the transistors M5 and M6 and the resistor R4, which is operated in the region where the output current (mirror current) is monotonously reduced with respect to the input current (reference current). The transistors M1 and M2 are respectively driven by the transistors M6 and M5. Thus, the MOS self-biased Nagata current circuit is provided. If a ratio (W/L) of a gate width W between a gate length L of the transistor M5 and a ratio (W/L) of a gate width W between a gate length L of the transistor M6 is $1:K_2$, then a relation is represented by the following equation (31):

$$I_{D1}=K_2I_{D2} \tag{31}$$

If the transistor M4 is a unit transistor, a ratio (W/L) of a gate width W between a gate length L of the transistor M5 is $K_3$ times as large as that of the unit transistor; and a ratio (W/L) of a gate width W between a gate length L of the transistor M6 $K_2K_3$ times as large as that of the unit transistor. In addition, to keep the MOS Nagata current mirror circuit operable in the region of a monotonous reduction, $K_3$>4 must be set.

Therefore, a relation represented by the following equation (32) is established:

$$\Delta V_{GS}=V_{GS1}-V_{GS2}=R_1I_{D1} \tag{32}$$

By solving the equations (29) to (32), then a relation represented by the following equation (33) is obtained:

$$I_{D1} = \frac{1}{R_1^2\beta}\left(1 - \frac{1}{\sqrt{K_1K_2}}\right)^2 \tag{33}$$

Here, $K_1$ and $K_2$ denote constants having no temperature characteristics. On the other hand, since the mobility $\mu$ has a temperature characteristic in the MOS transistor, temperature dependence of the transconductance parameter β is represented by the following equation (34):

$$\beta = \beta_0\left(\frac{T}{T_0}\right)^{-\frac{3}{2}} \tag{34}$$

Here, β0 denotes a value of β at a normal temperature (300 K). Thus, a relation represented by the following equation (35) is obtained.

$$\frac{1}{\beta} = \frac{1}{\beta_0}\left(\frac{T}{T_0}\right)^{\frac{3}{2}} \tag{35}$$

Figure 8:
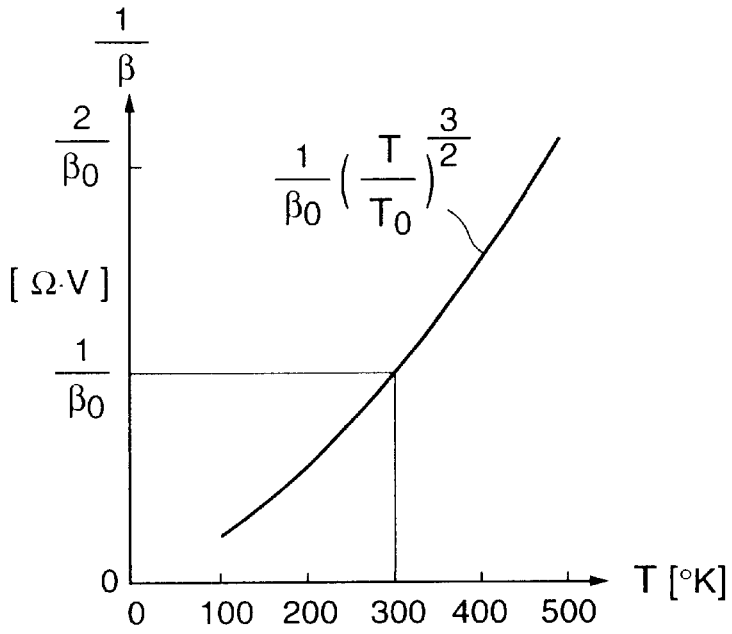
FIG. 8 is a view showing a temperature characteristic of an inverse number $1/\beta$ of a transconductance parameter.

FIG. 8 shows a calculated value of a temperature characteristic of 1/β (inverse number of the transconductance parameter) in the circuit of FIG. 6. The temperature characteristic of 1/β is 5000 ppm/° C. at a normal temperature. This is 1.5 times as large as that of a temperature characteristic 3333 ppm/° C. of the thermal voltage $V_T$ of the bipolar transistor. In other words, an output current $I_{REF}$ of the CMOS reference current circuit is represented by the following equation (36):

$$I_{REF} = I_{D1} = \frac{1}{R_1^2\beta_0}\left(\frac{T}{T_0}\right)^{\frac{3}{2}}\left(1 - \frac{1}{\sqrt{K_1K_2}}\right)^2 \tag{36}$$

Here, $K_1$ and $K_2$ denote constants having no temperature characteristics. As described above, the temperature characteristic of 1/β is substantially proportional to a temperature, being 5000 ppm/° C. at the normal temperature. This is 1.5 times as large as that of the temperature characteristic 3333 ppm/° C. of the thermal voltage $V_T$ of the bipolar transistor. Thus, if a temperature characteristic of the resistor R2 is equal to or lower than 5000 ppm/° C., being a primary characteristic with respect to the temperature, a drain current $I_{D1}$ has a positive temperature characteristic, and an output current $I_0$ of the reference current circuit outputted through the current mirror circuit is proportional to the temperature, realizing a PTAT current source circuit.

To make currents flowing to the transistors M1 and M3 equal to each other, transistor size ratios (ratio (W/L) of gate width W between gate length L (W/L)) K1, K2 and K3 are set, and values of the resistors R1 and R4 are set. Thus, gate voltages of the transistors M1 and M3 can be set substantially equal to each other, fixing and setting drain voltages of the transistors M1 and M3 to be equal to each other. As a result, no effects of the channel length modulation of the transistors M1 and M2 appear, and no changes occur in a desired current mirror ratio even if the drain voltages of the transistors M5 and M6 are changed to cause an appearance of effects of the channel length modulation, making it possible to obtain a highly accurate current output having only a small change with respect to fluctuation in a power supply voltage. Moreover, even when the currents flowing to the transistors M1 and M3 are not equal to each other, the drain voltages of the transistors M1 and M2 are fixed by at least the. gate voltages of the transistors M1 and M3, and a fluctuation extent is limited, and thus almost no effects of the channel length modulation of the transistors M1 and M2 appear.

Figure 9:
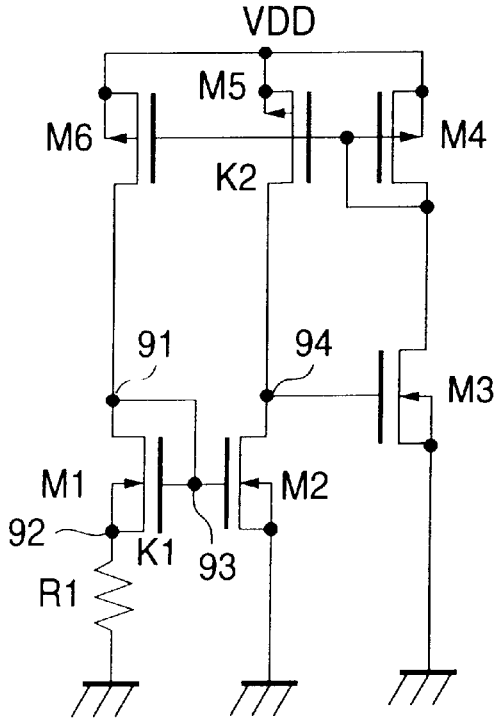
FIG. 9 is a view showing an example of a reference current circuit according to a second embodiment of the present invention, using a highly accurate CMOS self-biased inverse Widlar reference current circuit.

FIG. 9 shows a reference current circuit according to a second embodiment of the present invention, specifically an embodiment of a CMOS reference current circuit. In the reference current circuit of the second embodiment of the present invention, transistors M1 and M2, and a resistor R1 constitute the MOS inverse Widlar current mirror circuit. As described above with reference to the prior art, a negative feedback current loop is formed, and the circuit is stable operated at a set operation point. Thus, the MOS inverse Widlar current mirror circuit is self-biased to realize a CMOS reference current circuit. In FIG. 9, if the transistor M2 is a unit transistor, and a ratio (W/L) of a gate width W between a gate length L of the transistor M1 is $K_1$ times ($K_1$>1) as large as that of the unit transistor, then drain currents of the MOS transistors M1 and M2 are respectively represented by the following equations (37) and (38):

$$I_{D1}=K_1\beta(V_{GS1}-V_{TH})^2 \tag{37}$$

$$I_{D2}=\beta(V_{GS2}-V_{TH})^2 \tag{38}$$

Furthermore, a relation represented by the following equation (39) is established:

$$V_{GS2}=V_{GS1}+R_1I_{D1} \tag{39}$$

Here, by solving the equations (37) to (39), a relation is represented by the following equation (40):

$$I_{D2}=\beta I_{D1}\left(\frac{1}{\sqrt{K_1\beta}}+R_1\sqrt{I_{D1}}\right)^2 \tag{40}$$

Figure 10:
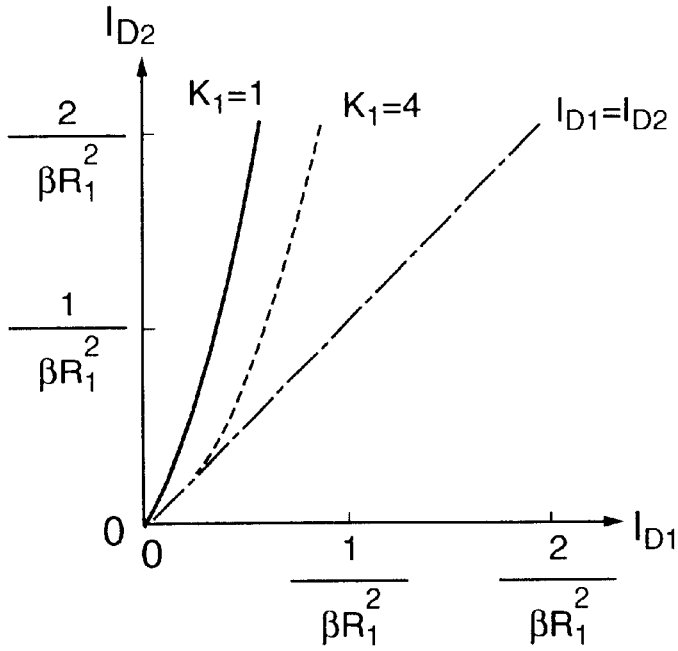
FIG. 10 is a view showing an input/output characteristic of the MOS inverse Widlar current mirror circuit.

FIG. 10 shows an input/output characteristic of the MOS inverse Widlar current mirror circuit. In the drawing, an abscissa indicates an input current $I_{D1}$, and an ordinate indicates an output current $I_{D2}$, a characteristic with $K_1$=1 and $K_1$=4 set as parameters being shown.

In this case, the transistor M3 drives the transistor M4, and the transistor M4 constitutes a current mirror circuit with the transistors M5 and M6. The transistors M1 and M2 are respectively driven by the transistors M6 and M5. Thus, the MOS self-biased inverse Widlar reference current circuit is provided, and if a ratio (W/L) of a ratio (W/L) of a gate width W btween a gate length L of the transistor M6 and M5 6 (W/L) 5 is 1:$K_2$, then a relation is represented by the following equation (41):

$$K_2I_{d1}=I_{D2} \tag{41}$$

Furthermore, a relation represented by the following equation (42) is established:

$$\Delta V_{GS}=V_{GS2}-V_{GS1}=R_1I_{D1} \tag{42}$$

By solving the equations (37) to (42), then a relation is represented by the following equation (43).

$$I_{D1}=\frac{K_2}{R_1^2\beta}\left(1-\frac{1}{\sqrt{K_1K_2}}\right)^2 \tag{43}$$

Here, $K_1$ and $K_2$ denote constants having no temperature characteristics. On the other hand, since mobility $\mu$ has a temperature characteristic in the MOS transistor, temperature dependence of a transconductance parameter β is represented byte the equation (31), and an output current $I_{REF}$ of the CMOS reference current circuit is obtained by the following equation (44):

$$I_{REF}=I_{D1}=\frac{K_2}{R_1^2\beta_0}\left(\frac{T}{T_0}\right)^{\frac{3}{2}}\left(1-\frac{1}{\sqrt{K_1K_2}}\right)^2 \tag{44}$$

Here, K1 and K2 denote constants having no temperature characteristics and, as described above, a temperature characteristic of 1/β is substantially proportional to a temperature, being 5000 ppm/° C. at a normal temperature.

Accordingly, if a temperature characteristic of the resistor R2 is equal toor lower than 5000 ppm/° C., being a primary characteristic with respect to the temperature, an output current $I_0$ of the reference current circuit outputted through the current mirror circuit is proportional to the temperature, realizing a PTAT current source circuit. Here, by setting $K_2$=1, and the transistors M2 to M6 as unit transistors, gate voltages of the transistors M1 and M3 can be set equal to each other, and drain voltages of the transistors M5 and M6 are fixed and set equal to each other. As a result, no effects of the channel length modulation of the transistors M1 and M2 appear, and no changes occur in a desired current mirror ratio even if the drain voltages of the transistors M5 and M6 are changed to cause an appearance of effects of the channel length modulation, making it possible to obtain a highly accurate current output having only a small change with respect to fluctuation in a power supply voltage. Moreover, even with $K_2\neq1$, the drain voltages of the transistors M1 and M3 are fixed by at least the gate voltages of the transistors M1 and M2, and a fluctuation extent is limited, and thus almost no effects of the channel length modulation of the transistors M1 and M2 appear.

Figure 11:
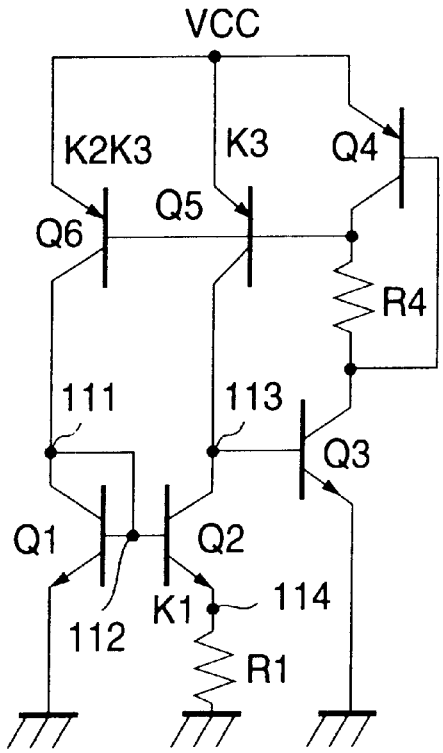
FIG. 11 is a view showing an example of a reference current circuit according to a third embodiment of the present invention, using a highly accurate bipolar self-biased Widlar reference current circuit.

FIG. 11 shows a reference current circuit according to a third embodiment of the present invention, specifically an embodiment of a bipolar reference current circuit. In the reference current circuit of the third embodiment of the present invention, transistors Q1 and Q2 and a resistor R1 constitute the bipolar Widlar current mirror circuit and, similarly, transistors Q4, Q5, (Q6), and a resistor R4 constitute the bipolar Nagata current mirror circuit. In this case, by the transistors Q5 and Q6 constituting a current source, the transistors Q1 and Q2, and the resistor R1 constitute the bipolar self-biased Widlar reference current circuit. In addition, in the bipolar Nagata current mirror circuit constituted of the transistors Q4, Q5, (Q6) and the resistor R4, a circuit constant is set such that when a current of the transistor Q3 to be driven is increased, currents flowing to the transistors Q5 and Q6 can be reduced. Thus, in the bipolar self-biased Nagata reference current circuit, a negative feedback current loop is formed, enabling the circuit to be stably operated. In the case of the bipolar self-biased Widlar reference current circuit described in Japanese Patent Application Laid-Open No. 200086/1995, a positive feedback current loop is formed in the circuit, and thus the circuit is not operated.

Assuming that a DC current amplification factor of the transistor is sufficiently near 1, by ignoring a base current, in the bipolar Widlar current mirror circuit, from the equation (1), relations are represented by the following equations (45) to (47):

$$V_{BE1}=V_T \ln(I_{C1}/I_S) \tag{45}$$

$$V_{BE2}=V_T \ln\{(I_{C2}/(K_1 I_S)\} \tag{46}$$

$$V_{BE1}=R_1 I_{C2} \tag{47}$$

Here, by solving the equations (45) to (47), a relation between input and output currents in the bipolar Widlar current mirror circuit is represented by the following equation (48):

$$I_{C1}=(I_{C2}/K_1)\exp(R_1 I_{C2}/V_T) \tag{48}$$

Figure 12:
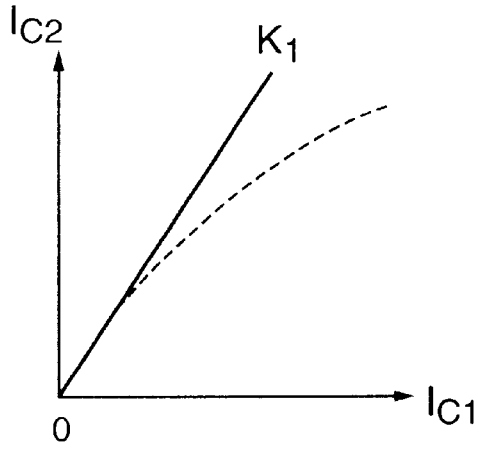
FIG. 12 is a view showing an input/output characteristic of the bipolar Widlar current mirror circuit.

A relation between input and output currents of the bipolar Widlar current mirror is just a inverse of input and output currents of the bipolar inverse Widlar current mirror circuit. FIG. 12 shows an input/output characteristic of the bipolar Widlar current mirror circuit constituted of the transistors Q1 and Q2 and the resistor R1.

In this case, the transistor Q3 drives the transistor Q4. The transistor Q4 constitutes the bipolar Nagata current mirror circuit with the transistor Q5 and Q6 and the resistor R4, which is operated in a region where the output current (mirror current) is monotonously reduced with respect to the input current (reference current). The transistors Q1 and Q2 are respectively driven by the transistors Q6 and Q5. Thus, the bipolar self-biased Widlar reference current circuit is provided, and if an emitter area ratio of the transistors Q5 and Q6 is $1:K_2$, then a relation is represented by the following equation (49):

$$I_{C1}=K_2 I_{C2} \tag{49}$$

However, if the transistor Q4 is a unit transistor, an emitter area ratio of the transistor Q5 is $K_3$ times as large as that of the unit transistor; and an emitter area ratio of the transistor Q6 is $K_2K_3$ times as large as that of the unit transistor. In addition, to keep the bipolar Nagata current mirror circuit operable in the region of a monotonous reduction, $K_3>e$ (=2.7183) must be set.

In addition, since the following equation (50) is established, $$\begin{aligned}\Delta V_{BE} = V_{BE1} - V_{BE2} &= V_T \ln(I_{C1}/I_s) - V_T \ln\{I_{C2}/(K_1 I_s)\} \\ &= V_T \ln(K_1 I_{C1}/I_{C2}) = V_T \ln(K_1 K_2) = R_1 I_{C2}\end{aligned} \tag{50}$$

the equation (51) is obtained:

$$I_0=I_{C1}=\{V_T/(R_1 K_2)\}\ln(K_1 K_2) \tag{51}$$

Here, $K_1$ and $K_2$ denote the constants having no temperature characteristics and, as described above, the thermal voltage $V_T$ is represented by $V_T$=kT/q, exhibiting a temperature characteristic of 3333 ppm/° C. Accordingly, if a temperature characteristic of the resistor R1 is smaller than the temperature characteristic of the thermal voltage $V_T$, being a primary characteristic with respect to a temperature, an output current $I_0$ (=$I_{C1}$) of the reference current circuit outputted through the current mirror circuit is proportional to the temperature, realizing a PTAT current source circuit.

To make currents flowing to the transistors Q1 and Q3 equal to each other, the emitter area ratios K1, K2 and K3, and values of the resistors R1 and R4 are set. Thus, base bias voltages of the transistors Q1 and Q3 are substantially equal to each other, fixing and setting collector voltages of the transistors Q1 and Q3 to be equal to each other. As a result, no effects of Early voltages of the transistors Q1 and Q2 appear, and no changes occur in a desired current mirror ratio even if the collector voltages of the transistors Q5 and Q6 are changed to cause an appearance of effects of Early voltages, making it possible to obtain a highly accurate current output having only a small change with respect to fluctuation in a power supply voltage. Moreover, even when the currents flowing to the transistors Q1 and Q3 are not equal to each other, the collector voltages of the transistors Q1 and Q2 are fixed by at least the base bias voltages of the transistors Q1 and Q3, and a fluctuation extent is limited, and thus almost no effects of Early voltages of the transistors Q1 and Q2 appear.

Figure 13:
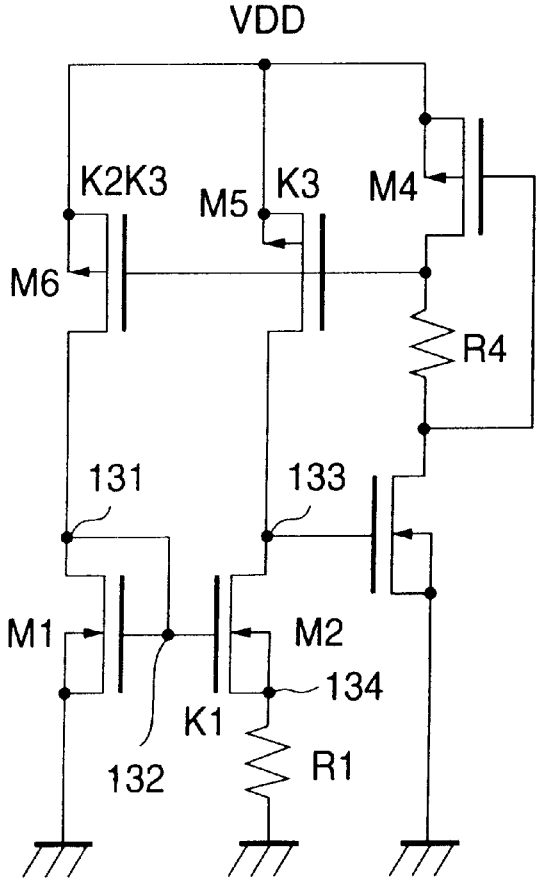
FIG. 13 is a view showing an example of the reference current circuit of the third embodiment of the present invention, using a highly accurate CMOS self-biased Widlar reference current circuit.
Figure 14:
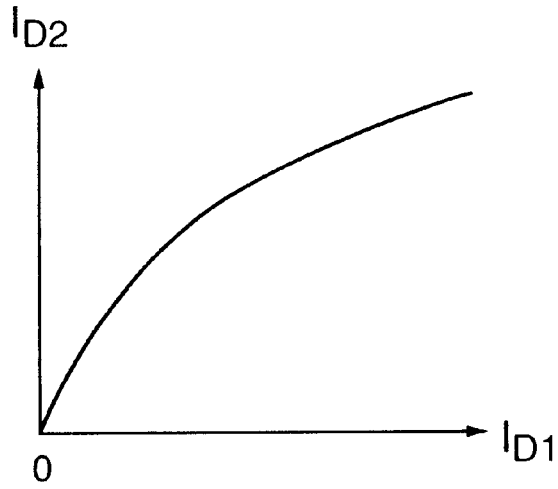
FIG. 14 is a view showing an input/output characteristic of the MOS Widlar current mirror circuit.

FIG. 13 shows the reference current circuit of the third embodiment of the present invention, specifically a CMOS reference current circuit of another embodiment. In the reference current circuit of the third embodiment of the present invention, transistors M1 and M2 and a resistor R1 constitute the MOS Widlar current mirror circuit and, similarly, transistors M4, and MS (M6), and a resistor R4 constitute the MOS Nagata current mirror circuit. In this case, by the transistors MS and M6 constituting a current source, the transistors M1 and M2 and the resistor R1 constitute the CMOS self-biased Widlar reference current circuit. In addition, the MOS Nagata reference current circuit constituted of the transistors M4 and M5 (M6), and the resistor R4 has a circuit constant set such that when a current of a transistor M3 to be driven is increased, currents flowing to the transistors MS and M6 can be reduced. Thus, in the CMOS self-biased Widlar reference current circuit, a negative feedback current loop is formed, and the circuit is stably operated. In the case of the CMOS self-biased Widlar reference current circuit described in Japanese Patent Application Laid-Open No. 200086/1995, a positive feedback current loop is formed in the circuit, and thus the circuit is not operated. FIG. 14 shows an input/output characteristic of the MOS Widlar current mirror circuit constituted of the transistors M1 and M2 and the resistor R1.

In FIG. 13, the transistor M1 is a unit transistor, and a ratio (W/L) of a gate width W between a gate length L of the transistor M2 is $K_1$ times ($K_1>1$) as large as that of the unit transistor. In the MOS Widlar current mirror circuit shown in FIG. 13, if the consistency of the circuit element is high, the channel length modulation and a body effect are ignored, and a relation between a drain current and a voltage between the gate and the source of the MOS transistor is set according to a square law, then the drain currents of the MOS transistors M1 and M2 are represented by the following equations (52) and (53):

$$I_{D1}=\beta(V_{GS1}-V_{TH})^2 \tag{52}$$

$$I_{D2}=K_1\beta(V_{GS2}-V_{TH})$$

Furthermore, a relation represented by the following equation (54) is established:

$$V_{GS1}=V_{GS2}+R_1 I_{D2} \tag{54}$$

Here, by solving the equations (52) to (54), a relation between input and output currents of the MOS Widlar current mirror circuit is represented by the following equation (55):

$$I_{D2}=\frac{1}{R_1}\sqrt{\frac{I_{D1}}{\beta}}+\frac{1}{2K_1R_1^2\beta}\left(1-\sqrt{1+4K_1R_1\sqrt{I_{D1}}}\right) \tag{55}$$

This relation between the input and output currents of the MOS Widlar current mirror circuit is a inverse of a relation between input and output currents of the MOS inverse Widlar current mirror circuit. FIG. 14 shows an input/output characteristic of the MOS Widlar current mirror circuit constituted of the transistors M1 and M2 and the resistor R1.

In this case, the transistor M3 drives the transistor M4. The transistor M4 constitutes the MOS Nagata current mirror circuit with the transistors M5 and M6 and the resistor R4, which is operated in a region where the output current (mirror current) is monotonously reduced with respect to the input current (reference current). The transistors M1 and M2 are respectively driven by the transistors M6 and M5. Thus, the MOS self-biased Widlar current circuit is provided.

If a ratio (W/L) of a gate width W between a gate length L of the transistor M5 and a ratio (W/L) of a gate width W between a gate length L of the transistor M6 is $1:K_2$, then a relation is represented by the following equation (56):

$$I_{D1}=K_2 I_{D2} \tag{56}$$

Furthermore, a relation is represented by the following equation (57):

$$\Delta V_{GS}=V_{GS1}-V_{GS2}=R_1 I_{D2} \tag{57}$$

By solving the equations (52) to (57), then a relation represented by the following equation (58) is obtained:

$$I_{D1}=\frac{K_2}{R_1^2\beta}\left(1-\frac{1}{\sqrt{K_1K_2}}\right)^2 \tag{58}$$

Here, $K_1$ and $K_2$ denote constants having no temperature characteristics. On the other hand, since the mobility $\mu$ has a temperature characteristic in the MOS transistor, the temperature dependence of the transconductance parameter $\beta$ is represented by the equation (31), and an output current $I_{REF}$ of the CMOS reference current circuit is represented by the following equation (59):

$$I_{REF}=I_{D1}=\frac{K_2}{R_1^2\beta_0}\left(\frac{T}{T_0}\right)^{\frac{3}{2}}\left(1-\frac{1}{\sqrt{K_1K_2}}\right)^2 \tag{59}$$

Here, $K_1$ and $K_2$ denote constants having no temperature characteristics. As described above, the temperature characteristic of $1/\beta$ is substantially proportional to a temperature, being 5000 ppm/° C. at the normal temperature. If a temperature characteristic of the resistor R2 is equal to or lower than 5000 ppm/° C., being a primary characteristic with respect to the temperature, a drain current $I_{D1}$ has a positive temperature characteristic, and an output current $I_0$ of the reference current circuit outputted through the current mirror circuit is proportional to the temperature, realizing a PTAT current source circuit. To make currents flowing to the transistors M1 and M3 equal to each other, transistor size ratios (ratio (W/L) of gate width W between gate length L) $K_1$, $K_2$ and $K_3$ are set, and values of the resistors R1 and R4 are set. Thus, gate voltages of the transistors M1 and M3 can be set substantially equal to each other, fixing and setting drain voltages of the transistors M1 and M2 to be equal to each other.

As a result, no effects of the channel length modulation of the transistors M1 and M2 appear, and no changes occur in a desired current mirror ratio even if the drain voltages of the transistors M5 and M6 are changed to cause an appearance of effects of the channel length modulation, making it possible to obtain a highly accurate current output having only a small change with respect to fluctuation in a power supply voltage. Moreover, even when the currents flowing to the transistors M1 and M3 are not equal to each other, the drain voltages of the transistors M1 and M2 are fixed by at least the gate voltages of the transistors M1 and M3, and a fluctuation extent is limited, and thus almost no effects of the channel length modulation of the transistors M1 and M2 appear.

The reference current circuits (PTGAT current sources) for outputting currents having positive temperature characteristics have been described. Each of the foregoing circuits is constructed such that the collector (drain) voltages of the two output transistors constituting the current mirror circuit can be equal, or substantially equal to each other. The temperature characteristics of the collector (or drain) voltages of at least the two output transistors constituting the current mirror circuit are negative. By using such a temperature characteristic of the drain voltage, a current $I_{IPTAT}$ having a negative temperature characteristic is obtained, and this current $I_{IPTAT}$ and a current $I_{PTAT}$ having a positive temperature characteristic obtained from the PTAT current mirror source are weighted and added. Thus, it is possible to realize a reference current circuit for outputting a current having an optional temperature characteristic.

Figure 15:
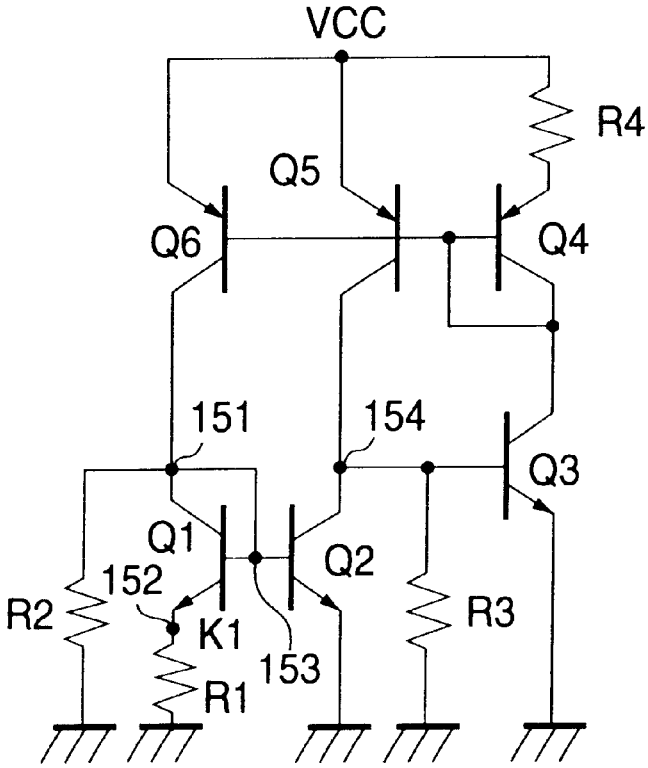
FIG. 15 is a view showing an example of a reference current circuit according to a fourth embodiment of the present invention, using a bipolar inverse Widlar reference current circuit.

FIG. 15 shows a reference current circuit according to a fourth embodiment of the present invention, specifically an embodiment of a bipolar reference current circuit, which outputs a current having an optional temperature characteristic. Referring to FIG. 15, the reference current circuit of the fourth embodiment of the present invention is shown to be constructed in a manner that transistors Q1 and Q2, and a resistor R1 constitute the bipolar inverse Widlar current mirror circuit, and transistors Q4, Q5, (Q6), and a resistor R4 constitute the bipolar inverse Widlar current mirror circuit. In this case, if a ratio of currents flowing to the resistors R2 and R3 is equal to that of currents of the current mirror circuit constituted of the transistors Q5 and Q6, the transistors Q1, Q2 (Q3), Q5 and Q6, and the resistor R1 constitute the bipolar self-biased inverse Widlar reference current circuit. Accordingly, a terminal voltage $V_1$ ($=V_{BE2}$) of the resistor R2 and a terminal voltage $V_2$ ($=V_{BE3}$) of the resistor R3 may be set equal to each other, and a ratio of resistance values of the resistors R2 and R3 may be set inverse to a current ratio of the current mirror circuit.

Assuming that a DC current amplification factor of the transistor is sufficiently near 1, by ignoring a base current, from the equation (1), relations are represented by the following equations (60) to (62):

$$V_{BE1}=V_T \ln\{I_{C1}/(K_1 I_S)\} \tag{60}$$

$$V_{BE2}=V_T \ln(I_{C2}/I_S) \tag{61}$$

$$V_{BE2}V_{BE1}+R_1I_{C1} \quad (62)$$

Then, if the transistor Q1 and the resistor R2, and the transistor Q2 and the resistor R3 are driven by a current mirror circuit having a mirror ratio of 1:1, a relation represented by the following equation (63) is established:

$$I_{C1}+V_1/R_2=I_{C2}V_2/R_3 \quad (63)$$

Here, the transistors Q4, Q5, (Q6) and the resistor R4 constitute the bipolar inverse Widlar current mirror circuit, and the transistors Q5 and Q6 are unit transistors. An emitter area ratio of the transistor Q4 is $K_3$ times as large as that of the unit transistor. By setting a resistor R4 to establish $I_{C3}=I_{C4}=I_{C2}$, $V_1=V_2$ ($\therefore V_{BE2}=V_{BE3}$) is set, and with $R_3=R_2$, the following equation (64) is established:

$$I_{C1}=I_{C2} \quad (64)$$

Thus, the following equation (65) is obtained:

$$\begin{aligned}\Delta V_{BE} &= V_{BE2}-V_{BE1}=V_T\ln(I_{C1}/I_S)-V_T\ln\{I_{C2}/(K_1I_s)\} \\ &= V_T\ln\{I_{C1}/(I_{C2}/K_1)\}=V_T\ln(K_1K_2)=R_1I_{C1}\end{aligned} \quad (65)$$

Here, $K_1$ and $K_2$ denote constants having no temperature characteristics and, as described above, the thermal voltage $V_T$ is represented by $V_T$=kT/q, exhibiting a temperature characteristic of 3333 ppm/° C. Thus, $\Delta V_{BE}$ is proportional to a temperature.

An output current $I_{REF}$ of the bipolar reference current circuit is obtained by the following equation (66):

$$\begin{aligned}I_{REF} &= I_{C2}+V_2/R_3=\Delta V_{BE}/R_1+V_{BE3}/R_3 \\ &= (V_T/R_1)\ln(K_1K_2)+V_{BE2}/R_3\end{aligned} \quad (66)$$

That is, the output current $I_{REF}$ of the bipolar reference current circuit is represented by an equation of weighting and adding a base-emitter bias voltage $V_{BE}$ having a negative temperature characteristic and $\Delta V_{BE}$ having a positive temperature characteristic. Accordingly, by changing weight factors, temperature characteristics of two reference voltages can be optionally set as described above. Specifically, an emitter area ratio or a current mirror ratio and each resistance ratio may be set. For example, by converting the output current $I_{REF}$ of the bipolar reference current circuit into a voltage by the resistor R5, an output voltage $V_{REF}$ obtained is represented by the following equation (67):

$$\begin{aligned}V_{REF} &= R_5I_{REF}=(R_5/R_1)V_T\ln(K_1K_2)+(R_5/R_3)V_{BE2} \\ &= (R_5/R_3)\{V_{BE2}+(R_3/R_1)V_T\ln(K_1K_2)\}\end{aligned} \quad (67)$$

In this case, the thermal voltage $V_T$ has a positive temperature characteristic of 3333 ppm/° C., and the base-emitter bias voltages $V_{BE2}$ and $V_{BE3}$ of the transistors Q2 and Q3 have negative temperature characteristics of about −1.9 mV/° C. The resistance ratios ($R_5/R_1$) and ($R_5/R_3$) are zero because of cancellation of temperature characteristics, and $\ln(K_1K_2)$ has no temperature characteristics. Thus, the output voltage $V_{REF}$ obtained by converting the output current of the bipolar reference current circuit into a voltage through the resistor is decided by the positive temperature characteristic, 3333 ppm/° C., of the thermal voltage $V_T$, and the negative temperature characteristic, about −1.9 mV/° C., of the base-emitter bias voltage $V_{BE2}$ of the transistor Q2. For example, in order to set zero a temperature characteristic of $V_{REF}$ obtained by voltage conversion of the output current of the bipolar reference current circuit through the resistor, if a base-emitter bias voltage $V_B$ output voltage $E_2$ (=$V_{BE3}$) of the transistor Q2 is 630 mV at a normal temperature, since the thermal voltage $V_T$ is 25.6 mV at the normal temperature, $(R_3/R_1)\ln(K_1K_2)=22.3$ is obtained. Accordingly, $\{V_{BE}(R_3/R_1)V_T\ln(K_1K_2)\}=1.2$ V is obtained. The output voltage $V_{REF}$ having the temperature characteristic of zero thus obtained can be set to an optional voltage value by optionally setting a ratio ($R_5/R_3$) of the resistors $R_5$ and $R_3$.

In the setting of $(R_5/R_3)<1$, for example a case of setting 0.7 V is considered, an operation is possible from about 0.9 V. Alternatively, if a power supply voltage has an allowance to increase a voltage, by setting $(R_5/R_3)>1$, a reference voltage having a temperature characteristic of zero at $V_{REF}>1.2$ V is obtained. Specifically, $V_{REF}=1.5$ V is obtained by setting $(R_5/R_3)=1.25$; and $V_{REF}=2.0$ V by setting $(R_5/R_3)=5/3$. As apparent from the foregoing, by setting the resistor $R_5$ to be $R_5>R_3$, and optionally providing the number (n−1) of taps in the resistor $R_5$ to set it as an output terminal, it is possible to obtain n reference voltages of optional different voltage values having no temperature characteristics.

Figure 16:
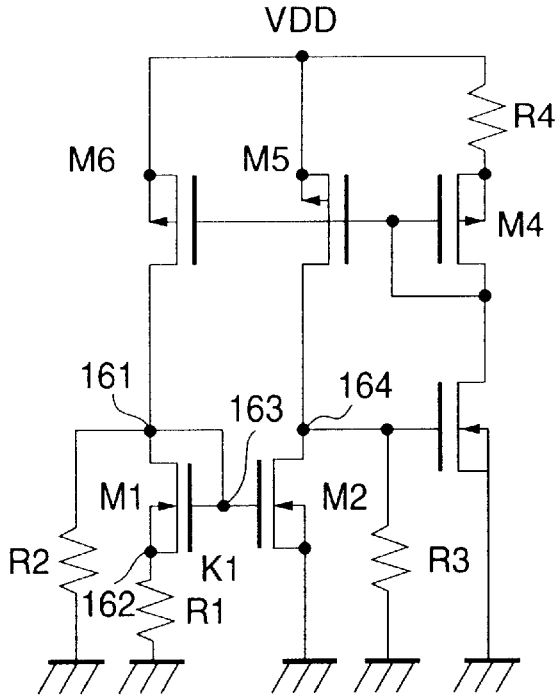
FIG. 16 is a view showing an example of the reference current circuit of the fourth embodiment of the present invention, using a CMOS inverse Widlar reference current circuit.

FIG. 16 shows the reference current circuit of the fourth embodiment of the present invention, specifically a CMOS reference current circuit of another embodiment, which outputs a current having an optional temperature characteristic. Referring to FIG. 16, the reference current circuit of the fourth embodiment of the present invention is shown to be constructed in a manner that transistors M1 and M2 and a resistor R1 constitute the MOS inverse Widlar current mirror circuit, and transistors M4, and M5 (M6), and a resistor R4 constitute the MOS inverse Widlar current mirror circuit. In this case, if a ratio of currents flowing to the resistors R2 and R3 is equal to that of currents flowing to the current mirror circuit constituted of the transistors M5 and M6, the transistors M1, and M2 (M3), M5 and M6, and the resistor R1 constitute the MOS self-biased inverse Widlar reference current circuit. Accordingly, a terminal voltage $V_2$ (=$V_{GS2}$) of the resistor R2, and a terminal voltage $V_2$ (=$V_{GS3}$) of the resistor R3 may be set equal to each other, and a ratio of resistance values of the resistors R2 and R3 may be set inverse to a current ratio of the current mirror circuit. In FIG. 16, the transistor M2 is a unit transistor, and a ratio (W/L) of a gate width W/a gate length L of the transistor M1 is $K_1$ times ($K_1>1$) as large as that of the unit transistor.

If the consistency of the circuit element is high, drain currents of the MOS transistors M1 and M2 are represented by the following equations (68) and (69):

$$I_{D1}=K_1\beta(V_{GS1}-V_{Th})^2 \quad (68)$$

$$I_{D2}=\beta(V_{GS2}V_{TH})^2 \quad (69)$$

Furthermore, a relation is represented by the following equation (70):

$$\Delta V_{GS}=V_{GS2}-V_{GS1}=R_1I_{D1} \quad (70)$$

Then, if the transistor M1 and the resistor R2, and the transistor M2 and the transistor R3 are driven by a current mirror having a mirror ratio of 1:1, the following equation (71) is obtained:

$$I_{D1}+V_1/R_2=I_{D2}+V_2/R_3 \quad (71)$$

In this case, the transistors M4 and M5 (M6), and the resistor R4 constitute the MOS inverse Widlar current mirror circuit, the transistors M5 and M6 are unit transistors, and a ratio (W/L) of a gate width W between a gate length L of the transistor M4 is $K_3$ times as large as that of the unit transistor. By setting the R4, $I_{D3}=I_{D4}=I_{D2}$ is established, realizing $V_1=V_2$ ($\therefore V_{GS2}=V_{GS3}$). With R3=R2, a relation represented by the following equation (72) is established:

$$I_{D1}=I_{D2} \tag{72}$$

Thus, by solving the equations (68) to (72), a relation represented by the following equation (73) is obtained:

$$I_{D1}=\frac{1}{R_1^2\beta}\left(1-\frac{1}{\sqrt{K_1}}\right)^2 \tag{73}$$

Here, $K_1$ denotes a constant having no temperature characteristics. On the other hand, since mobility $\mu$ has a temperature characteristic in the MOS transistor, temperature dependence of the transconductance parameter β is represented by the equation (21) and, as shown in FIG. 5, a temperature characteristic of 1/β is substantially proportional to a temperature. The temperature characteristic of 1/β is 5000 ppm/° C. at a normal temperature. Therefore, it can be understood that if a temperature characteristic of the resistor R1 is equal to or lower than 5000 ppm/° C., a drain current $I_{D1}$ has a positive temperature characteristic.

That is, an output current $I_{REF}$ of the MOS reference voltage current is obtained by the following equation (74):

$$I_{REF}=I_{D2}+V_2/R_3=I_{D1}+V_{GS2}/R_3 \tag{74}$$

On the other hand, from the equation (69), the following represented by an equation (75) is established:

$$V_{GS2}=\sqrt{\frac{1_{D2}}{\beta}}+V_{TH} \tag{75}$$

Then, the equation (74) is rewritten into the following equation (76):

$$\begin{aligned} I_{REF} &= \frac{1}{R_1^2\beta}\left(1-\frac{1}{\sqrt{K_1}}\right)^2+\frac{1}{R_1R_3\beta}\left(1-\frac{1}{\sqrt{K_1}}\right)+\frac{V_{TH}}{R_3} \\ &= \frac{1}{R_1\beta}\left(1-\frac{1}{\sqrt{K_1}}\right)\left\{\frac{1}{R_1}\left(1-\frac{1}{\sqrt{K_1}}\right)+\frac{1}{R_3}\right\}+\frac{V_{TH}}{R_3} \end{aligned} \tag{76}$$

In this case, a temperature characteristic of a threshold voltage $V_{TH}$ is represented by the following equation (77):

$$V_{TH}=V_{TH0}-\alpha(T-T_0) \tag{77}$$

Here, α is about 2.3 mV/° C. in a CMOS fabrication process of the MOS transistor having a low threshold voltage. Accordingly, the output current $I_{REF}$ of the MOS reference voltage circuit is represented by weighting and adding a term of the threshold voltage $V_{TH}$ having a negative temperature characteristic and a term of 1/β having a positive temperature characteristic. As a result, by changing weight factors, it is possible to optionally set a temperature characteristic of the reference current. For example, by converting the output current $I_{REF}$ of the MOS reference current circuit into a voltage through the resistor R5, an output voltage $V_{REF}$ is represented by the following equation (78):

$$\begin{aligned} V_{REF} &= R_5 I_{REF} \\ &= \frac{R_5}{R_1\beta_0}\left(\frac{T}{T_0}\right)^{\frac{3}{2}}\left(1-\frac{1}{\sqrt{K_1}}\right)\left\{\frac{1}{R_1}\left(1-\frac{1}{\sqrt{K_1}}\right)+\frac{1}{R_3}\right\}+\frac{R_5}{R_3}V_{TH0}-\frac{R_5}{R_3}\alpha(T-T_0) \\ &= \frac{R_5}{R_3}\left[\frac{R_3}{R_1\beta_0}\left(\frac{T}{T_0}\right)^{\frac{3}{2}}\left(1-\frac{1}{\sqrt{K_1}}\right)\left\{\frac{1}{R_1}\left(1-\frac{1}{\sqrt{K_1}}\right)+\frac{1}{R_3}\right\}+V_{TH0}-\alpha(T-T_0)\right] \end{aligned} \tag{78}$$

A right side of the equation (78) is represented by weighting and adding of voltage values caused by inverse numbers of the threshold voltage $V_{TH}$ having the negative temperature characteristic and the transconductance parameter (mobility) having the positive temperature characteristic. Accordingly, by changing weight factors, it is possible to optionally set a temperature characteristic of the output voltage $V_{REF}$ of the MOS reference voltage circuit as described above. Specifically, (W/L)/(W/L) ratio, or a current mirror ratio and resistance values, and each resistance ratio may be set. In this case, a temperature characteristic of 1/β as an inverse number of the transconductance parameter β is substantially proportional to a temperature, which is 5000 ppm/° C. at a normal temperature. A threshold voltage $V_{TH}$ of the transistor M2 has a negative temperature characteristic of about −2.3 mV/° C. The temperature characteristics of the resistance ratios ($R_5/R_1$) and ($R_5/R_3$) are zero because of cancellation, and $\sqrt{K_1}$ has no temperature characteristics. Thus, the output voltage $V_{REF}$ of the MOS reference voltage circuit is decided by the positive temperature characteristic of 5000 ppm/° C., the negative temperature characteristic of the threshold voltage $V_{TH}$ of the transistor M2, and about −2.3 mV/° C. For example, if $V_{TH0}$=0.7 V is set, the following represented by an equation (79) is obtained:

$$\frac{R_3}{R_1\beta}\left(1-\frac{1}{\sqrt{K_1}}\right)\left\{\frac{1}{R_1}\left(1-\frac{1}{\sqrt{K_1}}\right)+\frac{1}{R_3}\right\}=0.46\text{ V} \tag{79}$$

Then, the output value is represented by the following equation (80)

$$V_{REF}=(R_5/R_3)\ (0.46+0.7)=1.16(R_5/R_3)V \tag{80}$$

Here, the voltage 1.16 V has no temperature characteristics. Thus, since the temperature characteristic of the ($R_5/R_3$) is zero because of cancellation, a reference voltage $V_{REF}$ to be outputted has no temperature characteristics.

In this case, a ratio ($R_5/R_3$) of the resistors R5 and R3 can be optionally set. For example, if ($R_5/R_3$)<1 is set, an operation is possible by a low voltage. Specifically, with $R_5/R_3$=0.69, $V_{REF}$=0.8 V is set, and an operation is possible from a power supply voltage of about 1.0 V. Furthermore, ($R_5/R_3$)>1 can be set. For example, with $R_5/R_3$=1.72, $V_{REF}$= 2.0 V is set, and an operation is possible from a power supply voltage of about 2.2 V. Moreover, by providing three taps in the resistor R5, and dividing a resistance value into four parts, four reference voltages all having no temperature characteristics, i.e., $V_{REF1}$=0.5V, $V_{REF2}$=1.0V, $V_{REF3}$=1.5 V, and $V_{REF4}$=2.0 V, are obtained.

Figure 17:
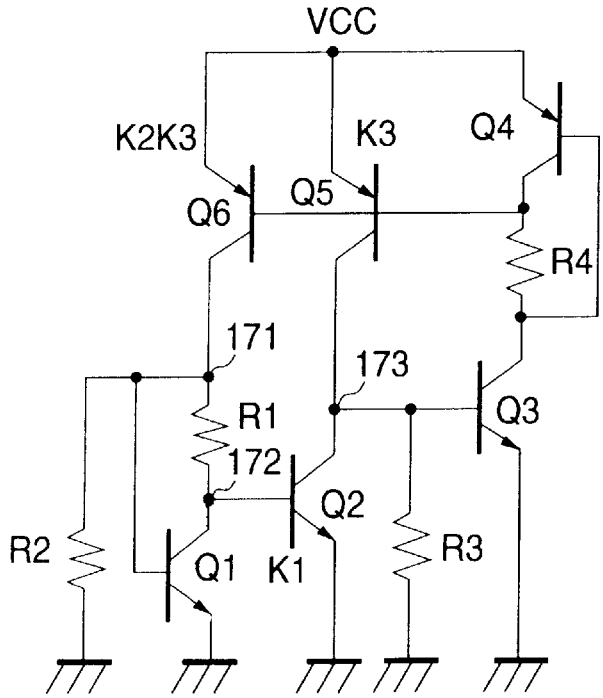
FIG. 17 is a view showing an example of a reference current circuit according to a fifth embodiment of the present invention, using a bipolar Nagata reference current circuit.

FIG. 17 shows a reference current circuit according to a fifth embodiment of the present invention, specifically an embodiment of a bipolar reference current circuit, which outputs a current having an optional temperature characteristic. Referring to FIG. 17, the reference current circuit of the fifth embodiment of the present invention is shown to be constructed in a manner that transistors Q1 and Q2, and a resistor R1 constitute the bipolar Nagata Widlar current mirror circuit, and the bipolar Nagata current mirror circuit constituted of transistors Q4, Q5, (Q6), and a resistor R4 has a circuit constant such that when a current of a transistor Q3 to be driven is increased, currents flowing to the transistors Q5 and Q6 can be reduced. Thus, a negative feedback current loop is provided in the circuit, enabling the circuit to be stably operated. In this case, if a ratio of currents flowing to the resistors R2 and R3 is equal to that of currents of the current mirror circuit constituted of the transistors Q5 and Q6, the transistors Q1, Q2 (Q3), Q5 and Q6, and the resistor R1 constitute the bipolar self-biased Nagata reference current circuit. Accordingly, $K_1$, $K_2$ and $K_3$, and the resistors R1 and R4 are set such that the terminal voltage $V_1$ (=$V_{BE2}$) of the resistor R2 and the terminal voltage $V_2$ (=$V_{BE3}$) of the resistor R3 can be set equal to each other, and a ratio of resistance values of the resistors R2 and R3 may be set inverse to a current ratio of the current mirror circuit.

Assuming that a DC current amplification factor of the transistor is sufficiently near 1, by ignoring a base current, from the equation (1), relations are represented by the following equations (81) to (83):

$$V_{BE1}=V_T \ln=(I_{C1}/I_S) \tag{81}$$

$$V_{BE2}=V_T \ln\{I_{C2}/(K_1 I_S)\} \tag{82}$$

$$V_{BE1}=V_{BE2}+R_1 I_{C1} \tag{83}$$

Then, if the transistor Q1 and the resistor R2, and the transistor Q2 and the resistor R3 are driven by a current mirror having a mirror ratio of $K_2$:1, a relation represented by the following equation (84) is established:

$$I_{C1}+V_1/R_2=K_2(I_{C2}+V_2/R_3) \tag{84}$$

Here, the transistors Q4, Q5, (Q6) and the resistor R4 constitute the bipolar Nagata current mirror circuit, and the transistors Q5 and Q6 are unit transistors. An emitter area ratio of the transistor Q4 is $K_3$ times as large as that of the unit transistor. By setting a resistor R4 to establish $I_{C1}=I_{C3}$, $V_1=V_2$ ($\therefore V_{BE2}=V_{BE3}$) is set, and with $R_3/R_2=K_2$, the following equation (85) is established:

$$I_{C1}=K_2 I_{C2} \tag{85}$$

Thus, the following equation (86) is obtained:

$$\begin{aligned}\Delta V_{BE} &= V_{BE1}-V_{BE2}=V_T\ln(I_{C1}/I_S)-V_T\ln\{I_{C2}/(K_1 I_s)\} \\ &= V_T\ln\{I_{C1}/(I_{C2}/K_1)\}=V_T\ln(K_1K_2)=R_1 I_{C1}\end{aligned} \tag{86}$$

Here, $K_1$ and $K_2$ denote constants having no temperature characteristics and, as described above, a thermal voltage $V_T$ is represented by $V_T$=kT/q, exhibiting a temperature characteristic of 3333 ppm/° C. Thus, $\Delta V_{BE}$ is proportional to a temperature.

An output current $I_{REF}$ of the bipolar reference voltage circuit is obtained by the following equation (87):

$$\begin{aligned}I_{REF} &= I_{C2}+V_2/R_3=\Delta V_{BE}/(K_2R_1)+V_{BE3}/R_3 \\ &= \{V_T/(K_2R_1)\}\ln(K_1K_2)+V_{BE1}/R_3\end{aligned} \tag{87}$$

That is, the output current $I_{REF}$ of the bipolar reference current circuit is represented by an equation of weighting and adding a base-emitter bias voltage $V_{BE}$ having a negative temperature characteristic and $\Delta V_{BE}$ having a positive temperature characteristic. Accordingly, by changing weight factors, temperature characteristics of two reference voltages can be optionally set as described above. Specifically, an emitter area ratio or a current mirror ratio and each resistance ratio may be set. For example, by converting the output current $I_{REF}$ of the bipolar reference current circuit into a voltage by the resistor R5, an output voltage $V_{REF}$ obtained is represented by the following equation (88):

$$\begin{aligned}V_{REF} &= R_5 I_{REF}=(R_5/K_2R_1)\}V_T\ln(K_1K_2)+(R_5/R_3)V_{BE1} \\ &= (R_5/R_3)[\{R_3/(K_2R_1)\}V_T\ln(K_1K_2)+V_{BE1}]\end{aligned} \tag{88}$$

In this case, the thermal voltage $V_T$ has a positive temperature characteristic of 3333 ppm/° C., and the base-emitter bias voltages $V_{BE2}$ and $V_{BE3}$ of the transistors Q2 and Q3 have negative temperature characteristics of about −1.9 mV/° C. The resistance ratios ($R_5/R_1$) and ($R_5/R_3$) are zero because of cancellation of the temperature characteristics, and $K_2$ and $\ln(K_1K_2)$ have no temperature characteristics. Thus, the output voltage $V_{REF}$ obtained by converting the output current of the bipolar reference current circuit into a voltage through the resistor is decided by the positive temperature characteristic, 3333 ppm/° C., of the thermal voltage $V_T$, and the negative temperature characteristic, about −1.9 mV/° C., of the base-emitter bias voltage $V_{BE2}$ of the transistor Q1. For example, in order to set zero a temperature characteristic of the output voltage $V_{REF}$ obtained by voltage conversion of the output current of the bipolar reference current circuit through the resistor, if a base-emitter bias voltage $V_{BE1}$ (=$V_{BE3}$) of the transistor Q1 is 630 mV at a normal temperature, since the thermal voltage $V_T$ is 25.6 mV at the normal temperature, $(R_3/K_2R_1)\ln(K_1K_2)$=22.3 is obtained. Accordingly, $\{R_3/(K_2R_1)\}V_T\ln(K_1K_2)+V_{BE1}\}$=1.2 V is obtained.

The output voltage $V_{REF}$ having the temperature characteristic of zero thus obtained can be set to an optional voltage value by optionally setting a ratio ($R_5/R_3$) of the resistors $R_5$ and $R_3$. In the setting of ($R_5/R_3$)<1, for example a case of setting 0.7 V is considered, an operation is possible from about 0.9 V. Alternatively, if a power supply voltage has an allowance to increase a voltage, by setting ($R_5/R_3$)>1, a reference voltage having a temperature characteristic of zero at $V_{REF}$>1.2 V is obtained. Specifically, $V_{REF}$=1.5 V is obtained by setting ($R_5/R_3$)=1.25; and $V_{REF}$=2.0 V by setting ($R_5/R_3$)=5/3. As apparent from the foregoing, by setting the resistor $R_5$ to be $R_5>R_3$, and optionally providing the number (n-1) of taps in the resistor $R_5$ to set it as an output terminal, it is possible to obtain n reference voltages of optional different voltage values having no temperature characteristics.

Figure 18:
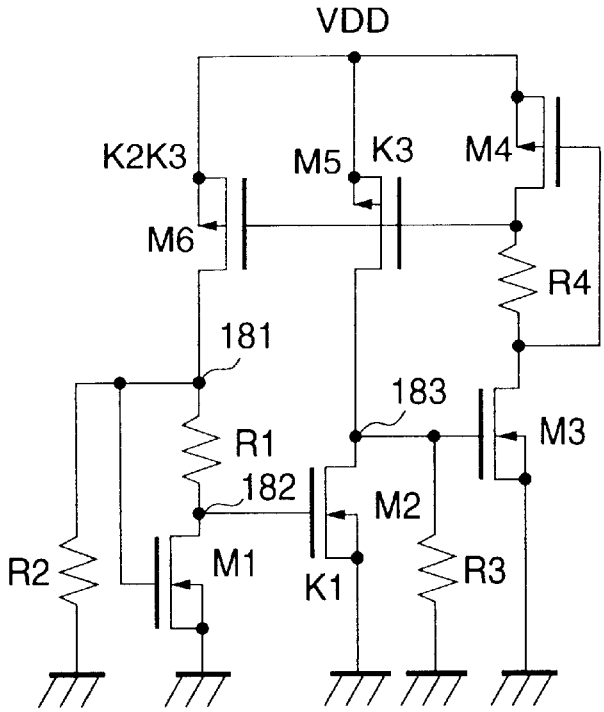
FIG. 18 is a view showing an example of the reference current circuit of the fifth embodiment of the present invention, using a CMOS Nagata reference current circuit.

FIG. 18 shows the reference current circuit of the fifth embodiment of the present invention, specifically a CMOS reference current circuit of another embodiment, which outputs a current having an optional temperature characteristic. Referring to FIG. 18, the reference current circuit of the fifth embodiment of the present invention is shown to be constructed in a manner that transistors M1 and M2 and a resistor R1 constitute the MOS Nagata current mirror circuit, and the MOS Nagata current mirror circuit constituted of transistors M4, and M5 (M6), and a resistor R4 has a circuit constant set such that when a current of a transistor M3 to be driven is increased, currents flowing to the transistors M5 and M6 can be reduced. In this case, if a ratio of currents flowing to the resistors R2 and R3 is equal to that of currents flowing to the current mirror circuit constituted of the transistors M5 and M6, the transistors M1, and M2 (M3), M5 and M6, and the resistor R1 constitute the MOS self-biased Nagata reference current circuit. Accordingly, $K_1$, $K_2$ and $K_3$, and the resistors R1 and R2 are set such that the terminal voltage $V_1$ ($=V_{GS2}$) of the resistor R2, and the terminal voltage $V_2$ ($=V_{GS3}$) of the resistor R3 may be set equal to each other, and a ratio of resistance values of the resistors R2 and R3 may be set inverse to a current ratio of the current mirror circuit. In FIG. 18, the transistor M2 is a unit transistor, and a ratio of a gate width W between a gate length L (W/L) of the transistor M1 is $K_1$ times ($K_1>1$) as large as that of the unit transistor.

If the consistency of the circuit element is high, drain currents of the MOS transistors M1 and M2 are represented by the following equations (89) and (90):

$$I_{D1}=\beta(V_{GS1}-V_{TH})^2 \tag{89}$$

$$I_{D2}K_1\beta(V_{GS2}-V_{TH})^2 \tag{90}$$

Furthermore, a relation is represented by the following equation (91):

$$\Delta V_{GS}=V_{GS1}V_{GS2}R_1I_{D1} \tag{91}$$

Then, if the transistor M1 and the resistor R2, and the transistor M2 and the transistor R3 are driven by a current mirror having a mirror ratio of $K_2$:1, the following equation (92) is obtained:

$$I_{D1}+V_1/R_2=K_2(I_{D2}+V_2/R_3) \tag{92}$$

In this case, the transistors M4 and M5 (M6), and the resistor R4 constitute the MOS Nagata current mirror circuit, the transistors M5 and M6 are unit transistors, and a ratio (W/L) of a gate width W between a gate length L of the transistor M4 is $K_3$ times as large as that of the unit transistor. By setting the R4, $I_{D1}=I_{D3}$ is established, realizing $V_1=V_2$ ($\therefore V_{GS2}=V_{GS3}$). With $R_3/R_2=K_2$, a relation represented by the following equation (93) is established:

$$I_{D1}=K_2I_{D2} \tag{93}$$

Thus, by solving the equations (89) to (92), a relation represented by the following equation (94) is obtained:

$$I_{D1}=\frac{1}{R_1^2\beta}\left(1-\frac{1}{\sqrt{K_1K_2}}\right)^2 \tag{94}$$

Here, $K_1$ and $K_2$ denote the constants having no temperature characteristics. On the other hand, since the mobility $\mu$ has a temperature characteristic in the MOS transistor, the temperature dependence of the transconductance parameter $\beta$ is represented by the equation (34) and, as shown in FIG. 5, the temperature characteristic of $1/\beta$ is substantially proportional to the temperature. The temperature characteristic of $1/\beta$ is 5000 pm/° C. at the normal temperature. Therefore, it can be understood that if the temperature characteristic of the resistor R1 is equal to or lower than 5000 ppm/° C., a drain current $I_{D1}$ has a positive temperature characteristic. That is, an output current $I_{REF}$ of the MOS reference voltage current is obtained by the following equation (95):

$$I_{REF}=I_{D2}+V_2/R_3=I_{D1}/K_3+V_{GS1}/R_3 \tag{95}$$

On the other hand, from the equation (89), the following represented by an equation (96) is established:

$$V_{GS1}=\sqrt{\frac{I_{D1}}{\beta}}+V_{TH} \tag{96}$$

Then, the equation (95) is rewritten into the following equation (97):

$$\begin{aligned} I_{REF} &= \frac{1}{R_1^2K_2\beta}\left(1-\frac{1}{\sqrt{K_1K_2}}\right)^2+\frac{1}{R_1R_3\beta}\left(1-\frac{1}{\sqrt{K_1K_2}}\right)+\frac{V_{TH}}{R_3} \\ &= \frac{1}{R_1\beta}\left(1-\frac{1}{\sqrt{K_1K_2}}\right)\left\{\frac{1}{R_1K_1}\left(1-\frac{1}{\sqrt{K_1K_2}}\right)+\frac{1}{R_3}\right\}+\frac{V_{TH}}{R_3} \end{aligned} \tag{97}$$

In this case, the temperature characteristic of the threshold voltage $V_{TH}$ is represented by the equation (77), where a is about 2.3 mV/° C. in a CMOS fabrication process of the MOS transistor having a low threshold voltage.

Accordingly, the output current $I_{REF}$ of the MOS reference voltage circuit is represented by weighting and adding a term of the threshold voltage $V_{TH}$ having a negative temperature characteristic and a term of $1/\beta$ having a positive temperature characteristic. As a result, by changing weight factors, it is possible to optionally set the temperature characteristic of the reference current. For example, by converting the output current $I_{REF}$ of the MOS reference current circuit into a voltage through the resistor R5, an output voltage $V_{REF}$ is represented by the following equation (98):

$$\begin{aligned} V_{REF} &= R_5I_{REF} \\ &= \frac{R_5}{R_1\beta_0}\left(\frac{T}{T_0}\right)^{\frac{3}{2}}\left(1-\frac{1}{\sqrt{K_1K_2}}\right)\left\{\frac{1}{R_1K_1}\left(1-\frac{1}{\sqrt{K_1K_2}}\right)+\frac{1}{R_3}\right\}+\frac{R_5}{R_3}V_{TH0}-\frac{R_5}{R_3}\alpha(T-T_0) \\ &= \frac{R_5}{R_3}\left[\frac{R_3}{R_1\beta_0}\left(\frac{T}{T_0}\right)^{\frac{3}{2}}\left(1-\frac{1}{\sqrt{K_1K_2}}\right)\left\{\frac{1}{R_1K_2}\left(1-\frac{1}{\sqrt{K_1K_2}}\right)+\frac{1}{R_3}\right\}+V_{TH0}-\alpha(T-T_0)\right] \end{aligned} \tag{98}$$

A right side of the equation (98) is represented by weighting and adding of the voltage values caused by inverse numbers of the threshold voltage $V_{TH}$ having the negative temperature characteristic and the transconductance parameter (mobility) having the positive temperature characteristic. Accordingly, by changing weight factors, it is possible to optionally set a temperature characteristic of the output voltage $V_{REF}$ of the MOS reference voltage circuit.

Specifically, a (W/L)/(W/L) ratio, or a current mirror ratio and resistance values, and each resistance ratio may be set. In this case, a temperature characteristic of 1/β as an inverse number of the transconductance parameter β is substantially proportional to the temperature, which is 5000 ppm/° C. at a normal temperature. The threshold voltage $V_{TH}$ of the transistor M2 has a negative temperature characteristic of about −2.3 mV/° C. The temperature characteristics of the resistance ratios ($R_5/R_1$) and ($R_5/R_3$) are zero because of cancellation, and $\sqrt{K_1}$ has no temperature characteristics. Thus, the output voltage $V_{REF}$ of the MOS reference voltage circuit is decided by the positive temperature characteristic of 5000 ppm/° C., the negative temperature characteristic of the threshold voltage $V_{TH}$ of the transistor M2, and about −2.3 mV/° C. For example, if $V_{TH0}$=0.7 V is set, the following represented by an equation (99) is obtained:

$$\frac{R_3}{R_1\beta_0}\left(1-\frac{1}{\sqrt{K_1K_2}}\right)\left\{\frac{1}{R_1K_2}\left(1-\frac{1}{\sqrt{K_1K_2}}\right)+\frac{1}{R_3}\right\}=0.46\text{ V} \tag{99}$$

Then, the output value is represented by the following equation (100):

$$V_{REF}=(R_5/R_3)(0.46+0.7)=1.16(R_5/R_3)V \tag{100}$$

Here, the voltage 1.16 V has no temperature characteristics.

Thus, since the temperature characteristic of the ($R_5/R_3$) is zero because of cancellation, a reference voltage $V_{REF}$ to be outputted has no temperature characteristics. In this case, a ratio ($R_5/R_3$) of the resistors R5 and R3 can be optionally set. For example, if ($R_5/R_3$)<1 is set, an operation is possible by a low voltage. Specifically, with $R_5/R_3$=0.69, $V_{REF}$=0.8 V is set, and an operation is possible from a power supply voltage of about 1.0 V. Furthermore, ($R_5/R_3$)>1 can be set. For example, with $R_5/R_3$=1.72, $V_{REF}$=2.0 V is set, and an operation is possible from a power supply voltage of about 2.2 V. Moreover, by providing three taps in the resistor R5, and dividing a resistance value into four parts, four reference voltages all having no temperature characteristics, i.e., $V_{REF1}$=0.5 V, $V_{REF2}$=1.0 V, $V_{REF3}$=1.5 V, and $V_{REF4}$=2.0 V, are obtained.

Figure 19:
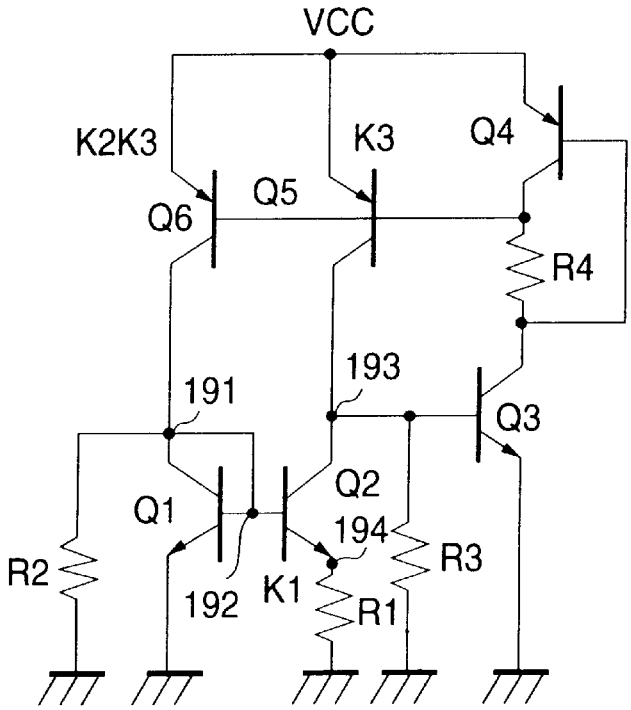
FIG. 19 is a view showing an example of a reference current circuit according to a sixth embodiment of the present invention, using a bipolar Widlar reference current circuit.

FIG. 19 shows a reference current circuit according to a sixth embodiment of the present invention, specifically an embodiment of a bipolar reference current circuit, which outputs a current having an optional temperature characteristic. Referring to FIG. 19, the reference current circuit of the sixth embodiment of the present invention is shown to be constructed in a manner that transistors Q1 and Q2, and a resistor R1 constitute the bipolar Widlar current mirror circuit, and the bipolar Nagata current mirror circuit constituted of transistors Q4, Q5, (Q6), and a resistor R4 has a circuit constant set such that when a current of a transistor Q3 to be driven is increased, currents flowing to the transistors Q5 and Q6 can be reduced. Thus, a negative feedback current loop is provided in the circuit, and the circuit is stably operated. In this case, if a ratio of currents flowing to the resistors R2 and R3 is equal to that of currents of the current mirror circuit constituted of the transistors Q5 and Q6, the transistors Q1, Q2 (Q3), Q5 and Q6, and the resistor R1 constitute the bipolar self-biased Nagata reference current circuit. Accordingly, $K_1$, $K_2$ and $K_3$, and the resistors R1 and R4 are set such that the terminal voltage $V_1$ (=$V_{BE1}$) of the resistor R2 and the terminal voltage $V_2$ (=$V_{BE3}$) of the resistor R3 may be set equal to each other, and a ratio of resistance values of the resistors R2 and R3 may be set inverse to a current ratio of the current mirror circuit.

Assuming that a DC current amplification factor of the transistor is sufficiently near 1, by ignoring a base current, from the equation (1), relations are represented by the following equations (101) to (103):

$$V_{BE1}=V_T\ln(I_{C1}/I_S) \tag{101}$$

$$V_{BE2}=V_T\ln\{I_{C2}/K_1I_S)\} \tag{102}$$

$$V_{BE1}=V_{BE2}+R_1I_{C2} \tag{103}$$

Then, if the transistor Q1 an the resistor R2, and the transistor Q2 and the resistor R3 are driven by a current mirror having the mirror ratio of $K_2$:1, a relation represented by the following equation (104) is established:

$$I_{C1}+V_1/R_2=K_2(I_{C2}+V_2/R_3) \tag{104}$$

Here, the transistors Q4, Q5, (Q6) and the resistor R4 constitute the bipolar Nagata current mirror circuit, and the transistors Q5 and Q6 are unit transistors. An emitter area ratio of the transistor Q4 is $K_3$ times as large as that of the unit transistor. By setting a resistor R4 to establish $I_{C1}=I_{C3}$, $V_1=V_2$ ($\therefore V_{BE2}=V_{BE3}$) is set, and with $R_3/R_2=K_2$, the following equation (105) is established:

$$I_{C1}=K_2I_{C2} \tag{105}$$

Thus, the following equation (106) is obtained:

$$\begin{aligned}\Delta V_{BE} &= V_{BE1}-V_{BE2}=V_T\ln(I_{C1}/I_S)-V_T\ln\{I_{C2}/(K_1I_s)\}\\ &= V_T\ln\{I_{C1}/(I_{C2}/K_1)\}=V_T\ln(K_1K_2)=R_1I_{C2}\end{aligned} \tag{106}$$

Here, $K_1$ and $K_2$ denote the constants having no temperature characteristics and, as described above, the thermal voltage $V_T$ is represented by $V_T$=kT/q, exhibiting a temperature characteristic of 3333 ppm/° C. Thus, $\Delta V_{BE}$ is proportional to a temperature.

An output current $I_{REF}$ of the bipolar reference voltage circuit is obtained by the following equation (107):

$$I_{REF}=I_{C2}+V_2/R_3=\Delta V_{BE}/R_1+V_{BE3}/R_3=(V_T/R_1)\ln(K_1K_2)+V_{BE1}/R_3 \tag{107}$$

That is, the output current $I_{REF}$ of the bipolar reference current circuit is represented by an equation of weighting and adding the base-emitter bias voltage $V_{BE}$ having a negative temperature characteristic and $\Delta V_{BE}$ having a positive temperature characteristic. Accordingly, by changing weight factors, the temperature characteristics of two reference voltages can be optionally set as described above. Specifically, an emitter area ratio or a current mirror ratio and each resistance ratio may be set. For example, by converting the output current $I_{REF}$ of the bipolar reference current circuit into a voltage by the resistor R5, the output voltage $V_{REF}$ obtained is represented by the following equation (108):

$$\begin{aligned}V_{REF} &= R_5I_{REF}=(R_5/R_1)V_T\ln(K_1K_2)+(R_5/R_3)V_{BEI}\\ &= (R_5/R_3)\{(R_3/R_1)V_T\ln(K_1K_2)+V_{BEI}\}\end{aligned} \tag{108}$$

In this case, the thermal voltage $V_T$ has a positive temperature characteristic of 3333 ppm/° C., and the base-emitter bias voltages $V_{BE2}$ and $V_{BE3}$ of the transistors Q2 and Q3 have negative temperature characteristics of about −1.9 mV/° C. The resistance ratios ($R_5/R_1$) and ($R_5/R_3$) are zero because of cancellation of temperature characteristics, and $\ln(K_1K_2)$ has no temperature characteristics. Thus, the output voltage $V_{REF}$ obtained by converting the output current of the bipolar reference current circuit into a voltage through the resistor is decided by the positive temperature characteristic, 3333 ppm/° C., of the thermal voltage $V_T$, and the negative temperature characteristic, about −1.9 mV/° C., of the base-emitter bias voltage $V_{BE1}$ of the transistor Q1. For example, in order to set zero a temperature characteristic of the output voltage $V_{REF}$ obtained by voltage conversion of the output current of the bipolar reference current circuit through the resistor, if a base-emitter bias voltage $V_{BE1}$ ($=V_{BE3}$) of the transistor Q1 is 630 mV at the normal temperature, since the thermal voltage $V_T$ is 25.6 mV at the normal temperature, $(R_3/R_1)\ln(K_1K_2)=22.3$ is obtained.

Accordingly, $\{(R_3R_1)V_T \ln(K_1K_2)+V_{BE1}\}=1.2$ V is obtained. The output voltage $V_{REF}$ having the temperature characteristic of zero thus obtained can be set to an optional voltage value by optionally setting a ratio $(R_5/R_3)$ of the resistors $R_5$ and $R_3$. In the setting of $(R_5/R_3)<1$, for example a case of setting 0.7 V is considered, an operation is possible from about 0.9 V. Alternatively, if a power supply voltage has an allowance to increase a voltage, by setting $(R_5/R_3)>1$, a reference voltage having a temperature characteristic of zero at $V_{REF}>1.2$ V is obtained. Specifically, $V_{REF}=1.5$ V is obtained by setting $(R_5/R_3)=1.25$; and $V_{REF}=2.0$ V by setting $(R_5/R_3)=5/3$. As apparent from the foregoing, by setting the resistor $R_5$ to be $R_5>R_3$, and optionally providing the number (n−1) of taps in the resistor $R_5$ to set it as an output terminal, it is possible to obtain n reference voltages of optional different voltage values having no temperature characteristics.

Figure 20:
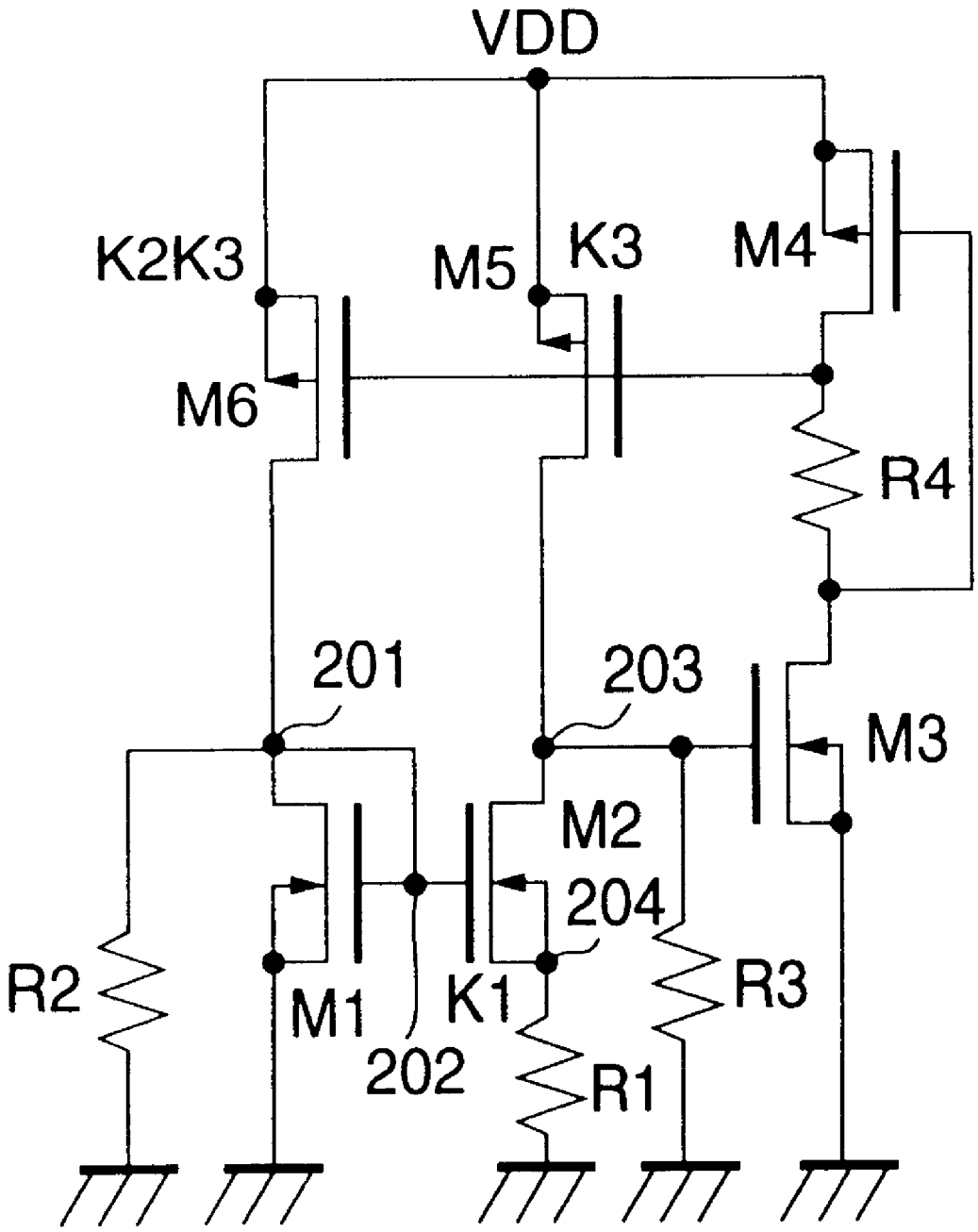
FIG. 20 is a view showing an example of the reference current circuit of the sixth embodiment of the present invention, using a CMOS Widlar reference current circuit.

FIG. 20 shows the reference current circuit of the sixth embodiment of the present invention, specifically a CMOS reference current circuit of another embodiment, which outputs a current having an optional temperature characteristic. Referring to FIG. 20, the reference current circuit of the sixth embodiment of the present invention is shown to be constructed in a manner that transistors M1 and M2 and a resistor R1 constitute the MOS Widlar current mirror circuit, and the MOS Nagata current mirror circuit constituted of transistors M4, and M5 (M6), and a resistor R4 has a circuit constant set such that when a current of a transistor M3 to be driven is increased, currents flowing to the transistors M5 and M6 can be reduced. Accordingly, a negative feedback current loop is provided in the circuit, and the circuit is stably operated. In this case, if a ratio of currents flowing to the resistors R2 and R3 is equal to that of currents flowing to the current mirror circuit constituted of the transistors M5 and M6, the transistors M1, and M2 (M3), M5 and M6, and the resistor R1 constitute the MOS self-biased Nagata reference current circuit. Thus, $K_1$, $K_2$ and $K_3$, and the resistors R1 and R2 are set such that the terminal voltage $V_1$ ($=V_{GS1}$) of the resistor R2, and the terminal voltage $V_2$ ($=V_{GS3}$) of the resistor R3 can be set equal to each other, and a ratio of resistance values of the resistors R2 and R3 may be set inverse to a current ratio of the current mirror circuit. In FIG. 20, the transistor M2 is a unit transistor, and a ratio (W/L) of a gate width W between a gate length L of the transistor M1 is $K_1$ times ($K_1>1$) as large as that of the unit transistor.

If the consistency of the circuit element is high, drain currents of the MOS transistors M1 and M2 are represented by the following equations (109) and (110):

$$I_{D1}=\beta(V_{GS1}-V_{TH}) \tag{109}$$

$$I_{D2}K_1\beta(V_{GS2}-V_{TH})^2 \tag{110}$$

Furthermore, a relation is represented by the following equation (111):

$$\Delta V_{GS}=V_{GS1}-V_{GS2}=R_1I_{D2} \tag{111}$$

Then, if the transistor M1 and the resistor R2, and the transistor M2 and the transistor R3 are driven by a current mirror having a mirror ratio of $K_2$:1, the following equation (112) is obtained:

$$I_{D1}+V_1/R_2=K_2(I_{D2}+V_2/R_3) \tag{112}$$

In this case, the transistors M4 and M5 (M6), and the resistor R4 constitute the MOS Nagata current mirror circuit, the transistor M4 is a unit transistor, and a ratio (W/L) of a gate width W between a gate length L of the transistor M5 is $K_3$ times as large as that of the unit transistor. By setting the R4, $I_{D1}=I_{D3}$ is established, realizing $V_1=V_2$ ($\therefore V_{GS1}=V_{GS3}$). With $R_3/R_2=K_2$, a relation represented by the following equation (113) is established:

$$I_{D1}K_2I_{D2} \tag{113}$$

Thus, by solving the equations (109) to (112), a relation represented by the following equation (114) is obtained:

$$I_{D2}=\frac{K_2}{R_1^2\beta}\left(1-\frac{1}{\sqrt{K_1K_2}}\right)^2 \tag{114}$$

Here, $K_1$ and $K_2$ denote constants having no temperature characteristics. On the other hand, since mobility $\mu$ has a temperature characteristic in the MOS transistor, temperature dependence of the transconductance parameter β is represented by the equation (34) and, as shown in FIG. 8, a temperature characteristic of 1/β is substantially proportional to a temperature. The temperature characteristic of 1/β is 5000 ppm/° C. at a normal temperature. Therefore, it can be understood that if a temperature characteristic of the resistor R1 is equal to or lower than 5000 ppm/° C., a drain current ID2 has a positive temperature characteristic.

That is, an output current $I_{REF}$ of the MOS reference voltage current is obtained by the following equation (115):

$$I_{REF}I_{D2}+V_2/R_3=I_{D2}+V_{GS1}/R_3 \tag{115}$$

On the other hand, from the equation (109), the following represented by an equation (116) is established:

$$V_{GS1}=\sqrt{\frac{I_{D1}}{\beta}}+V_{TH} \tag{116}$$

Then, the equation (115) is rewritten into the following equation (117):

$$\begin{aligned} I_{REF} &= \frac{K_2}{R_1^2\beta}\left(1-\frac{1}{\sqrt{K_1K_2}}\right)^2+\frac{1}{R_1R_3\beta}\left(1-\frac{1}{\sqrt{K_1K_2}}\right)+\frac{V_{TH}}{R_3} \\ &= \frac{1}{R_1\beta}\left(1-\frac{1}{\sqrt{K_1K_2}}\right)\left\{\frac{K_2}{R_1}\left(1-\frac{1}{\sqrt{K_1K_2}}\right)+\frac{1}{R_3}\right\}+\frac{V_{TH}}{R_3} \end{aligned} \tag{117}$$

In this case, the temperature characteristic of the threshold voltage $V_{TH}$ is represented by the (77), where α is about 2.3 mV/° C. in a CMOS fabrication process of the MOS transistor having a low threshold voltage. Accordingly, the output current $I_{REF}$ of the MOS reference voltage circuit is represented by weighting and adding a term of the threshold voltage $V_{TH}$ having a negative temperature characteristic and a term of 1/β having a positive temperature characteristic.

As a result, by changing weight factors, it is possible to optionally set a temperature characteristic of the reference current. For example, by converting the output current $I_{REF}$ of the MOS reference current circuit into a voltage through the resistor R5, an output voltage $V_{REF}$ is represented by the following equation (118):

$$V_{REF} = R_5 I_{REF} = \frac{R_5}{R_1\beta_0}\left(\frac{T}{T_0}\right)^{\frac{3}{2}}\left(1-\frac{1}{\sqrt{K_1K_2}}\right)\left\{\frac{K_2}{R_1}\left(1-\frac{1}{\sqrt{K_1K_2}}\right)+\frac{1}{R_3}\right\}+\frac{R_5}{R_3}V_{TH0}-\frac{R_5}{R_3}\alpha(T-T_0) = \frac{R_5}{R_3}\left[\frac{R_3}{R_1\beta_0}\left(\frac{T}{T_0}\right)^{\frac{3}{2}}\left(1-\frac{1}{\sqrt{K_1K_2}}\right)\left\{\frac{K_2}{R_1}\left(1-\frac{1}{\sqrt{K_1K_2}}\right)+\frac{1}{R_3}\right\}+V_{TH0}-\alpha(T-T_0)\right] \quad (118)$$

A right side of the equation (118) is represented by weighting and adding of voltage values caused by inverse numbers of the threshold voltage $V_{TH}$ having the negative temperature characteristic and the transconductance parameter (mobility) having the positive temperature characteristic. Accordingly, by changing weight factors, it is possible to optionally set a temperature characteristic of the output voltage $V_{REF}$ of the MOS reference voltage circuit as described above. Specifically, a (W/L)/(W/L) ratio, or a current mirror ratio and resistance values, and each resistance ratio may be set.

In this case, the temperature characteristic of 1/β as an inverse number of the transconductance parameter β is substantially proportional to a temperature, which is 5000 ppm/° C. at the normal temperature. The threshold voltage $V_{TH}$ of the transistor M2 has the negative temperature characteristic of about −2.3 mV/° C. The temperature characteristics of the resistance ratios ($R_5/R_1$) and ($R_5/R_3$) are zero because of cancellation, and $\sqrt{K_1}$ has no temperature characteristics. Thus, the output voltage $V_{REF}$ of the MOS reference voltage circuit is decided by the positive temperature characteristic of 5000 ppm/° C., the negative temperature characteristic of the threshold voltage $V_{TH}$ of the MOS reference voltage circuit, and about −2.3 mV/° C. For example, if $V_{TH0}$=0.7 V is set, the following represented by an equation (119) is obtained:

$$\frac{R_3}{R_1\beta_0}\left(1-\frac{1}{\sqrt{K_1K_2}}\right)\left\{\frac{K_2}{R_1}\left(1-\frac{1}{\sqrt{K_1K_2}}\right)+\frac{1}{R_3}\right\} = 0.46\text{ V} \quad (119)$$

Then, the output value is represented by the following equation (120):

$$V_{REF}=(R_5/R_3)\ (0.46+0.7)=1.16(R_5/R_3)V \quad (120)$$

Here, the voltage 1.16 V has no temperature characteristics. Thus, since the temperature characteristic of the ($R_5/R_3$) is zero because of cancellation, the reference voltage $V_{REF}$ to be outputted has no temperature characteristics.

In this case, a ratio ($R_5/R_3$) of the resistors R5 and R3 can be optionally set. For example, if ($R_5/R_3$)<1 is set, an operation is possible by a low supply voltage. Specifically, with $R_5/R_3$=0.69, $V_{REF}$=0.8 V is set, and an operation is possible from a power supply voltage of about 1.0 V. Furthermore, ($R_5/R_3$)>1 can be set. For example, with $R_5/R_3$=1.72, $V_{REF}$=2.0 V is set, and an operation is possible from a power supply voltage of about 2.2 V. Moreover, by providing three taps in the resistor R5, and dividing a resistance value into four parts, four reference voltages all having no temperature characteristics, i.e., $V_{REF1}$=0.5 V, $V_{REF2}$=1.0 V, $V_{REF3}$=1.5 V, and $V_{REF4}$=2.0 V, are obtained.

Figure 21:
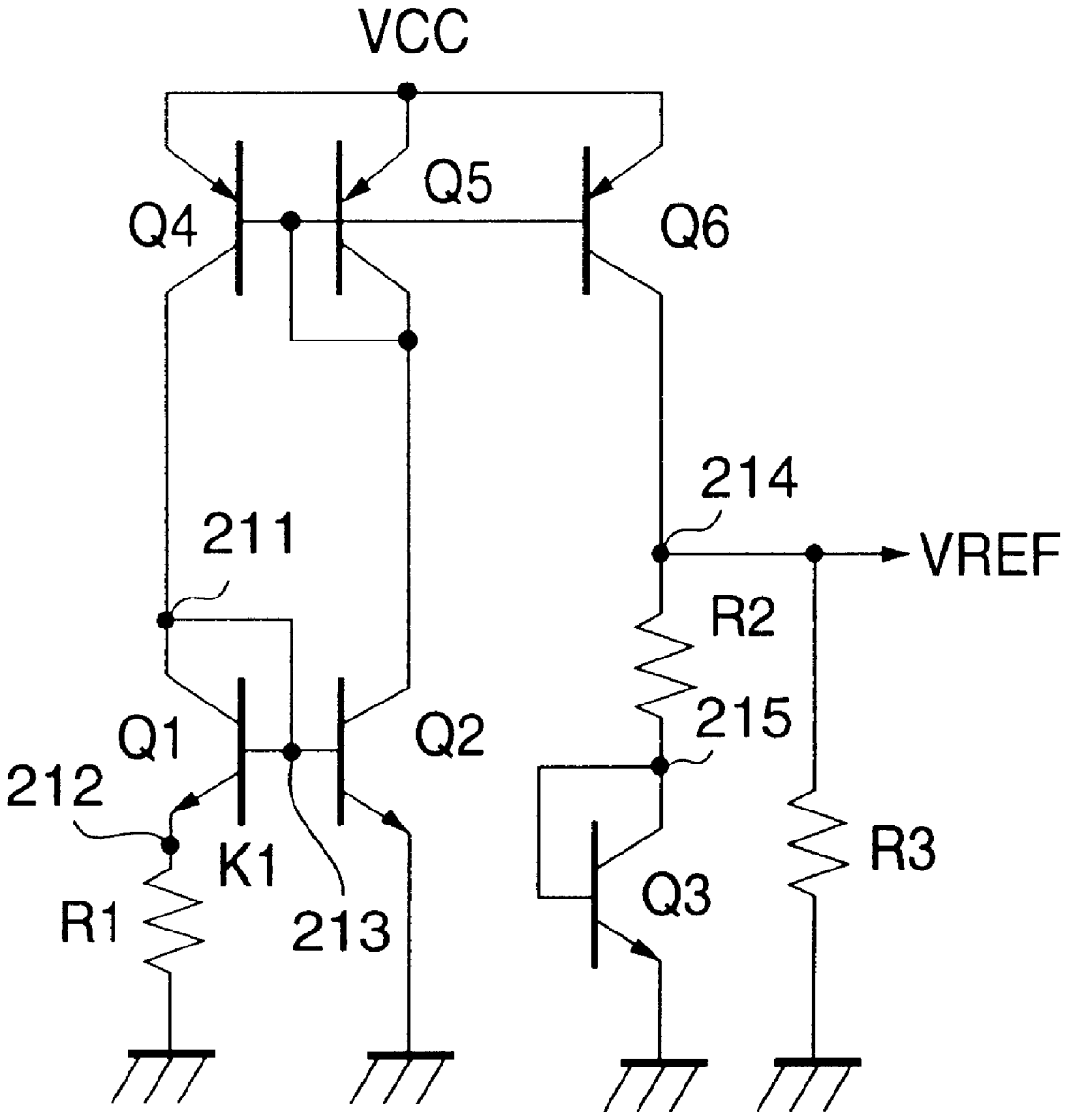
FIG. 21 is a view showing an example of a reference voltage circuit according to a seventh embodiment of the present invention, using a bipolar self-biased inverse Widlar reference current circuit.

Next, description will be made of the preferred embodiments of the present invention, specifically those of reference voltage circuits with reference to the accompanying drawings. FIG. 21 is a view showing an example of a reference voltage circuit according to a seventh embodiment of the present invention, specifically an embodiment of a bipolar reference voltage circuit. Referring to FIG. 21, the reference voltage circuit of the seventh embodiment of the present invention is shown to be constructed in a manner that transistors Q1 and Q2, and a resistor R1 constitute the bipolar inverse Widlar current mirror circuit. Assuming that a DC current amplification factor of the transistor is sufficiently near 1, by ignoring a base current, in the bipolar inverse Widlar current mirror circuit, from the equation (9), relations are represented by the following equations (121) to (123):

$$V_{BE1}=V_T\ \ln\{I_{C1}/(K_1I_S)\} \quad (121)$$

$$V_{BE2}=V_T\ \ln(I_{C2}/I_S) \quad (122)$$

$$V_{BE2}=V_{BE1}+R_1I_{C1} \quad (123)$$

Here, by solving the equations (121) to (123), a relation between input and output currents in the bipolar inverse Widlar current mirror circuit is represented by the following equation (124):

$$I_{C2}=(I_{C1}/K_1)\exp(R_1I_{C1}/V_T) \quad (124)$$

Thus, in the bipolar inverse Widlar current mirror circuit, a mirror current $I_{C2}$ is exponentially increased with respect to a reference current $I_{C2}$.

In this case, the transistor Q5 constitutes the current mirror circuit with the transistor Q4 (and Q6), which has a current mirror ratio of 1:1, and the transistors Q1 and Q2 are respectively driven by the transistors Q4 and Q5. Thus, the bipolar self-biased inverse Widlar reference current circuit is provided, and then a relation is represented by the following equation (125):

$$I_{C1}=I_{C2} \quad (125)$$

Furthermore, since the following equation (126) is established, $$\Delta V_{BE} = V_{BE2}-V_{BE1} = V_T\ln(I_{C1}/I_S)-V_TK_1I_S)\} = V_T\ln(I_{C1}/I_{C2}) = V_T\ln(K_1) = R_1I_{C1} \quad (126)$$

the equation (127) is obtained:

$$I_{C1}=I_{C2}=(V_T/R_1)\ln(K_1) \quad (127)$$

Here, $K_1$ denotes a constant having no temperature characteristics and, as described above, the thermal voltage $V_T$ is represented by $V_T$=kT/q, exhibiting a temperature characteristic of 3333 ppm/° C. Accordingly, if a temperature characteristic of the resistor R1 is smaller than the temperature characteristic of the thermal voltage $V_T$, being a primary characteristic with respect to a temperature, an output current $I_{REF}$ ($=I_{C1}$) of the reference current circuit outputted through the current mirror circuit is proportional to the temperature, realizing a PTAT current source. In addition, since the transistor Q5 constitutes a current mirror circuit with the transistors Q4 and Q6, a relation represented by the following equation (128) is established:

$$I_{C4}=I_{C5}=I_{C6}=I_{C1}=I_{C2}=(V_T/R_1)\ln(K_1) \tag{128}$$

A collector current $I_{C6}$ of the transistor Q6 is converted into a voltage by the output circuit, becoming a reference voltage $V_{REF}$. If a current flowing to the resistor R2 is $\gamma I_{C6}$ ($0<\gamma<1$), then the reference voltage $V_{REF}$ is represented by the following equation (129):

$$V_{REF}V_{BE3}+R_2\gamma I_{C6}=R_3(1-\gamma)I_{C6} \tag{129}$$

By solving the equation (120) for γ, γ is represented by the following equation (130):

$$\gamma=(-V_{BE3}+R_3I_{C6})/\{I_{C6}(R_2+R_3)\} \tag{130}$$

Thus, the reference voltage $V_{REF}$ is obtained by the following equation (131):

$$\begin{aligned} V_{REF} &= \{I_{C6}(R_2+R_3)\}(V_{BE3}+R_2I_{C6}) \\ &= \{I_{C6}(R_2+R_3)\}\{V_{BE3}+(R_2/R_1)V_T\ln(K_1)\} \end{aligned} \tag{131}$$

Figure 33:
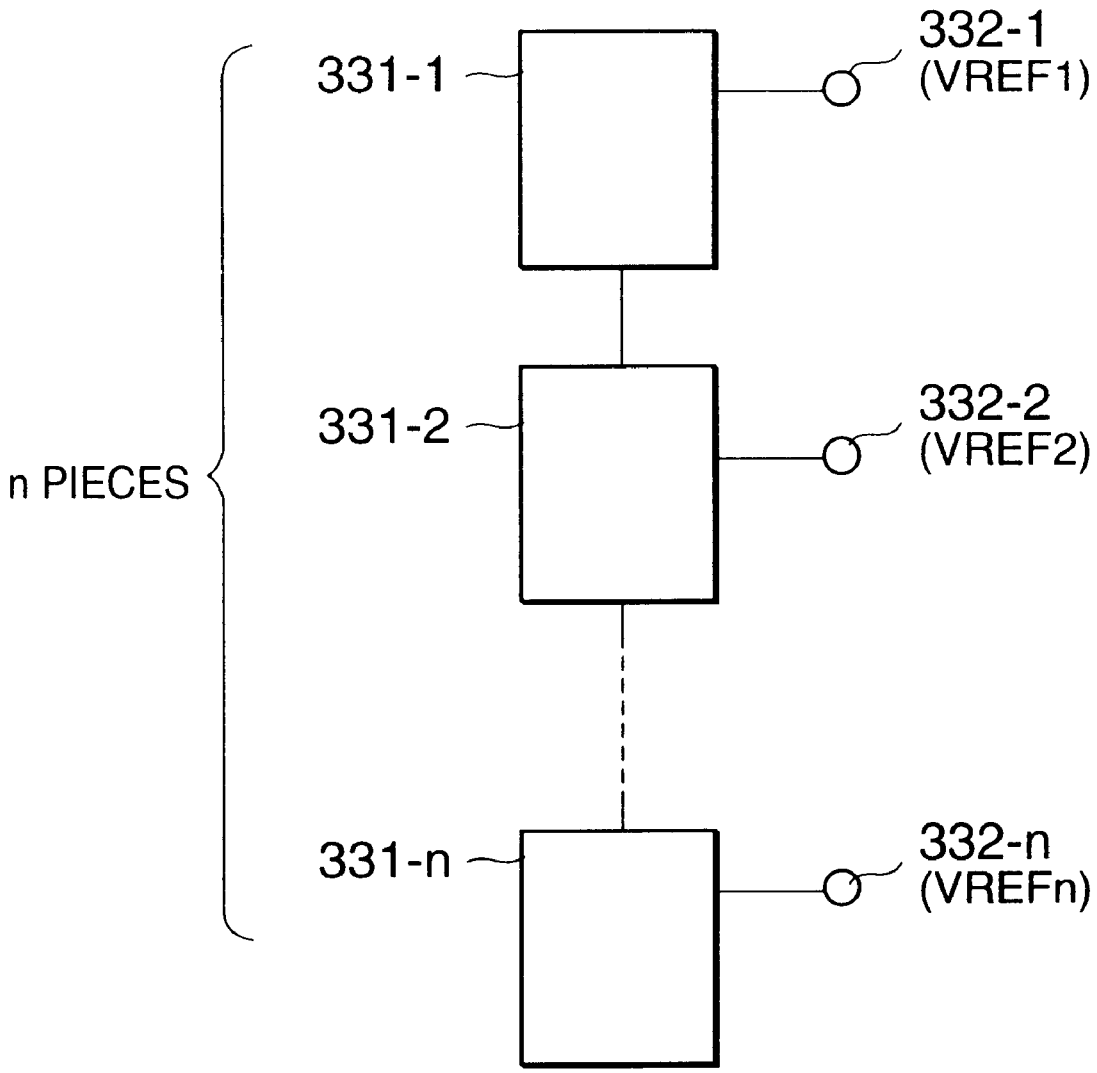
FIG. 33 is a view showing an example of a circuit, where any one of the reference voltage circuits of the seventh to twelfth embodiments of the present invention is series-connected.

In the equation (131), a coefficient term $R_3/(R_2+R_3)$ is $0<R_3/(R_2+R_3)<1$. In a second term $\{V_{BE3}+(R_2/R_1)V_T\ln(K_1)\}$, $V_{BE3}$ has a negative temperature characteristic of about −1.9 mV/° C., and the thermal voltage $V_T$ has a positive temperature characteristic of 0.0853 mV/° C. Accordingly, in order to prevent the reference voltage $V_{REF}$ to be outputted from having any temperature characteristics, a temperature characteristic is canceled by a voltage having a positive temperature characteristic and a voltage having a negative temperature characteristic. That is, in this case, a value of $(R_2/R_1)\ln(K_1)$ is 22.3, and a voltage value of $(R_2/R_1)V_T\ln(K_1)$ is 0.57 V. Now, if $V_{BE3}$ is 0.7 V, $\{V_{BE3}+(R_2/R_1)V_T\ln(K_1)\}=1.27$ V is obtained. Thus, sine $R_3/(R_2+R_3)<1$ is established, the reference voltage $V_{REF}$ can be set equal to or lower than 1.27 V, e.g., 1.0 V. In addition, as shown in FIG. 33, a current is outputted through the current mirror circuit, and then the current is converted into a voltage by an output circuit constituted of a diode-connected transistor and two resistors, and outputted. Thus, by series-connecting the current mirror circuit with n output circuits having different resistance ratios ($R_3/(R_2+R_3)$, two resistors at each stage, it is possible to obtain n reference voltages having no temperature characteristics.

Figure 34:
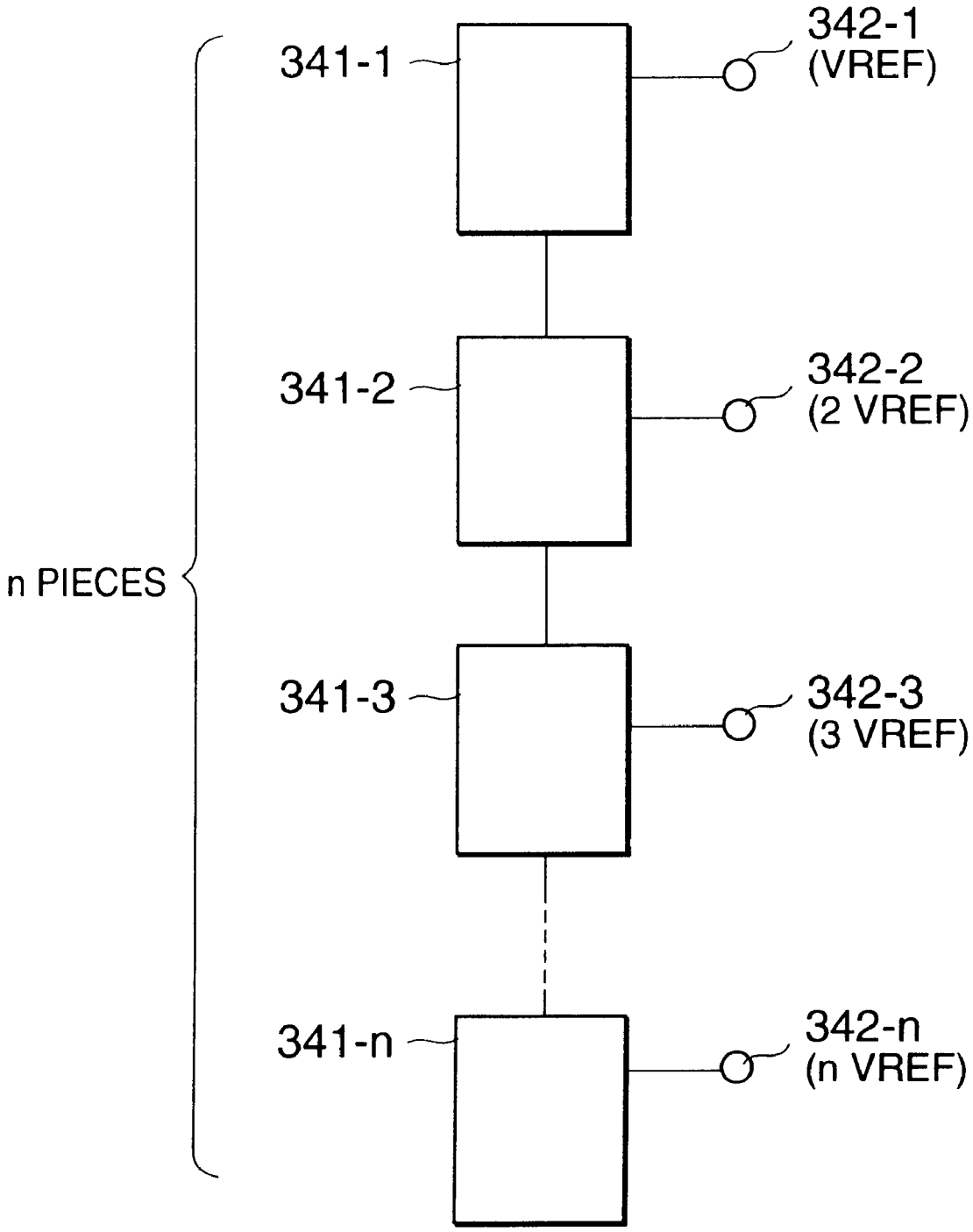
FIG. 34 is a view showing an example of a circuit, where any one of the reference voltage circuits of the seventh to twelfth embodiments of the present invention is series-connected.

For example, if a power supply voltage has an allowance to increase a voltage, the output circuits each constituted of the diode-connected transistor and the two resistors are series-connected at n stages, a flowing current is shared, and the two resistance values at each stage are made different from each other. Accordingly, n different output voltages ($V_{REF1}$, $V_{REF2}$, $V_{REF3}$, . . . , $V_{REFn}$) are obtained. Any of these output voltages has no temperature characteristics. Alternatively, as shown in FIG. 34, similar output circuits each constituted of a diode-connected transistor and two resistors are series-connected at n stages, and a flowing current is shared, enabling output voltages to be $nV_{REF}$. Needless to say, since a voltage between stages can be outputted, voltages $V_{REF}$, $2V_{REF}$, $3V_{REF}$, . . . $nV_{REF}$ are also obtained. In this case, no changes occur in a circuit current.

Figure 22:
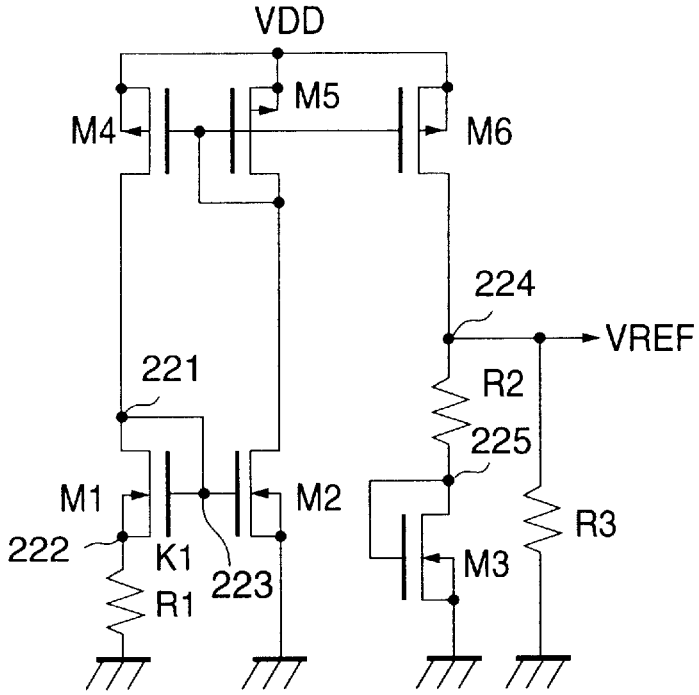
FIG. 22 is a view showing an example of the reference voltage circuit of the seventh embodiment of the present invention, using a CMOS self-biased inverse Widlar reference current circuit.

FIG. 22 shows the reference voltage circuit of the seventh embodiment of the present invention, specifically a CMOS reference voltage circuit of another embodiment. Referring to FIG. 22, the reference voltage circuit of the seventh embodiment of the present invention is shown to be constructed in a manner that transistors M1 and M2 and a resistor R1 constitute the MOS inverse Widlar current mirror circuit, a negative feedback current loop is provided, and the circuit is stably operated at a set operation point. Thus, the CMOS reference current circuit is realized by self-biased the MOS inverse Widlar current mirror circuit. In FIG. 22, the transistor M2 is a unit transistor, and a ratio (W/L) of a gate width W between a gate length L of the transistor M1 is $K_1$ times ($K_1>1$) as large as that of the unit transistor. Then, drain currents of the MOS transistors M1 and M2 are represented by the following equations (132) and (133):

$$I_{D1}=K_1\beta(V_{GS}-V_{TH})^2 \tag{132}$$

$$I_{D2}\beta(V_{GS2}-V_{TH})^2 \tag{133}$$

Here, β denotes a transconductance parameter, which is represented by $\beta=\mu\,(C_{OX}/2)$ (W/L). In this case, $\mu$ denotes effective mobility of a carrier; $C_{OX}$ a gate oxide film capacity per unit area; W and L respectively a gate width and a gate length; and $V_{TH}$ a threshold voltage.

Furthermore, a relation represented by the following equation (134) is established:

$$V_{GS2}V_{GS1}+R_1I_{D1} \tag{134}$$

Here, by solving the equations (132) to (134), a relation is represented by the following equation (135):

$$I_{D2}=\beta I_{D1}\left(\frac{1}{\sqrt{K_1\beta}}+R_1\sqrt{I_{D1}}\right)^2 \tag{135}$$

In this case, the transistor M5 constitutes the current mirror circuit with the transistors M4 and M6, and the transistors M1 and M2 are respectively driven by the transistors M4 and M5. Thus, the MOS self-biased inverse Widlar current circuit is provided. If the ratios (W/L) of gate widths W between gate lengths L of the transistors M4, M5 and M6 are all equal, then a relation is represented by the following equation (136):

$$I_{D1}=I_{D2} \tag{136}$$

Furthermore, a relation represented by the following equation (137) is established:

$$\Delta V_{GS}=V_{GS1}=R_1I_{D1} \tag{137}$$

By solving the equations (132) to (137), a relation represented by the following equation (138) is obtained:

$$I_{D1}=\frac{1}{R_1^2\beta}\left(1-\frac{1}{\sqrt{K_1}}\right)^2 \tag{138}$$

Here, $K_1$ denotes a constant having no temperature characteristics.

On the other hand, since the mobility $\mu$ has a temperature characteristic in the MOS transistor, the temperature dependence of the transconductance parameter β is represented by the following equation (139):

$$\beta = \beta_0\left(\frac{T}{T_0}\right)^{-\frac{3}{2}}. \tag{139}$$

Here, $\beta_0$ denotes a value of $\beta$ at a normal temperature (300K). Thus, a relation represented by the following equation (140) is obtained:

$$\frac{1}{\beta} = \frac{1}{\beta_0}\left(\frac{T}{T_0}\right)^{\frac{3}{2}} \tag{140}$$

A temperature characteristic of $1/\beta$ is 5000 ppm/° C. at a normal temperature. This is 1.5 times as large as that of a temperature characteristic 3333 ppm/° C. of the thermal voltage $V_T$ of the bipolar transistor.

The output current $I_{REF}$ of the CMOS reference current circuit is represented by the following equation (141):

$$I_{REF} = I_{D1} = \frac{1}{R_1^2\beta_0}\left(\frac{T}{T_0}\right)^{\frac{3}{2}}\left(1 - \frac{1}{\sqrt{K_1}}\right)^2 \tag{141}$$

Here, $K_1$ denotes a constant having no temperature characteristics. As described above, the temperature characteristic of $1/\beta$ is substantially proportional to a temperature, being 5000 ppm/° C. at the normal temperature. Thus, if a temperature characteristic of the resistor R2 is equal to or lower than 5000 ppm/° C., being a primary characteristic with respect to the temperature, a drain current $I_{D1}$ has a positive temperature characteristic, and an output current $I_0$ of the reference current circuit outputted through the current mirror circuit is proportional to the temperature, realizing a PTAT current source circuit. In addition, since the transistor M6 constitutes the current mirror circuit with the transistors M4 and M5, a relation is represented by the following equation (142):

$$I_{D4}=I_{D5}=I_{D6} \tag{142}$$

A drain current $I_{D6}$ of the transistor M6 is converted into a voltage by the output circuit, becoming a reference voltage $V_{REF}$. If a current flowing to the resistor R2 is $\gamma I_{D6}(0<\gamma<1)$, then the reference voltage $V_{REF}$ is represented by the following equation (143):

$$V_{REF}V_{BE32}\gamma I_{D6}=R_3(1-\gamma)I_{D6} \tag{143}$$

By solving the equation (143) for $\gamma$, $\gamma$ is represented by the following equation (144):

$$\gamma=(-V_{BE3}+R_3I_{D6})/\{I_{D6}(R_2+R_3)\} \tag{144}$$

Accordingly, the reference voltage $V_{REF}$ is obtained by the following equation (145)

$$\begin{aligned} V_{REF} &= \{I_{D6}(R_2 + R_3)\}(V_{BE3} + R_2I_{D6}) \\ &= \frac{R_3}{R_2 + R_3}\left\{V_{GS3} + \frac{R_2}{R_1^2}\left(1 - \frac{1}{\sqrt{K_1}}\right)^2\right\} \end{aligned} \tag{145}$$

On the other hand, $V_{GS3}$ is represented by the following equation (146):

$$V_{GS3} = \sqrt{\frac{ID_3}{\beta}} + V_{TH} = \sqrt{\frac{ID_6}{\beta}} + V_{TH} \tag{146}$$

The equation (145) is rewritten into the following equation (147):

$$\begin{aligned} V_{REF} &= \frac{R_3}{R_2 + R_3}\left\{\frac{R_2}{R_1^2}\left(1 - \frac{1}{\sqrt{K_1}}\right)^2 + \frac{1}{R_1\beta}\left(1 - \frac{1}{\sqrt{K_1}}\right) + V_{TH}\right\} \\ &= \frac{R_3}{R_2 + R_3}\left\{\frac{1}{R_1\beta}\left(1 - \frac{1}{\sqrt{K_1}}\right)\left\{\frac{R_2}{R_1}\left(1 - \frac{1}{\sqrt{K_1}}\right) + 1\right\} + V_{TH}\right] \end{aligned} \tag{147}$$

In this case, a temperature characteristic of a threshold voltage $V_{TH}$ is represented by the following equation (148):

$$V_T=V_{TH0}-\alpha(T-T_0) \tag{148}$$

Here, $\alpha$ is about 2.3 mV/° C. in a CMOS fabrication process of the. MOS transistor having a low threshold voltage. Accordingly, the output current $I_{REF}$ of the MOS reference voltage circuit is represented by weighting and adding a term of the threshold voltage $V_{TH}$ having a negative temperature characteristic and a term of $1/\beta$ having a positive temperature characteristic. As a result, by changing weight factors, it is possible to optionally set a temperature characteristic of the reference current. An output voltage $V_{REF}$ is represented by the following equation (149):

$$V_{REF} = \frac{R_3}{R_2 + R_3}\left[\frac{R_5}{R_1\beta_0}\left(\frac{T}{T_0}\right)^{\frac{3}{2}}\left(1 - \frac{1}{\sqrt{K_1}}\right)\left\{\frac{R_2}{R_1}\left(1 - \frac{1}{\sqrt{K_1}}\right) + \frac{1}{R_3}\right\} + V_{TH0} - \alpha(T - T_0)\right] \tag{149}$$

A right side of the equation (149) is represented by weighting and adding of the voltage values caused by inverse numbers of the threshold voltage $V_{TH}$ having the negative temperature characteristic and the transconductance parameter (mobility) having the positive temperature characteristic. Accordingly, by changing weight factors, it is possible to optionally set the temperature characteristic of the output voltage $V_{REF}$ of the MOS reference voltage circuit as described above. Specifically, a (W/L)/(W/L) ratio, or a current mirror ratio and resistance values, and each resistance ratio may be set.

In this case, the temperature characteristic of $1/\beta$ as an inverse number of the transconductance parameter $\beta$ is substantially proportional to the temperature, which is 5000 ppm/° C. at the normal temperature. The threshold voltage $V_{TH}$ of the transistor M2 has a negative temperature characteristic of about −2.3 mV/° C. The temperature characteristics of the resistance ratios $(R_2/R_1)$ and $R_2/(R_2+R_3)$ are zero because of cancellation, and $\sqrt{K_1}$ has no temperature characteristics. Thus, the output voltage $V_{REF}$ of the MOS reference voltage circuit is decided by the positive temperature characteristic of 5000 ppm/° C., the negative temperature characteristic of the threshold voltage $V_{TH}$ of the transistor M2, and about −2.3 mV/° C.

In order to prevent the output voltage $V_{REF}$ of the MOS reference voltage circuit from having any temperature characteristics in the equation (149), the following equation (150) is established:

$$\frac{1}{R_1\beta_0}\left(1-\frac{1}{\sqrt{K}}\right)\left\{\frac{R_2}{R_1}\left(1-\frac{1}{\sqrt{K_1}}\right)+\frac{1}{R_3}\right\}=200\alpha=0.46\text{ V} \quad (150)$$

Accordingly, if $V_{TH0}$=0.7 V is set, the output voltage $V_{REF}$ is obtained by the following equation (151):

$$V_{REF}=\frac{R_3}{R_2+R_3}(1.16\text{ V}) \quad (151)$$

In this case, sine $R_3/(R_2+R_3)<1$ is established, if $R_3/(R_2+R_3)=0.7$ is set, $V_{REF}$=0.77 V is established. In addition, as shown in FIG. 33, a current is outputted through the current mirror circuit, and then the current is converted into a voltage by an output circuit constituted of a diode-connected transistor and two resistors, and outputted. Thus, by series-connecting the current mirror circuit with n output circuits having the different resistance ratios $(R_3/(R_2+R_3)$, two resistors at each stage, it is possible to obtain n reference voltages having no temperature characteristics.

For example, if a power supply voltage has an allowance to increase a voltage, the output circuits each if constituted of the diode-connected transistor and the two resistors are series-connected at n stages, a flowing current is shared, and the two resistance values at each stage are made different from each other. Accordingly, n different output voltages ($V_{REF1}$, $V_{REF2}$, $V_{REF3}$, . . . , $V_{REFn}$) are obtained. Any of these output voltages has no temperature characteristics. Alternatively, as shown in FIG. 34, similar output circuits each constituted of a diode-connected transistor and two resistors are series-connected at n stages, and a flowing current is shared, enabling output voltages to be $nV_{REF}$. Needless to say, since a voltage between stages can be outputted, voltages $V_{REF}$, $2V_{REF}$, $3V_{REF}$, . . . , $nV_{REF}$ are also obtained. In this case, no changes occur in a circuit current.

Figure 23:
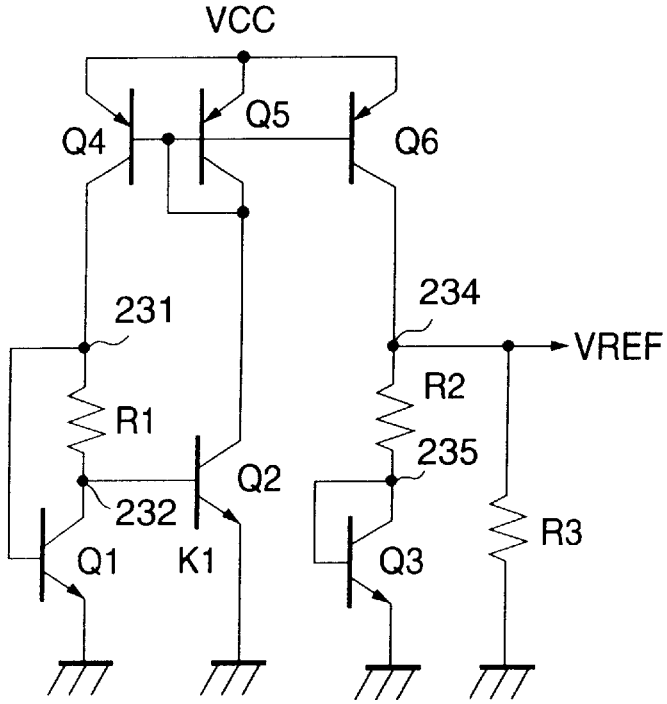
FIG. 23 is a view showing an example of a reference voltage circuit according to an eighth embodiment of the present invention, using a bipolar self-biased Nagata Widlar reference current circuit.

FIG. 23 shows a reference voltage circuit according to an eighth embodiment of the present invention, specifically an embodiment of a bipolar reference current circuit. Referring to FIG. 23, the reference voltage circuit of the eighth embodiment of the present invention is shown to be constructed in a manner that transistors Q1 and Q2, and a resistor R1 constitute the bipolar Nagata current mirror circuit. A feature of the bipolar Nagata current mirror circuit is that there are a region where an output current (mirror current) is monotonously increased with respect to an input current (reference current), a peak point, and a region where the output current (mirror current) is monotonously reduced with respect to the input current (reference current). In this case, by transistors Q4 and Q5 (Q6) constituting a current mirror circuit, the transistors Q1 and Q2, and the resistor R1 constitute the bipolar self-biased Nagata current mirror circuit.

Assuming that a DC current amplification factor of the transistor is sufficiently near 1, by ignoring a base current, in the bipolar Nagata current mirror circuit, from the equation (9), relations are represented by the following equations (152) to (154):

$$V_{BE1}=V_T\ln(I_{C1}/I_S) \quad (152)$$

$$V_{BE2}=V_T\ln\{I_{C2}/(K_1I_S)\} \quad (153)$$

$$V_{BE1}=V_{BE2}+R_1I_{C1} \quad (154)$$

Here, by solving the equations (152) to (154), a relation between input and output currents in the bipolar Nagata current mirror circuit is represented by the following equation (155):

$$I_{C2}=K_{C1}\exp(-R_1I_{C1}/V_T) \quad (155)$$

At the peak point, with $R_1I_{C1}=V_T$, $I_{C2}=K_1I_{C1}/e$ is set: e=2.7183. Thus, with $K_1$=e, $I_{C2}=I_{C1}$ is set.

In this case, the transistors Q5 and Q4 constitute the current mirror circuit, and the transistors Q1 and Q2 are respectively driven by the transistors Q4 and Q5. Thus, the bipolar self-biased Nagata reference current circuit is provided, and then a relation is represented by the following equation (156):

$$I_{C1}=I_{C2} \quad (156)$$

Furthermore, since the following equation (157) is established, $$\Delta V_{BE}=V_{BE1}-V_{BE2}=V_T\ln(I_{C1}/I_S)-V_T\ln\{I_{C1}/K_1I_S)\} \quad (157)$$
$$=V_T\ln(I_{C1}/I_{C2})=V_T\ln(K_1)=R_1I_{C1}$$

the equation (158) is obtained:

$$I_{C1}=I_{C2}=(V_T/R_1)\ln(K_1) \quad (158)$$

Here, $K_1$ denotes a constant having no temperature characteristics and, as described above, the thermal voltage $V_T$ is represented by $V_T$=kT/q, exhibiting the temperature characteristic of 3333 ppm/° C. Accordingly, if a temperature characteristic of the resistor R1 is smaller than the temperature characteristic of the thermal voltage $V_T$, being a primary characteristic with respect to a temperature, an output reference current $I_{REF}$ (=$I_{C1}$) of the reference current circuit outputted through the current mirror circuit is proportional to the temperature, realizing a PTAT current source. In addition, since the transistor Q5 constitutes a current mirror circuit with the transistors Q4 and Q6, a relation represented by the following equation (159) is established:

$$I_{C4}=I_{C5}=I_{C6}=I_{C1}=I_{C2}=(V_T/R_1)\ln(K_1) \quad (159)$$

A collector current $I_{C6}$ of the transistor Q6 is converted into a voltage by the output circuit, becoming a reference voltage $V_{REF}$. If a current flowing to the resistor R2 is $\gamma I_{C6}$ ($0<\gamma<1$), then the reference voltage $V_{REF}$ is represented by the following equation (160):

$$V_{REF}=V_{BE3}+R_2\gamma I_{C6}=R_3(1-\gamma)I_{C6} \quad (160)$$

By solving the equation (160) for γ, γ is represented by the following equation (161):

$$\gamma=(-V_{BE3}+R_3I_{C6})/\{I_{C6}(R_2+R_3)\} \quad (161)$$

Thus, the reference voltage $V_{REF}$ is obtained by the following equation (162):

$$V_{REF}=\{I_{C6}(R_2+R_3)\}(V_{BE3}+R_2I_{C6}) \quad (162)$$
$$=\{I_{C6}(R_2+R_3)\}\{V_{BE3}+(R_2/R_1)V_T\ln(K_1)\}$$

In the equation (162), a coefficient term $R_3/(R_2+R_3)$ is $0<R_3/(R_2+R_3)<1$. In a second term $\{V_{BE3}+(R_2/R_1)V_T\ln(K_1)\}$, $V_{BE3}$ has a negative temperature characteristic of about −1.9 mV/° C., and the thermal voltage $V_T$ has a positive temperature characteristic of 0.0853 mV/° C. Accordingly, in order to prevent the reference voltage $V_{REF}$ to be outputted from having any temperature characteristics, a temperature characteristic is canceled by a voltage having a positive temperature characteristic and a voltage having a negative temperature characteristic. That is, in this case, a value of $(R_2/R_1)\ln(K_1)$ is 22.3, and a voltage value of $(R_2/R_1)V_T \ln(K_1)$ is 0.57V. Now, if $V_{BE3}$ is 0.7 V, $\{V_{BE3}+(R_2/R_1)V_T \ln(K_1)\}=1.27$ V is obtained. Thus, sine $R_3/(R_2+R_3)<1$ is established, the reference voltage $V_{REF}$ can be set equal to or lower than 1.27 V, e.g., 1.0 V. In addition, as shown in FIG. 33, a current is outputted through the current mirror circuit, and then the current is converted into a voltage by an output circuit constituted of a diode-connected transistor and two resistors, and outputted. Thus, by series-connecting the current mirror circuit with n output circuits having different resistance ratios $(R_3/(R_2+R_3)$, two resistors at each stage, it is possible to obtain n reference voltages having no temperature characteristics.

For example, if a power supply voltage has an allowance to increase a voltage, the output circuits each constituted of the diode-connected transistor and the two resistors are series-connected at n stages, a flowing current is shared, and the two resistance values at each stage are made different from each other. Accordingly, n different output voltages ($V_{REF1}$, $V_{REF2}$, $V_{REF3}$, . . . , $V_{REFn}$) are obtained. Any of these output voltages has no temperature characteristics. Alternatively, as shown in FIG. 34, similar output circuits each constituted of a diode-connected transistor and two resistors are series-connected at n stages, and a flowing current is shared, enabling output voltages to be $nV_{REF}$. Needless to say, since a voltage between stages can be outputted, voltages $V_{REF}$, $2V_{REF}$, $3V_{REF}$, . . . , $nV_{REF}$ are also obtained. In this case, no changes occur in a circuit current.

Figure 24:
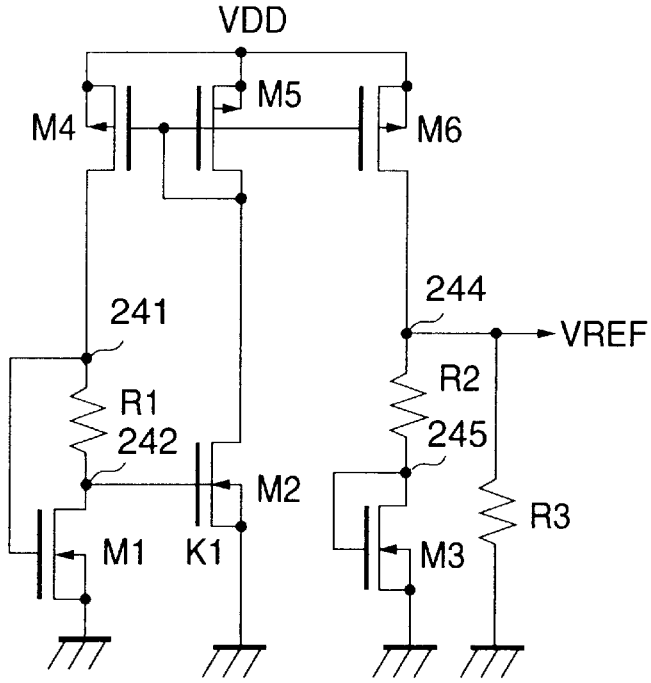
FIG. 24 is a view showing an example of the reference voltage circuit of the eight embodiment of the present invention, using a CMOS self-biased Nagata Widlar reference current circuit.

FIG. 24 shows the reference voltage circuit of the eighth embodiment of the present invention, specifically a CMOS reference current circuit of another embodiment. Referring to FIG. 24, the reference voltage circuit of the eighth embodiment of the present invention is shown to be constructed in a manner that transistors M1 and M2 and a resistor R1 constitute the MOS Nagata current mirror circuit. A feature of the MOS Nagata current mirror circuit is that there are a region where an output current (mirror current) is monotonously increased with respect to an input current (reference current), a peak point, and a region where the output current (mirror current) is monotonously reduced with respect to the input current (reference current). In this case, by transistors M4 and M5 (M6) constituting a current mirror circuit, the transistors M1 and M2, and the resistor R1 constitute the CMOS self-biased Nagata reference current circuit. In FIG. 24, the transistor M1 is a unit transistor, and a ratio (W/L) of a gate width W or a gate length L of the transistor M2 is $K_1$ times ($K_1>1$) as large as that of the unit transistor.

In the MOS Nagata current mirror circuit shown in FIG. 24, the consistency of the circuit element is high, the channel length modulation and a body effect are ignored, and a relation between a drain voltage and a voltage between the gate and the source of the MOS transistor is set according to a square law. Then, a drain current of the MOS transistor M1 is represented by the following equation (163):

$$I_{D1}=\beta(V_{GS1}-V_{TH})^2 \tag{163}$$

Furthermore, a drain current of the MOS transistor M2 is represented by the following equation (164):

$$I_{D2}=K_1\beta(V_{GS2}-V_{TH})^2 \tag{164}$$

In addition, a relation represented by the following equation (165) is established:

$$V_{GS1}=V_{GS2}+R_1I_{D1} \tag{165}$$

By solving the equations (163) to (165), a relation between the input and output currents of the MOS Nagata current mirror circuit is represented by the following equation (166):

$$I_{D2}=K_1\beta R_1^2 I_{D1}\left(\sqrt{I_{D1}}-\frac{1}{\sqrt{R_1\beta}}\right)^2 \tag{166}$$

As in the case of the bipolar Nagata current mirror circuit, a feature of the MOS Nagata current mirror circuit is that there are a region where an output current (mirror current) is monotonously increased with respect to an input current (reference current), a peak point, and a region where the output current (mirror current) is monotonously reduced with respect to the input current (reference current). At the peak point, with $I_{D1}=1/(4R_1^2\beta)$, $I_{D2}=K_1I_{D1}/4$ is set. Thus, with $K_1=4$, $I_{D2}=I_{D1}$ is set. In this case, the transistor M5 constitutes the current mirror circuit with the transistor M4, and the transistors M1 and M2 are respectively driven by the transistors M4 and M5. Therefore, the MOS self-biased Nagata current circuit is provided. Then, a relation is represented by the following equation (167):

$$I_{D1}=I_{D2} \tag{167}$$

Furthermore, a relation represented by the following equation (168) is established:

$$\Delta V_{GS}=V_{GS1}-V_{GS2}R_1I_{D1} \tag{168}$$

By solving the equations (166) to (168), then a relation represented by the following equation (169) is obtained:

$$I_{D1}=\frac{1}{R_1^2\beta}\left(1-\frac{1}{\sqrt{K_1}}\right)^2 \tag{169}$$

Here, $K_1$ denotes a constant having no temperature characteristics. On the other hand, since mobility $\mu$ has a temperature characteristic in the MOS transistor, temperature dependence of the transconductance parameter $\beta$ is represented by the equation (139). Here, $\beta_0$ denotes a value of $\beta$ at a normal temperature (300K). That is, an output current $I_{REF}$ of the CMOS reference current circuit is represented by the following equation (170):

$$I_{REF}=I_{D1}=I_{D2}=\frac{1}{R_1^2\beta_0}\left(\frac{T}{T_0}\right)^{\frac{3}{2}}\left(1-\frac{1}{\sqrt{K_1}}\right)^2 \tag{170}$$

Here, $K_1$ denotes a constant having no temperature characteristics. As described above, the temperature characteristic of $1/\beta$ is substantially proportional to a temperature, being 5000 ppm/° C. at the normal temperature. Thus, if a temperature characteristic of the resistor R2 is equal to or lower than 5000 ppm/° C., being a primary characteristic with respect to the temperature, a drain current $I_{D1}$ has a positive temperature characteristic, and an output current $I_{REF}$ of the reference current circuit outputted through the current mirror circuit is proportional to the temperature, realizing a PTAT current source circuit.

In addition, since the transistor M6 constitutes the current mirror circuit with the transistors M4 and M5, a relation is represented by the following equation (171):

$$I_{D4}I_{D5}I_{D6} \tag{171}$$

A drain current $I_{D6}$ of the transistor M6 is converted into a voltage by the output circuit, becoming a reference voltage $V_{REF}$. If a current flowing to the resistor R2 is $\gamma I_{D6}(0<\gamma<1)$, then the reference voltage $V_{REF}$ is represented by the following equation (172):

$$V_{REF}=V_{BE3}+R_2\gamma I_{D6}=R_3(1-\gamma)I_{D6} \tag{172}$$

By solving the equation (172) for $\gamma$, $\gamma$ is represented by the following equation (173):

$$\gamma=(-V_{BE3}+R_3I_{D6})/\{I_{D6}(R_2+R_3)\} \tag{173}$$

Accordingly, the reference voltage $V_{REF}$ is obtained by the following equation (174)

$$\begin{aligned} V_{REF} &= \{I_{D6}(R_2+R_3)\}(V_{BE3}+R_2I_{D6}) \\ &= \frac{R_3}{R_2+R_3}\left\{V_{GS3}+\frac{R_2}{R_1^2}\left(1-\frac{1}{\sqrt{K_1}}\right)^2\right\} \end{aligned} \tag{174}$$

On the other hand, $V_{GS3}$ is represented by the following equation (175):

$$V_{GS3}=\sqrt{\frac{I_{D3}}{\beta}}+V_{TH}=\sqrt{\frac{I_{D6}}{\beta}}+V_{TH} \tag{175}$$

The equation (175) is rewritten into the following equation (176):

$$\begin{aligned} V_{REF} &= \frac{R_3}{R_2+R_3}\left\{\frac{R_2}{R_1^2}\left(1-\frac{1}{\sqrt{K_1}}\right)^2+\frac{1}{R_1\beta}\left(1-\frac{1}{\sqrt{K_1}}\right)+V_{TH}\right\} \\ &= \frac{R_3}{R_2+R_3}\left[\frac{1}{R_1\beta}\left(1-\frac{1}{\sqrt{K_1}}\right)\left\{\frac{R_2}{R_1}\left(1-\frac{1}{\sqrt{K_1}}\right)+1\right\}+V_{TH}\right] \end{aligned} \tag{176}$$

In this case, the temperature characteristic of the threshold voltage $V_{TH}$ is represented by the following equation (177):

$$V_{TH}=V_{TH0}-\alpha(T-T_0) \tag{177}$$

Here, $\alpha$ is about 2.3 mV/° C. in a CMOS fabrication process of the MOS transistor having a low threshold voltage. Accordingly, the output current $I_{REF}$ of the MOS reference voltage circuit is represented by weighting and adding a term of the threshold voltage $V_{TH}$ having a negative temperature characteristic and a term of $1/\beta$ having a positive temperature characteristic. As a result, by changing weight factors, it is possible to optionally set a temperature characteristic of the reference current.

An output voltage $V_{REF}$ is represented by the following equation (178):

$$V_{REF}=\frac{R_3}{R_2+R_3}\left[\frac{1}{R_1\beta_0}\left(\frac{T}{T_0}\right)^{\frac{3}{2}}\left(1-\frac{1}{\sqrt{K_1}}\right)\left\{\frac{R_2}{R_1}\left(1-\frac{1}{\sqrt{K_1}}\right)+\frac{1}{R_3}\right\}+V_{TH0}-\alpha(T-T_0)\right] \tag{178}$$

A right side of the equation (178) is represented by weighting and adding of voltage values caused by inverse numbers of the threshold voltage $V_{TH}$ having the negative temperature characteristic and the transconductance parameter (mobility) having the positive temperature characteristic. Accordingly, by changing weight factors, it is possible to optionally set a temperature characteristic of the output voltage $V_{REF}$ of the MOS reference voltage circuit as described above. Specifically, a (W/L)/(W/L) ratio, or a current mirror ratio and resistance values, and each resistance ratio may be set.

In this case, the temperature characteristic of $1/\beta$ as an inverse number of the transconductance parameter $\beta$ is substantially proportional to the temperature, which is 5000 ppm/° C. at the normal temperature. The threshold voltage $V_{TH}$ of the transistor M2 has a negative temperature characteristic of about −2.3 mV/° C. The temperature characteristics of the resistance ratios $(R_2/R_1)$ and $R_2/(R_2+R_3)$ are zero because of cancellation, and $\sqrt{K_1}$ has no temperature characteristics. Thus, the output voltage $V_{REF}$ of the MOS reference voltage circuit is decided by the positive temperature characteristic of 5000 ppm/° C., the negative temperature characteristic of the threshold voltage $V_{TH}$ of the transistor M2, and about −2.3 mV/° C.

In order to prevent the output voltage $V_{REF}$ of the MOS reference voltage circuit from having any temperature characteristics in the equation (149), the following equation (179) is established:

$$\frac{1}{R_1\beta_0}\left(1-\frac{1}{\sqrt{K_1}}\right)\left\{\frac{R_2}{R_1}\left(1-\frac{1}{\sqrt{K_1}}\right)+\frac{1}{R_3}\right\}=200\alpha=0.46\ \text{V} \tag{179}$$

Accordingly, if $V_{TH0}$=0.7 V is set, the output voltage $V_{REF}$ is obtained by the following equation (180):

$$V_{REF}=\frac{R_3}{R_2+R_3}(1.16\ \text{V}) \tag{180}$$

In this case, sine $R_3/(R_2+R_3)<1$ is established, if $R_3/(R_2+R_3)$=0.7 is set, $V_{REF}$=0.77 V is established, and an operation is possible from a power supply voltage of about 1.0 V. In addition, as shown in FIG. 33, a current is outputted through the current mirror circuit, and then the current is converted into a voltage by an output circuit constituted of a diode-connected transistor and two resistors, and outputted. Thus, by series-connecting the current mirror circuit with n output circuits having different resistance ratios $(R_3/(R_2+R_3)$, two resistors at each stage, it is possible to obtain n reference voltages having no temperature characteristics.

For example, if a power supply voltage has an allowance to increase a voltage, the output circuits each constituted of the diode-connected transistor and the two resistors are series-connected at n stages, a flowing current is shared, and the two resistance values at each stage are made different from each other. Accordingly, n different output voltages ($V_{REF1}$, $V_{REF2}$, $V_{REF3}$, . . . , $V_{REFn}$) are obtained. Any of these output voltages has no temperature characteristics. Alternatively, as shown in FIG. 34, similar output circuits each constituted of a diode-connected transistor and two resistors are series-connected at n stages, and a flowing current is shared, enabling output voltages to be $nV_{REF}$. Needless to say, since a voltage between stages can be outputted, voltages $V_{REF}$, $2V_{REF}$, $3V_{REF}$, . . . , $nV_{REF}$ are also obtained. In this case, no changes occur in a circuit current.

Figure 25:
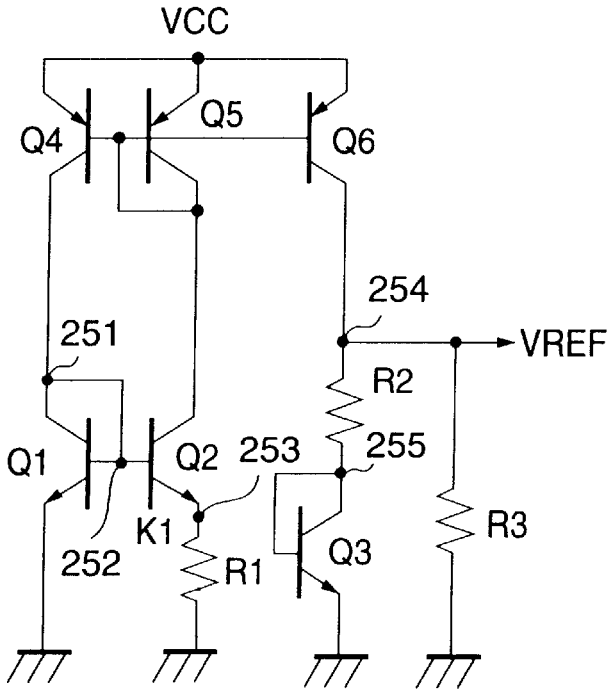
FIG. 25 is a view showing an example of a reference voltage circuit according to a ninth embodiment of the present invention, using a bipolar self-biased Widlar reference current circuit.

FIG. 25 shows a reference voltage circuit according to a ninth embodiment of the present invention, specifically an embodiment of a bipolar reference current circuit. Referring to FIG. 25, the reference voltage circuit of the ninth embodiment of the present invention is shown to be constructed in a manner that transistors Q1 and Q2, and a resistor R1 constitute the bipolar Widlar current mirror circuit. Assuming that a DC current amplification factor of the transistor is sufficiently near 1, by ignoring a base current, in the bipolar Widlar current mirror circuit, from the equation (9), relations are represented by the following equations (181) to (183):

$$V_{BE1}=V_T \ln(I_{C1}/I_s) \quad (181)$$

$$V_{BE2}=V_T \ln\{I_{C2}/(K_1 I_S)\} \quad (182)$$

$$V_{BE1}=V_{BE2}+R_1 I_{C2} \quad (183)$$

Here, by solving the equations (181) to (183), a relation between input and output currents in the bipolar Widlar current mirror circuit is represented by the following equation (184):

$$I_{C1}=(I_{C2}/K_1)\exp(R_1 I_{C2}/V_T) \quad (184)$$

Thus, the relation between the input and output currents of the bipolar Widlar current mirror circuit is just a inverse of a relation between input and output currents of the bipolar inverse Widlar current mirror circuit, and an output current (mirror current) is monotonously increased with respect to an input current (reference current).

In this case, the transistor Q5 constitutes the current mirror circuit with the transistor Q4, and the transistors Q1 and Q2 are respectively driven by the transistors Q4 and Q5. Thus, the bipolar self-biased Widlar reference current circuit is provided, and then a relation is represented by the following equation (185):

$$I_{C1}=I_{C2} \quad (185)$$

Furthermore, since the following equation (186) is established, $$\Delta V_{BE} = V_{BE1} - V_{BE2} = V_T \ln(I_{C1}/I_S) - V_T \ln\{I_{C2}/K_1 I_S)\} \quad (186)$$

$$= V_T \ln(K_1 I_{C1}/I_{C2}) = V_T \ln(K_1) = R_1 I_{C2}$$

the equation (187) is obtained:

$$I_0=I_{C1}=(V_T/R_1)\ln(K_1) \quad (187)$$

Here, $K_1$ denotes a constant having no temperature characteristics and, as described above, the thermal voltage $V_T$ is represented by $V_T$=kT/q, exhibiting a temperature characteristic of 3333 ppm/° C. Accordingly, if a temperature characteristic of the resistor R1 is smaller than the temperature characteristic of the thermal voltage $V_T$, being a primary characteristic with respect to a temperature, an output current $I_{REF}$ (=$I_{C1}$) of the reference current circuit outputted through the current mirror circuit is proportional to the temperature, realizing a PTAT current source circuit. In addition, since the transistor Q5 constitutes a current mirror circuit with the transistors Q4 and Q6, a relation represented by the following equation (188) is established:

$$I_{C4}=I_{C5}=I_{C6}=I_{C1}=I_{C2}=(V_T/R_1)\ln(K_1) \quad (188)$$

A collector current $I_{C6}$ of the transistor Q6 is converted into a voltage by the output circuit, becoming a reference voltage $V_{REF}$. If a current flowing to the resistor R2 is $\gamma I_{C6}$ ($0<\gamma<1$), then the reference voltage $V_{REF}$ is represented by the following equation (189):

$$V_{REF}=V_{BE3}+R_2\gamma I_{C6}=R_3(1-\gamma)I_{C6} \quad (189)$$

By solving the equation (189) for γ, γ is represented by the following equation (190):

$$\gamma=(-V_{BE3}+R_3 I_{C6})/\{I_{C6}(R_2+R_3)\} \quad (190)$$

Thus, the reference voltage $V_{REF}$ is obtained by the following equation (191):

$$V_{REF} = \{I_{C6}(R_2+R_3)\}(V_{BE3}+R_2 I_{C6}) \quad (191)$$

$$= \{I_{C6}(R_2+R_3)\}\{V_{BE3}+(R_2/R_1)V_T \ln(K_1)\}$$

In the equation (191), a coefficient term $R_3/(R_2+R_3)$ is $0<R_3/(R_2+R_3)<1$. In a second term $\{V_{BE3}+(R_2/R_1)V_T \ln(K_1)\}$, $V_{BE3}$ has a negative temperature characteristic of about −1.9 mV/° C., and the thermal voltage $V_T$ has a positive temperature characteristic of 0.0853 mV/° C. Accordingly, in order to prevent the reference voltage $V_{REF}$ to be outputted from having any temperature characteristics, a temperature characteristic is canceled by a voltage having a positive temperature characteristic and a voltage having a negative temperature characteristic. That is, in this case, a value of $(R_2/R_1)\ln(K_1)$ is 22.3, and a voltage value of $(R_2/R_1)V_T \ln(K_1)$ is 0.57 V. Now, if $V_{BE3}$ is 0.7 V, $\{V_{BE3}+(R_2/R_1)V_T \ln(K_1)\}$=1.27 V is obtained. Thus, sine $R_3/(R_2+R_3)<1$ is established, the reference voltage $V_{REF}$ can be set equal to or lower than 1.27 V, e.g., 1.0 V. In addition, as shown in FIG. 33, a current is outputted through the current mirror circuit, and then the current is converted into a voltage by an output circuit constituted of a diode-connected transistor and two resistors, and outputted. Thus, by series-connecting the current mirror circuit with n output circuits having different resistance ratios ($R_3/(R_2+R_3)$, two resistors at each stage, it is possible to obtain n reference voltages having no temperature characteristics.

For example, if a power supply voltage has an allowance to increase a voltage, the output circuits each constituted of the diode-connected transistor and the two resistors are series-connected at n stages, a flowing current is shared, and the two resistance values at each stage are made different from each other. Accordingly, n different output voltages ($V_{REF1}$, $V_{REF2}$, $V_{REF3}$, . . . , $V_{REFn}$) are obtained. Any of these output voltages has no temperature characteristics. Alternatively, as shown in FIG. 34, similar output circuits each constituted of a diode-connected transistor and two resistors are series-connected at n stages, and a flowing current is shared, enabling output voltages to be $nV_{REF}$. Needless to say, since a voltage between stages can be outputted, voltages $V_{REF}$, $2V_{REF}$, $3V_{REF}$, . . . , $nV_{REF}$ are also obtained. In this case, no changes occur in a circuit current.

Figure 26:
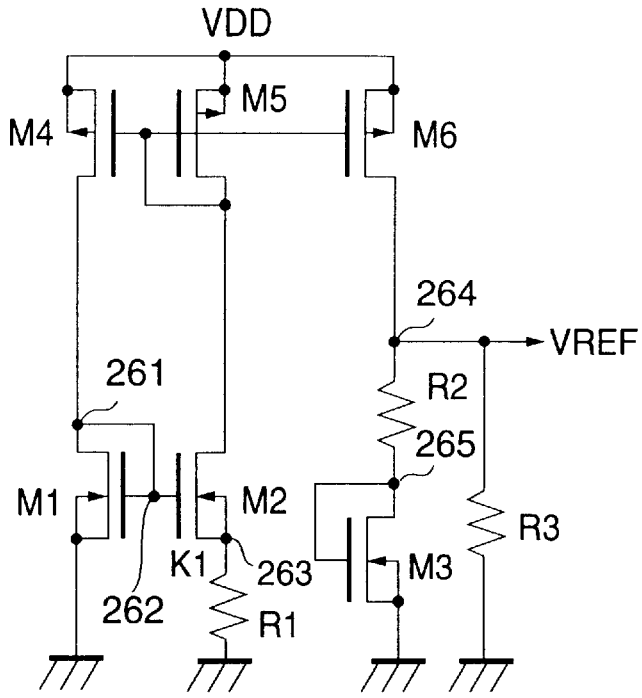
FIG. 26 is a view showing an example of the reference voltage circuit of the ninth embodiment of the present invention, using a CMOS self-biased Widlar reference current circuit.

FIG. 26 shows the reference voltage circuit of the ninth embodiment of the present invention, specifically a CMOS reference current circuit of another embodiment. referring to FIG. 26, the reference voltage circuit of the ninth embodiment of the present invention is shown to be constructed in a manner that transistors M1 and M2 and a resistor R1 constitute the MOS Widlar current mirror circuit. As in the case of the bipolar Widlar current mirror circuit, in the MOS Widlar current mirror circuit, an output current (mirror current) is monotonously increased with respect to an input current (reference current). In this case, by transistors M5 and M6 constituting a current source, the transistors M1 and M2, and the resistor R1 constitute the CMOS self-biased Widlar reference current circuit.

In the MOS Widlar current mirror circuit shown in FIG. 26, the transistor M1 is a unit transistor, and a ratio (W/L) of a gate width W or a gate length L of the transistor M2 is $K_1$ times ($K_1>1$) as large as that of the unit transistor. The consistency of the circuit element is high, the channel length modulation and a body effect are ignored, and a relation between a drain voltage and a voltage between the gate and the source of the MOS transistor is set according to a square law. Then, the drain currents of the MOS transistors M1 and M2 are represented by the following equations (192) and (193):

$$I_{D1}=\beta(V_{GS1}-V_{TH})^2 \tag{192}$$

$$I_{D2}=K_1\beta(V_{GS2}-V_{TH})^2 \tag{193}$$

Furthermore, a relation represented by the following equation (194) is established:

$$V_{GS1}=V_{GS2}+R_1I_{D2} \tag{194}$$

Here, by solving the equations (192) to (194), a relation between input and output currents of the MOS Widlar current mirror circuit is represented by the following equation (195):

$$I_{D2}=\frac{1}{R_1}\sqrt{\frac{I_{D1}}{\beta}}+\frac{1}{2K_1R_1^2\beta}\left(1-\sqrt{1+4K_1R_1\sqrt{I_{D1}}}\right) \tag{195}$$

The relation between the input and output currents of the MOS Widlar current mirror circuit is just a inverse of a relation between input and output currents of the MOS inverse Widlar current mirror circuit. In this case, the transistors M1 and M2 are respectively driven by the transistors M4 and M5. Thus, the MOS self-biased Widlar current circuit is provided. A relation is represented by the following equation (196):

$$I_{D1}=I_{D2} \tag{196}$$

Furthermore, a relation represented by the following equation (197) is established:

$$\Delta V_{GS}=V_{GS1}-V_{GS2}=R_1I_{D2} \tag{197}$$

By solving the equations (192) to (197), a relation represented by the following equation (198) is obtained:

$$I_{D1}=\frac{1}{R_1^2\beta}\left(1-\frac{1}{\sqrt{K_1}}\right)^2 \tag{198}$$

Here, $K_1$ denotes a constant having no temperature characteristics. On the other hand, since the mobility $\mu$ has a temperature characteristic in the MOS transistor, the temperature dependence of the transconductance parameter $\beta$ is represented by the equation (139), and the output current $I_{REF}$ of the CMOS reference current circuit is obtained by the following equation (199):

$$I_{REF}=I_{D1}=\frac{1}{R_1^2\beta_0}\left(\frac{T}{T_0}\right)^{\frac{3}{2}}\left(1-\frac{1}{\sqrt{K_1}}\right)^2 \tag{199}$$

Here, $K_1$ denotes a constant having no temperature characteristics. As described above, the temperature characteristic of $1/\beta$ is substantially proportional to a temperature, being 5000 ppm/° C. at the normal temperature. Thus, if a temperature characteristic of the resistor R2 is equal to or lower than 5000 ppm/° C., being a primary characteristic with respect to the temperature, a drain current $I_{D1}$ has a positive temperature characteristic, and an output current $I_0$ of the reference current circuit outputted through the current mirror circuit is proportional to the temperature, realizing a PTAT current source circuit.

In addition, since the transistor M6 constitutes the current mirror circuit with the transistors M4 and M5, a relation is represented by the following equation (200):

$$I_{D4}=I_{D5}I_{D6} \tag{200}$$

A drain current $I_{D6}$ of the transistor M6 is converted into a voltage by the output circuit, becoming a reference voltage $V_{REF}$. If a current flowing to the resistor R2 is $\gamma I_{D6}(0<\gamma<1)$, then the reference voltage $V_{REF}$ is represented by the following equation (201):

$$V_{REF}=V_{BE3}+R_2\gamma I_{D6}=R_3(1-\gamma)I_{D6} \tag{201}$$

By solving the equation (201) for $\gamma$, $\gamma$ is represented by the following equation (202):

$$\gamma=(-V_{BE3}+R_3I_{D6})/\{I_{D6}(R_2+R_3)\} \tag{202}$$

Accordingly, the reference voltage $V_{REF}$ is obtained by the following equation (203)

$$\begin{aligned}V_{REF}&=\{I_{D6}(R_2+R_3)\}(V_{BE3}+R_2I_{D6})\\&=\frac{R_3}{R_2+R_3}\left\{V_{GS3}+\frac{R_2}{R_1^2}\left(1-\frac{1}{\sqrt{K_1}}\right)^2\right\}\end{aligned} \tag{203}$$

On the other hand, $V_{GS3}$ is represented by the following equation (204):

$$V_{GS3}=\sqrt{\frac{I_{D3}}{\beta}}+V_{TH}=\sqrt{\frac{I_{D6}}{\beta}}+V_{TH} \tag{204}$$

The equation (204) is rewritten into the following equation (205):

$$\begin{aligned}V_{REF}&=\frac{R_3}{R_2+R_3}\left\{\frac{R_2}{R_1^2}\left(1-\frac{1}{\sqrt{K_1}}\right)^2+\frac{1}{R_1\beta}\left(1-\frac{1}{\sqrt{K_1}}\right)+V_{TH}\right\}\\&=\frac{R_3}{R_2+R_3}\left[\frac{1}{R_1\beta}\left(1-\frac{1}{\sqrt{K_1}}\right)\left\{\frac{R_2}{R_1}\left(1-\frac{1}{\sqrt{K_1}}\right)+1\right\}+V_{TH}\right]\end{aligned} \tag{205}$$

In this case, a temperature characteristic of the threshold voltage $V_{TH}$ is represented by the following equation (206):

$$V_{TH}=V_{TH0}-\alpha(T-T_0) \tag{206}$$

Here, $\alpha$ is about 2.3 mV/° C. in a CMOS fabrication process of the MOS transistor having a low threshold voltage. Accordingly, the output current $I_{REF}$ of the MOS reference voltage circuit is represented by weighting and adding a term of the threshold voltage $V_{TH}$ having a negative temperature characteristic and a term of $1/\beta$ having a positive temperature characteristic. As a result, by changing weight factors, it is possible to optionally set a temperature characteristic of the reference current. An output voltage $V_{REF}$ is represented by the following equation (207):

$$V_{REF}=\frac{R_3}{R_2+R_3}\left[\frac{1}{R_1\beta_0}\left(\frac{T}{T_0}\right)^{\frac{3}{2}}\left(1-\frac{1}{\sqrt{K_1}}\right)\left\{\frac{R_2}{R_1}\left(1-\frac{1}{\sqrt{K_1}}\right)+\frac{1}{R_3}\right\}+V_{TH0}-\alpha(T-T_0)\right] \tag{207}$$

A right side of the equation (207) is represented by weighting and adding of voltage values caused by inverse numbers of the threshold voltage $V_{TH}$ having the negative temperature characteristic and the transconductance parameter (mobility) having the positive temperature characteristic. Accordingly, by changing weight factors, it is possible to optionally set a temperature characteristic of the output voltage $V_{REF}$ of the MOS reference voltage circuit as described above. Specifically, a (W/L)/(W/L) ratio, or a current mirror ratio and resistance values, and each resistance ratio may be set.

In this case, a temperature characteristic of 1/β as an inverse number of the transconductance parameter β is substantially proportional to a temperature, which is 5000 ppm/° C. at a normal temperature. The threshold voltage $V_{TH}$ of the transistor M2 has a negative temperature characteristic of about −2.3 mV/° C. The temperature characteristics of the resistance ratios ($R_2/R_1$) and $R_2/(R_2+R_3)$ are zero because of cancellation, and $\sqrt{K_1}$ has no temperature characteristics. Thus, the output voltage $V_{REF}$ of the MOS reference voltage circuit is decided by the positive temperature characteristic of 5000 ppm/° C., the negative temperature characteristic of the threshold voltage $V_{TH}$ of the transistor M2, and about −2.3 mV/° C.

In order to prevent the output voltage $V_{REF}$ of the MOS reference voltage circuit from having any temperature characteristics in the equation (207), the following equation (208) is established:

$$\frac{1}{R_1\beta_0}\left(1-\frac{1}{\sqrt{K_1}}\right)\left\{\frac{R_2}{R_1}\left(1-\frac{1}{\sqrt{K_1}}\right)+\frac{1}{R_3}\right\}=200\alpha=0.46\text{ V} \tag{208}$$

Accordingly, if $V_{TH0}$=0.7 V is set, the output voltage $V_{REF}$ is obtained by the following equation (209):

$$V_{REF}=\frac{R_3}{R_2+R_3}\ (1.16\text{ V}) \tag{209}$$

In this case, sine $R_3/(R_2+R_3)<1$ is established, if $R_3/(R_2+R_3)=0.7$ is set, $V_{REF}$=0.77 V is established, and an operation is possible from a power supply voltage of about 1.0 V. In addition, as shown in FIG. 33, a current is outputted through the current mirror circuit, and then the current is converted into a voltage by an output circuit constituted of a diode-connected transistor and two resistors, and outputted. Thus, by series-connecting the current mirror circuit with n output circuits having different resistance ratios ($R_3/(R_2+R_3)$, two resistors at each stage, it is possible to obtain n reference voltages having no temperature characteristics.

For example, if a power supply voltage has an allowance to increase a voltage, the output circuits each constituted of the diode-connected transistor and the two resistors are series-connected at n stages, a flowing current is shared, and the two resistance values at each stage are made different from each other. Accordingly, n different output voltages ($V_{REF1}$, $V_{REF2}$, $V_{REF3}$, . . . , $V_{REFn}$) are obtained. Any of these output voltages has no temperature characteristics. Alternatively, as shown in FIG. 34, similar output circuits each constituted of a diode-connected transistor and two resistors are series-connected at n stages, and a flowing current is shared, enabling output voltages to be $nV_{REF}$. Needless to say, since a voltage between stages can be outputted, voltages $V_{REF}$, $2V_{REF}$, $3V_{REF}$, . . . , $nV_{REF}$ are also obtained. In this case, no changes occur in a circuit current.

Figure 27:
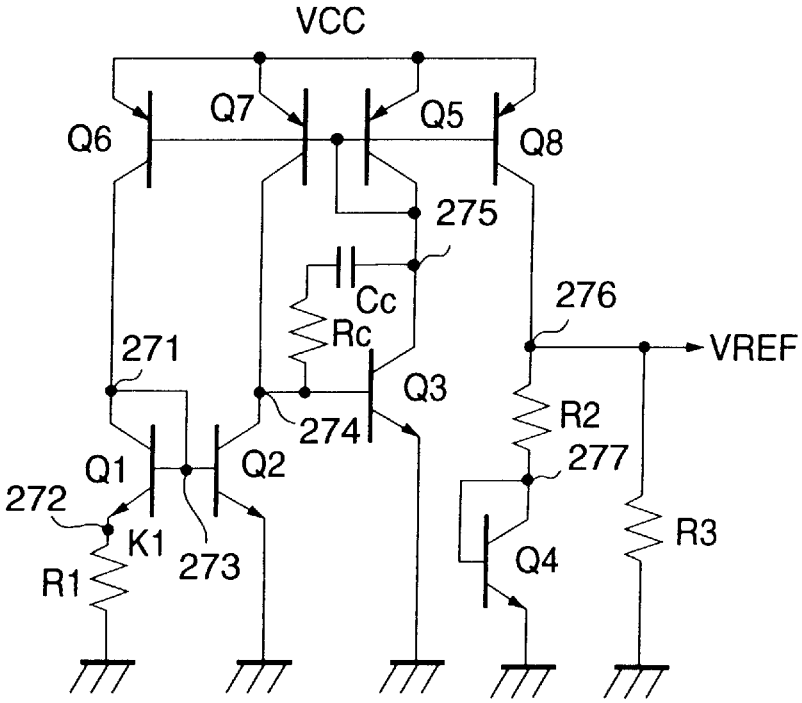
FIG. 27 is a view showing an example of a reference voltage circuit according to a tenth embodiment of the present invention, using a bipolar self-biased inverse Widlar reference current circuit.

Next, description will be made of a tenth embodiment of the present invention. FIG. 27 shows a reference voltage circuit according to the tenth embodiment of the present invention, specifically an embodiment of a bipolar reference voltage circuit. Referring to FIG. 27, the reference voltage circuit of the tenth embodiment of the present invention is shown to be constructed in a manner that transistors Q1 and Q2, and a resistor R1 constitute the bipolar inverse Widlar current mirror circuit. In this case, a resistor $R_C$ and a capacity $C_C$ are both for phase compensation. This circuit is constructed in a manner that in the circuit of FIG. 21 showing the embodiment of the bipolar reference voltage circuit of the seventh embodiment of the present invention, the self-biasing method is changed, a transistor Q3 is added to set collector voltages of the transistors Q1 and Q2 substantially equal to each other, the transistor Q5 is driven by the transistor Q3, and collector currents of the transistors Q6, Q7 and Q8 constituting the current mirror circuit with the transistor Q5 are reduced without being affected by the base width modulation (Early voltages). Thus, a reference voltage $V_{REF}$ to be obtained is similarly represented by the equation (131), and a similar advantage is provided.

Figure 28:
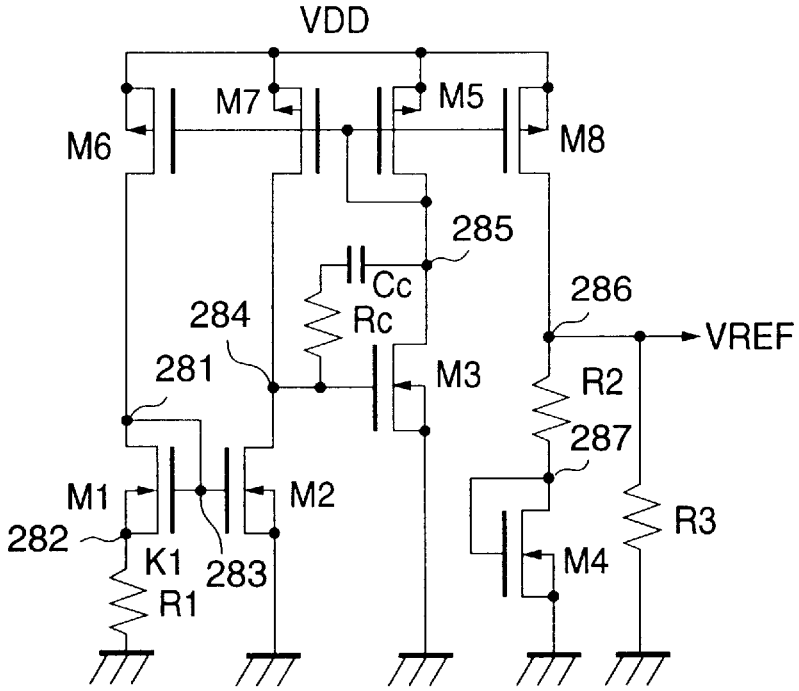
FIG. 28 is a view showing an example of the reference voltage circuit of the tenth embodiment of the present invention, using a CMOS self-biased inverse Widlar reference current circuit.

FIG. 28 shows the reference voltage circuit of the tenth embodiment of the present invention, specifically a MOS reference voltage circuit of another embodiment. Referring to FIG. 28, the reference voltage circuit of the tenth embodiment of the present invention is shown to be constructed in a manner that transistors M1 and M2, and a resistor R1 constitute the MOS inverse Widlar current mirror circuit. In this case, a resistor $R_C$ and a capacity $C_C$ care both for phase compensation. This circuit is constructed in a manner that in the circuit of FIG. 22 showing the embodiment of the MOS reference voltage circuit of the eighth embodiment of the present invention, the self-biased method is changed, a transistor M3 is added to set drain voltages of the transistors M1 and M2 substantially equal to each other, the transistor M5 is driven by the transistor M3, and the drain currents of the transistors M6, M7 and M8 constituting the current mirror circuit with the transistor M5 are reduced without being affected by the channel length width modulation. Thus, a reference voltage $V_{REF}$ to be obtained is similarly represented by the equation (149), and a similar advantage is provided.

Figure 29:
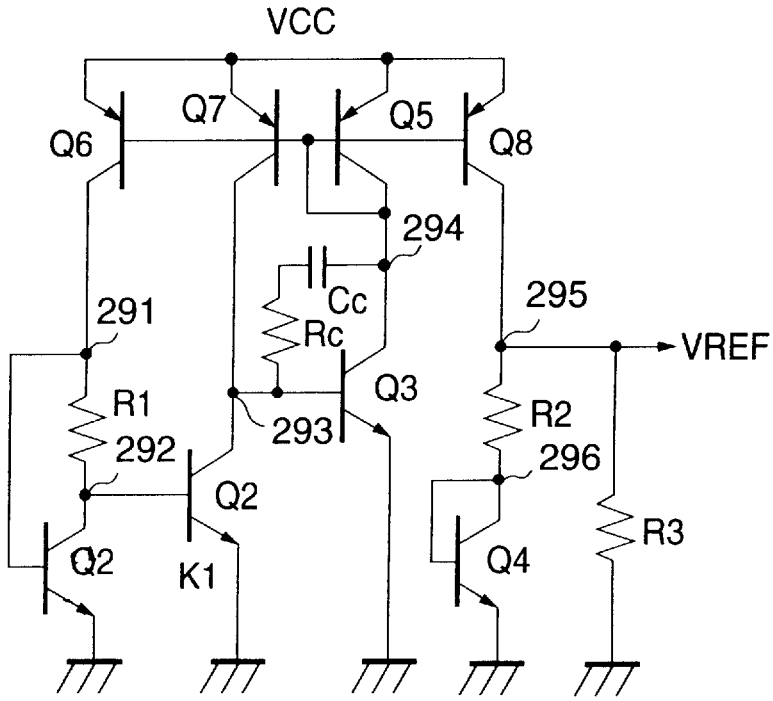
FIG. 29 is a view showing an example of a reference voltage circuit according to an eleventh embodiment of the present invention, using a bipolar self-biased Nagata Widlar reference current circuit.

Likewise, FIG. 29 shows a reference voltage circuit according to an eleventh embodiment of the present invention, specifically an embodiment of a bipolar reference voltage circuit. Referring to FIG. 29, the reference voltage circuit of the eleventh embodiment of the present invention is shown to be constructed in a manner that transistors Q1 and Q2, and a resistor R1 constitute the bipolar Nagata current mirror circuit. In this case, a resistor $R_C$ and a capacity $C_C$ are both for phase compensation. This circuit is constructed in a manner that in the circuit of FIG. 23 showing the embodiment of the bipolar reference voltage circuit of the eighth embodiment of the present invention, the self-biased method is changed, a transistor Q3 is added to set the collector bias voltages of the transistors Q1 and Q2 substantially equal to each other, the transistor Q5 is driven by the transistor Q3, and collector currents of the transistors Q6, Q7 and Q8 constituting the current mirror circuit with the transistor Q5 are reduced without being affected by the base width modulation (Early voltages). Thus, a reference voltage $V_{REF}$ to be obtained is similarly represented by the equation (162), and a similar advantage is provided.

Figure 30:
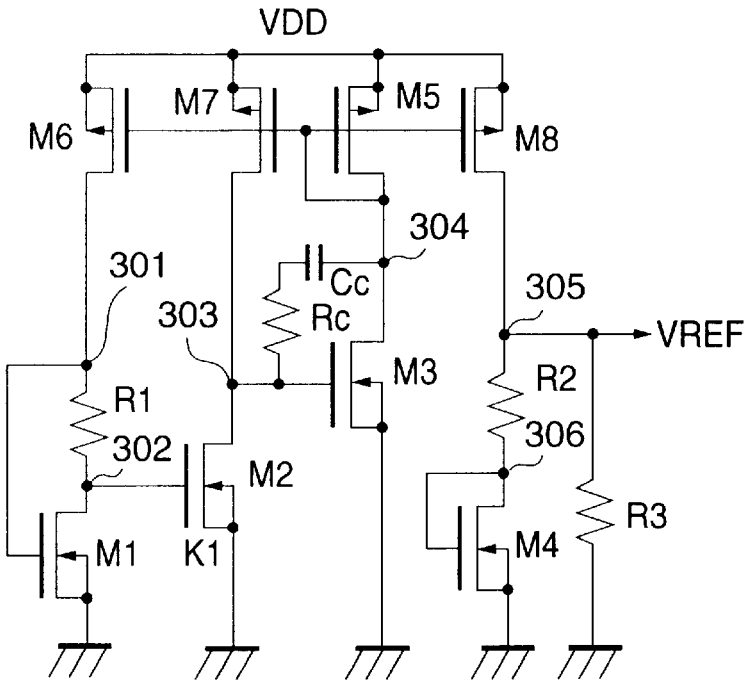
FIG. 30 is a view showing an example of the reference voltage circuit of the eleventh embodiment of the present invention, using a CMOS self-biased Nagata Widlar reference current circuit.

FIG. 30 shows the reference voltage circuit of the eleventh embodiment of the present invention, specifically a MOS reference voltage circuit of another embodiment. Referring to FIG. 30, the reference voltage circuit of the eleventh embodiment of the present invention is shown to be constructed in a manner that transistors M1 and M2, and a resistor R1 constitute the MOS Nagata current mirror circuit. In this case, a resistor $R_C$ and a capacity $C_C$ are both for phase compensation. This circuit is constructed in a manner that in the circuit of FIG. 24 showing the embodiment of the MOS reference voltage circuit of the ninth embodiment of the present invention, the self-biased method is changed, a transistor M3 is added to set the drain voltages of the transistors M1 and M2 substantially equal to each other, the transistor M5 is driven by the transistor M3, and the drain currents of the transistors M6, M7 and M8 constituting the current mirror circuit with the transistor M5 are reduced without being affected by the channel length width modulation. Thus, a reference voltage $V_{REF}$ to be obtained is similarly represented by the equation (178), and a similar advantage is provided.

Figure 31:
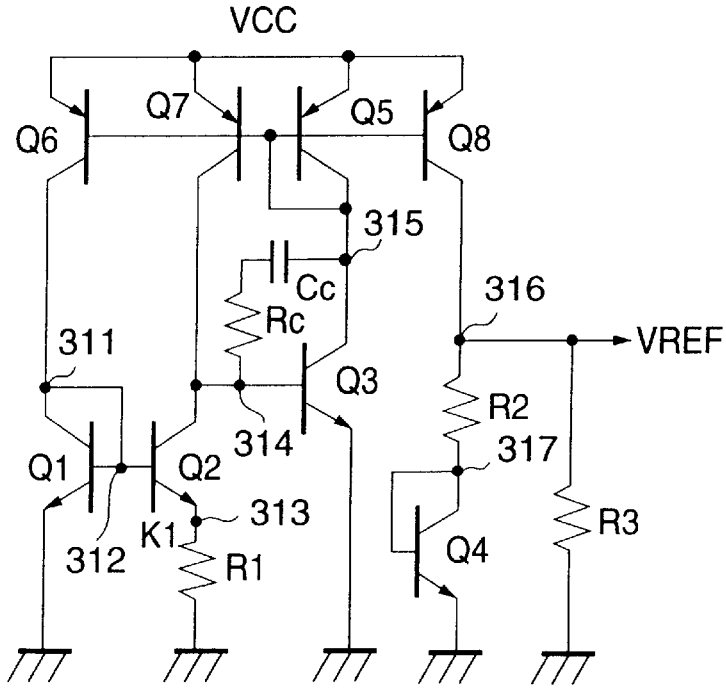
FIG. 31 is a view showing an example of a reference voltage circuit according to a twelfth embodiment of the present invention, using a bipolar self-biased Widlar reference current circuit.

FIG. 31 shows a reference voltage circuit according to a twelfth embodiment of the present invention, specifically an embodiment of a bipolar reference voltage circuit. Referring to FIG. 31, the reference voltage circuit of the twelfth embodiment of the present invention is shown to be constructed in a manner that transistors Q1 and Q2, and a resistor R1 constitute the bipolar Widlar current mirror circuit. In this case, a resistor $R_C$ and a capacity $C_C$ are both for phase compensation. This circuit is constructed in a manner that in the circuit of FIG. 25 showing the embodiment of the bipolar reference voltage circuit of the ninth embodiment of the present invention, the self-biased method is changed, a transistor Q3 is added to set the collector bias voltages of the transistors Q1 and Q2 substantially equal to each other, the transistor Q5 is driven by the transistor Q3, and collector currents of the transistors Q6, Q7 and Q8 constituting the current mirror circuit with the transistor Q5 are reduced without being affected by the base width modulation (Early voltages). Thus, a reference voltage $V_{REF}$ to be obtained is similarly represented by the equation (191), and a similar advantage is provided.

Figure 32:
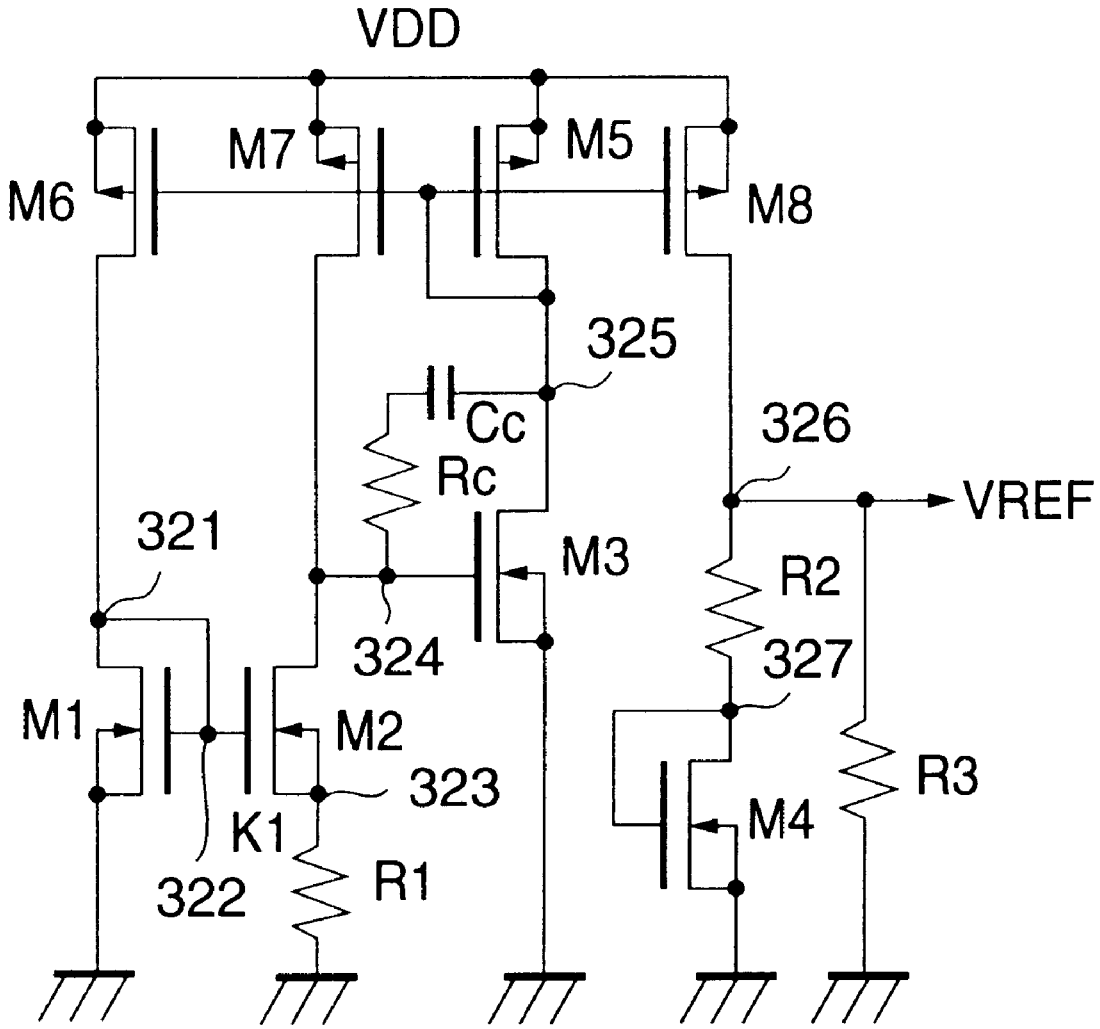
FIG. 32 is a view showing an example of the reference voltage circuit of the twelfth embodiment of the present invention, using a CMOS self-biased Widlar reference current circuit.

FIG. 32 shows the reference voltage circuit of the twelfth embodiment of the present invention, specifically a MOS reference voltage circuit of another embodiment. Referring to FIG. 32, the reference voltage circuit of the twelfth embodiment of the present invention is shown to be constructed in a manner that transistors M1 and M2, and a resistor R1 constitute the CMOS Widlar current mirror circuit. In this case, a resistor $R_C$ and a capacity $C_C$ are both for phase compensation. This circuit is constructed in a manner that in the circuit of FIG. 26 showing the embodiment of the MOS reference voltage circuit of the ninth embodiment of the present invention, the self-biased method is changed, a transistor M3 is added to set the drain voltages of the transistors M1 and M2 substantially equal to each other, the transistor M5 is driven by the transistor M3, and the drain currents of the transistors M6, M7 and M8 constituting the current mirror circuit with the transistor M5 are reduced without being affected by the channel length width modulation. Thus, a reference voltage $V_{REF}$ to be obtained is similarly represented by the equation (207), and a similar advantage is provided.

In addition, the reference voltage circuits of the tenth to twelfth embodiments of the present invention can be series-connected as shown in FIG. 33 or FIG. 34.

Furthermore, a starting-up circuit is necessary for staring a self-biased circuit, which has been omitted in the description of the operation thus far for simplicity. For example, as a simple starting-up circuit, one disclosed in Japanese Patent Application Laid-Open No. 3114561/1996 by the inventors is known.

As apparent from the foregoing, according to the reference current circuit of the present invention, it is possible to provide a highly accurate reference current circuit for outputting a current value proportional to a temperature without being affected by any Early voltages. It is because the negative feedback current loop is formed in the reference current circuit to realize the PTAT current source to be stably operated, and the collector (or drain) voltages of the two transistors constituting the non-linear current mirror circuit are set to the fixed values. According to the reference current circuit of the present invention, it is possible to realize a reference current circuit for outputting an optional current value having an optional temperature characteristic. It is because the reference current output is obtained by adding the current proportional to the temperature of the PTAT current source and the current proportional to VEE (or VGS) of the transistor having a negative temperature characteristic. In addition, according to the reference current circuit of the present invention, an operation voltage of the circuit can be set equal to or lower than 1 V. It is because the reference current circuit is realized by the circuitry for driving one transistor stage by the current mirror circuit, thereby reducing the number of longitudinally loaded circuits.

According to the reference voltage circuit of the present invention, the temperature characteristic is canceled by sharing the output current proportional to the temperature by the transistor diode-connected through the resistor (R2), and the resistor (R3) connected in parallel therewith, and thus providing the output voltage R3/(R2+R3) times (R3/(R2+R3)<1) as large as that of the conventional reference voltage circuit. As a result, it is possible to realize a reference voltage circuit for outputting a voltage of 1.2 V or lower, having no temperature characteristics. According to the reference voltage circuit of the present invention, since the circuit is realized by the current mirror circuit without using any operation amplifiers, it is possible to provide a reference voltage circuit to be operated from a power supply voltage of about 1 V. Moreover, according to the reference voltage circuit of the present invention, the collector (or drain) voltages of the two transistors constituting the non-linear current mirror circuit are set to the fixed values. As a result, it is possible to realize a highly accurate reference voltage circuit, which is not affected by any base width modulation (Early voltages) or any channel length modulation.

What is claimed is:

1. A reference current circuit comprising:

a power supply line;

a ground line;

a current mirror circuit installed between the power supply line and the ground line; and a third transistor connected between between the power supply line and the ground line, wherein the current mirror circuit includes a first resistor having one end connected to a first node, and the other end connected to a second node, a first transistor connected between the second node and the ground line, and having a control terminal connected to the first node, and a second transistor connected between a third node and the ground line, and having a control terminal connected to the second node, and the third transistor has a control terminal connected to the third node, drives the current mirror circuit for setting a current source for driving the first and second transistors as a mirror current, and constitutes a negative feedback current loop.

2. A reference current circuit comprising:

a power supply line;

a ground line;

a current mirror circuit installed between the power supply line and the ground line; and a third transistor connected between the power supply line and the ground line, wherein the current mirror circuit includes a first resistor having one end connected to a second node, and the other end connected to the ground line, a first transistor connected between the first and second nodes, and having a control terminal connected to the first node, and a third node, and a second transistor connected between a fourth node and the ground line, and having a control terminal connected to the third node, and the third transistor has a control terminal connected to the third node, drives the current mirror circuit for setting a current source for driving the first and second transistors as a mirror current, and constitutes a negative feedback current loop.

3. A reference current circuit comprising:

a power supply line;

a ground line;

a current mirror circuit installed between the power supply line and the ground line; and a third transistor connected between the power supply line and the ground line, wherein the current mirror circuit includes a first resistor having one end connected to a fourth node, and the other end connected to the ground line, a first transistor connected between a first node and the ground line, and having a control terminal connected to each of the first node and a second node, and a second transistor connected between a third node and the fourth node, and having a control terminal connected to the second node, and the third transistor has a control terminal connected to the third node, drives the current mirror circuit for setting a current source for driving the first and second transistors as a mirror current, and constitutes a negative feedback current loop.

4. A reference current circuit comprising:

a power supply line;

a ground line;

a current mirror circuit installed between the power supply line and the ground line; and a third transistor connected between the power supply line and the ground line; and second and third resistors, wherein the current mirror circuit includes a first resistor having one end connected to a second node, and the other end connected to the ground line, a first transistor connected between the first and second nodes, and having a control terminal connected to the first node and a third node, and a second transistor connected between a fourth node and the ground line, and having a control terminal connected to the third node, the second resistor has one end connected to the first node, and the other end connected to the ground line, the third resistor has one end connected to the fourth node, and the other end connected to the ground line, and the third transistor has a control terminal connected to the fourth node, drives the current mirror circuit for setting a current source for driving the first and second transistors as a mirror current, and constitutes a negative feedback current loop.

5. A reference current circuit comprising:

a power supply line;

a ground line;

a current mirror circuit installed between the power supply line and the ground line; and a third transistor connected between the power supply line and the ground line; and second and third resistors, wherein the current mirror circuit includes a first resistor having one end connected to a first node, and the other end connected to a second node, a first transistor connected between the second node and the ground line, and having a control terminal connected to the first node and a third node, and a second transistor connected between the third node and the ground line, and having a control terminal connected to the second node, the second resistor has one end connected to the first node, and the other end connected to the ground line, the third resistor has one end connected to the third node, and the other end connected to the ground line, and the third transistor has a control terminal connected to the third node, drives the current mirror circuit for setting a current source for driving the first and second transistors as a mirror current, and constitutes a negative feedback current loop.

6. A reference current circuit comprising:

a power supply line;

a ground line;

a current mirror circuit installed between the power supply line and the ground line;

a third transistor connected between the power supply line and the ground line; and second and third resistors, wherein the current mirror circuit includes a first resistor having one end connected to a fourth node, and the other end connected to a second node, a first transistor connected between a first node and the ground line, and having a control terminal connected to the first and second nodes, and a second transistor connected between a third node and the fourth node, and having a control terminal connected to the second node, the second resistor has one end connected to the first node, and the other end connected to the ground line, the third resistor has one end connected to the third node, and the other end connected to the ground line, and the third transistor has a control terminal connected to the third node, drives the current mirror circuit for setting a current source for driving the first and second transistors as a mirror current, and constitutes a negative feedback current loop.

7. A reference current circuit according to any one of claims 1 to 6, wherein a current outputted from the reference current circuit is supplied into a fifth resistor.

8. A reference current circuit according to claim 7, wherein the fifth resistor includes a plurality of resistors connected in series.

9. A reference current circuit according to any one of claims 1 to 8, wherein a current of the third transistor is set to be substantially inversely proportional to a temperature, a current mirror circuit current flowing to the transistor of the current mirror circuit and the current of the third transistor are weighted and added, and an output current having a fixed temperature characteristic is obtained.

10. A reference voltage circuit comprising:

a power supply line;

a ground line;

a current mirror circuit installed between the power supply line and the ground line; and a third transistor connected between the power supply line and the ground line, wherein the current mirror circuit includes a first resistor having one end connected to a second node, and the other end connected to the ground line, a first transistor connected between a first node and the second node, and having a control terminal connected to the first node and a third node, and a second transistor connected between a fourth node and the ground line, and having a control terminal connected to the third node, the reference voltage circuit being self-biased to constitute a reference current circuit, and including a second resistor having one end connected to a fourth node, and the other end connected to a fifth node, the third transistor connected between the fifth node and the ground line, and having a control terminal connected to the fifth node, and a third resistor having one end connected to the fourth node, and the other end connected to the ground line, and an output voltage being obtained by supplying an output current of the reference current circuit to paths of the third transistor and the third resistor through the second resistor.

11. A reference voltage circuit comprising:

a power supply line;

a ground line;

a current mirror circuit installed between the power supply line and the ground line; and a third transistor connected between the power supply line and the ground line, wherein the current mirror circuit includes a first resistor having one end connected to a first node, and the other end connected to a second node, a first transistor connected between the second node and the ground line, and having a control terminal connected to the first node, and a second transistor connected between a third node and the ground line, and having a control terminal connected to the second node, the reference voltage circuit being self-biased to constitute a reference current circuit, and including a second resistor having one end connected to a fourth node, and the other end connected to a fifth node, the third transistor connected between the fifth node and the ground line, and having a control terminal connected to the fifth node, and a third resistor having one end connected to the fourth node, and the other end connected to the ground line, and an output voltage being obtained by supplying an output current of the reference current circuit to paths of the third transistor and the third resistor through the second resistor.

12. A reference voltage circuit comprising:

a power supply line;

a ground line;

a current mirror circuit installed between the power supply line and the ground line; and a third transistor connected between the power supply line and the ground line, wherein the current mirror circuit includes a first resistor having one end connected to a fourth node, and the other end connected to the ground line, a first transistor connected between a first node and the second node, and having a control terminal connected to the first node and a second node, and a second transistor connected between a third node and the fourth node, and having a control terminal connected to the second node, the reference voltage circuit being self-biased to constitute a reference current circuit, and including a second resistor having one end connected to the fourth node, and the other end connected to a fifth node, the third transistor connected between the fifth node and the ground line, and having a control terminal connected to the fifth node, and a third resistor having one end connected to the fourth node, and the other end connected to the ground line, and an output voltage being obtained by supplying an output current of the reference current circuit to paths of the third transistor and the third resistor through the second resistor.

13. A reference voltage circuit comprising:

a power supply line;

a ground line;

a current mirror circuit installed between the power supply line and the ground line; and a third transistor connected between the power supply line and the ground line, wherein the current mirror circuit includes a first resistor having one end connected to a second node, and the other end connected to the ground line, a first transistor connected between a first node and the second node, and having a control terminal connected to the first node and a third node, and a second transistor connected between a fourth node and the ground line, and having a control terminal connected to the third node, the third transistor connected between a fifth node and the ground line drives a reference transistor of the current mirror circuit for setting a current source for driving the first and second transistors as a mirror current, and constitutes a negative feedback current loop, and the reference voltage circuit including a second resistor having one end connected to the fourth node, and the other end connected to the fifth node, the third transistor connected between the fifth node and the ground line, and having a control terminal connected to the fifth node, and a third resistor having one end connected to the fourth node, and the other end connected to the ground line, and an output voltage being obtained by supplying an output current proportional to a current of the current source for driving the first and second transistors to paths of the third transistor and the third resistor through the second resistor.

14. A reference voltage circuit comprising:

a power supply line;

a ground line;

a current mirror circuit installed between the power supply line and the ground line; and a third transistor connected between the power supply line and the ground line, wherein the current mirror circuit includes a first resistor having one end connected to a first node, and the other end connected to a second node, a first transistor connected between the second node and the ground line, and having a control terminal connected to the first node, and a second transistor connected between a third node and the ground line, and having a control terminal connected to the second node, and the third transistor connected between a fifth node and the ground line wire drives a reference transistor of the current mirror circuit for setting a current source for driving the first and second transistors as a mirror current, and constitutes a negative feedback current loop, the reference voltage circuit including a second resistor having one end connected to a fourth node, and the other end connected to the fifth node, the third transistor connected between the fifth node and the ground line, and having a control terminal connected to the fifth node, and a third resistor having one end connected to the fourth node, and the other end connected to the ground line, and an output voltage being obtained by supplying an output current proportional to a current of the current source for driving the first and second transistors to paths of the third transistor and the third resistor through the second resistor.

15. A reference voltage circuit comprising:

a power supply line;

a ground line;

a current mirror circuit installed between the power supply line and the ground line; and a third transistor connected between the power supply line and the ground line, wherein the current mirror circuit includes a first resistor having one end connected to a fourth node, and the other end connected to the ground line, a first transistor connected between a first node and the ground line, and having a control terminal connected to the first node and a second node, and a second transistor connected between a third node and the fourth node, and having a control terminal connected to the second node, and the third transistor connected between a fifth node and the ground line drives a reference transistor of the current mirror circuit for setting a current source for driving the first and second transistors as a mirror current, and constitutes a negative feedback current loop, the reference voltage circuit including a second resistor having one end connected to the fourth node, and the other end connected to the fifth node, the third transistor connected between the fifth node and the ground line, and having a control terminal connected to the fifth node, and a third resistor having one end connected to the fourth node, and the other end connected to the ground line, and an output voltage being obtained by supplying an output current proportional to a current of the current source for driving the first and second transistors to paths of the third transistor and the third resistor through the second resistor.

16. A reference voltage circuit according to any one of claims 11 to 15, wherein an output circuit composed of a fourth transistor having a control terminal connected through the second resistor to a current input terminal, and a current output terminal connected to the ground line, and the third resistor having one terminal connected to the ground line, and the current mirror circuit for driving the output circuit are series-connected by n stages, and n output voltages are outputted.

17. A reference voltage circuit according to any one of claims 11 to 15, wherein an output circuit composed of a fourth transistor having a control terminal connected through the second resistor to a current input terminal, and a current output terminal connected to the ground line, and the third resistor having one terminal connected to the ground line is series-connected by n stages, and n output voltages are outputted by sharing a circuit current.

18. A reference current circuit according to any one of claims 1 to 9, wherein the first to third transistors are bipolar transistors.

19. A reference current circuit according to any one of claims 1 to 9, the first to third transistors are field-effect transistors.

20. A reference voltage circuit according to any one of claims 10 to 17, wherein the first to third transistors are bipolar transistors.

21. A reference voltage circuit according to any one of claims 10 to 17, wherein the first to third transistors are field-effect transistors.

* * * * *